US005427127A

United States Patent [19]

Nogi et al.

[11] Patent Number: 5,427,127

[45] Date of Patent: Jun. 27, 1995

[54] METHOD AND APPARATUS FOR WASHING DISHES, STICKING INHIBITOR AND RINSING ASSISTANT

[75] Inventors: Munehiro Nogi; Koichiro Miyazaki, both of Sakai; Seiji Takubo, Osaka; Yoshio Amimoto, Takatsuki; Ryutaro Ohashi, Tondabayashi, all of Japan

[73] Assignee: Daikin Industries, Ltd., Osaka, Japan

[21] Appl. No.: 214,701

[22] Filed: Mar. 18, 1994

Related U.S. Application Data

[62] Division of Ser. No. 736,497, Jul. 26, 1991.

[30] Foreign Application Priority Data

Jul. 27, 1990 [JP] Japan ..... 2-199692

[51] Int. Cl.[6] ..... B08B 3/08

[52] U.S. Cl. ..... 134/100.1; 134/95.3; 134/93

[58] Field of Search ..... 252/174.23; 138/95.3, 138/100.1, 200, 176, 179, 200, 93

[56] References Cited

U.S. PATENT DOCUMENTS

| | | |
|---|---|---|
| 2,370,609 | 2/1945 | Wilson et al. . |
| 2,678,303 | 5/1954 | Bonewitz . |
| 2,867,224 | 1/1959 | Mariniak et al. . |
| 3,055,555 | 9/1962 | Reiter . |
| 3,062,878 | 11/1962 | Karabinos . |
| 3,074,927 | 1/1963 | Saltman et al. . |
| 3,701,735 | 10/1972 | Finck . |
| 3,969,134 | 7/1976 | Batka et al. . |
| 4,443,270 | 4/1984 | Biard et al. . |
| 4,737,308 | 4/1988 | Pearson . |

FOREIGN PATENT DOCUMENTS

| | | |
|---|---|---|
| 0282214 | 9/1988 | European Pat. Off. . |
| 0291713 | 11/1988 | European Pat. Off. . |
| 1792358 | 10/1872 | Germany . |
| 1728093 | 3/1972 | Germany . |
| 1792357 | 3/1972 | Germany . |
| 2412836 | 11/1974 | Germany . |
| 2432366 | 6/1975 | Germany . |
| 2444974 | 9/1975 | Germany . |
| 2518391 | 11/1976 | Germany . |

*Primary Examiner*—Frankie L. Stinson

[57] ABSTRACT

A dish washing method includes a process for applying a sticking inhibitor to the surface of dishes in order to make it easy to remove food from the surface of the dishes. The sticking inhibitor is a compound having hydrophilic and hydrophobic groups. The compound is absorbed to the surfaces of the dishes by the hydrophilic groups, and is absorbed to food surfaces by the hydrophobic groups. The compound is a compound containing a fluoroalkyl group. Also, a dish washer has a reservoir for storing therein the sticking inhibitor and a passageway for joining the sticking inhibitor with a detergent.

4 Claims, 30 Drawing Sheets

(A)

Rf: $CF_3CF_2(CF_2CF_2)_n^-$ n: 2–8
(Polyfluoroalkyl group) (primarily 3)

PEG: $-(OCH_2CH_2)_m-OCH_3$ m: 2–23
(Methoxypolyoxyethylene)

(B)

(C)

(D)

METHOD AND APPARATUS FOR WASHING DISHES, STICKING INHIBITOR AND RINSING ASSISTANT

This application is a divisional of copending application Ser. No. 07/736,497, filed on Jul. 26, 1991, the entire contents of which are hereby incorporated by reference.

BACKGROUND OF THE INVENTION

1. Field of the Invention

The present invention relates to a method of washing dishes by which food such as the remains of a meal is prevented from sticking to dish surfaces, and further relates to apparatus, sticking inhibitors and rinsing assistants used for the method.

2. Description of the Prior Art

There is conventionally provided such a dishwasher as shown in FIG. 27, as a dishwasher for business use, for example, in restaurants. This business-use dishwasher is arranged in the following way: A rack 27 on which dishes B are placed is accommodated between pairs of washing arms 23, 24 and rinsing arms 25, 26, each pair being oppositely disposed above and below in a washing chamber 22 provided in a casing 21 and the pairs being adapted to spin. A detergent C stored at the bottom of the washing chamber 22 is sprayed from the washing arms 23, 24 through washing piping 30 by a washing pump 29 having a filter 28, thereby washing dishes. After that, tap water passing through an electromagnetic valve 31 is warmed by an electric water heater 32, and the resulting warm water W is sprayed from the rinsing arms 25, 26 through rinsing piping 33 so as to rinse the dishes B. In addition, detergent and water are discharged outside from a drain 35 through drain piping 36 before overflowing a strainer pan 34 located at the bottom of the washing chamber 22.

The dishes B, washed with the detergent rinsed with the warm water, are allowed to dry by themselves without the need of toweling by virtue of a high temperature of the above-mentioned warm water as much as 80° C. or so, and drawn out of the washing chamber 22 after drying.

On the other hand, a conventional dishwasher for household use is shown in FIG. 28. This household-use dishwasher is arranged in the following way: A rack 73 on which dishes B are placed is accommodated in a washing chamber 72 provided in a casing 71. A detergent C stored in a reservoir 74 at the bottom of the washing chamber 72 is sprayed up toward the rack 73 from an arm 78 through piping 77 by a circulating pump 76 having a filter 75. After washing dishes B, the detergent C in the reservoir 74 is drained by a drain pump 79. Then an electromagnetic valve 80 is opened so that the reservoir 74 is filled with fresh water to the brim through a water supply pipe 81. The supplied fresh water is resprayed from the arm 78 by the circulating pump 76, thereby rendering the rinsing of the dishes B at least one time. The dishes B washed with the detergent and rinsed with the fresh water are taken out of the washing chamber 72 and toweled.

Thus, the dishes B after the washing and drying through the business-use and household-use dishwashers are filled with food such as rice or meat and vegetables, and served to customers in a restaurant or members of a family.

In the rinsing process, in either case of the above-mentioned dishwashers, a rinsing assistant based on a surface-active agent is added to the warm water W or fresh water. This rinsing assistant serves to accelerate the wetting of dish surfaces and to cause film-like flow of water to take place on dish surfaces, thereby washing away the detergent having been used in the washing process and remaining on dish surfaces. The rinsing assistant also prevents concentration of insoluble matters such as mineral matters contained in the water from occurring on dish surfaces as water spots, when the dishes are heated by warm water in a washing process or rinsing process, and the film-like water on the surface of the dishes is evaporated by the remaining heat of the dishes.

When rice served to customers in a restaurant is uneaten and left on dish surfaces, the rice becomes increasingly dried as time goes on, sticking to dish surfaces still more fixedly. There arises a problem therefrom that only washing the dishes with a business-use dishwasher will not readily remove the remains of rice. This problem, in particular, will be more serious and critical in business-use dishwashers that are designed to wash a bulk of dishes having been left for a long time period after use, unlike in household-use dishwashers.

As a result, to solve the above problem, restaurants or the like have conventionally adopted such a countermeasure that after-use dishes to which the remains of rice are sticking are immersed in a bath before washing so as to make them easily removed. This countermeasure, however, takes substantial time and labor for the immersion, which would be an obstacle to saving time and labor in dish washing as originally intended for the dishwashers.

Further, in households, it is often the case that all members of a family cannot take a meal together and therefore dishes of the first person that has taken a meal are washed together with those of the last person that has taken a meal. In small-in-number families, as another case, dishes for a meal and dishes for the successive meal may collectively be washed. In such cases, the remains of rice are sticking to dishes fixedly at the time of washing, with the result that the remains will not be removed unless the dishes are washed by a household-use dishwasher for a long time.

As the above-mentioned rinsing assistant used in the rinsing process, examples include a surfactant of an ester formed of a polyhydroxy alcohol such as sorbitan (trade name) or sucrose and a fatty acid such as capric acid or stearic acid, or a surfactant based on the partial ester thereof or one of a Pulronic-series (trade name). Disadvantageously, these rinsing assistants have a defect that the surfactant itself remains on dish surfaces as stains or water spots, or decreases the gloss of dish surfaces. Moreover, the above-mentioned rinsing assistants in all cases can be used only in a narrow concentration range of 100 to 50 ppm, making the concentration preparation thereof difficult.

SUMMARY OF THE INVENTION

The object of the present invention is therefore to provide a sticking inhibitor under such an original idea that food such as rice is made easy to remove from dishes preventively in advance, whereas it otherwise tends to stick to dishes as it becomes increasingly dried while being left after use, and to further provide a dish washing method and dishwasher used for the method which can save time and labor in washing dishes by eliminating the need of immersing dishes in a bath in restaurants, or that of washing dishes for a long time in households, by the use of the sticking inhibitor.

Another important object of the present invention is to provide a rinsing assistant which has both sticking prevention function for making food easy to remove and a rinsing enhancement function, without leaving stains or water spots on dish surfaces after rinsing but with an excellent gloss added thereto, and yet which can be used in a wide concentration range, and to further provide a dish washing method and dishwasher used for the method which can save time and labor in washing dishes and moreover render a successful rinsing finish of dishes with the aid of the rinsing assistant.

In order to achieve the aforementioned object, a dishwashing method of the present invention is characterized in that a sticking inhibitor is applied to surfaces of dishes in order to make food easy to remove from the surfaces of dishes.

Preferably, the sticking inhibitor contains a compound having hydrophilic groups and hydrophobic groups, said compound being adsorbed to the surfaces of the dishes by the hydrophilic groups and being adsorbed to food surfaces by the hydrophobic groups.

Preferably, the above-mentioned compound is a compound containig a fluoroalkyl group.

Preferably, the sticking inhibitor contains at least one polymer selected from the group consisting of a homopolymer of phoshate esters having a perfluoroalkyl group, an acrylate or methacrylate having a fluoroalkyl group and a hydrophilic group and a copolymer comprising (a) a repeating unit derived from an acrylate or methacrylate having a fluoroalkyl group and a hydrophilic group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide.

Preferably, the copolymer further comprises a repeating unit derived from at least one polymerizable compound having no fluoroalkyl group selected from the group consisting of ethylene, vinyl chloride, vinylidene halogenide, styrene, acrylic acid and its alkyl esters, methacrylate and its alkyl esters, benzyl methacrylate, vinyl alkyl ketone, vinyl alkyl ether, butaxdiene, isoprene, chloroprene and maleic anhydride.

On the other hand, a dish washing method of the present invention is characterized in that a sticking inhibitor for preventing food from sticking to surfaces of dishes is applied to the dishes. The sticking inhibitor may be applied to dishes by adding it to a detergent in a washing process, spraying it between the washing and rinsing processes, adding it to rinsing warm water in the rinsing process, or spraying it upon completion of the rinsing process.

A first dishwasher of the present invention is so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes; and a passageway for joining the sticking inhibitor in the reservoir with said detergent.

Also, the first dishwasher may be provided with a pump for supplying the sticking inhibitor in the reservoir to the bottom of the washing chamber or the washing piping through the passageway, and moreover the pump may be a diaphragm pump adapted to be intermittently driven by liquid pressure of the detergent. Further, the diaphragm pump may be an electric diaphragm pump controlled by a controller. Otherwise, an ejector may be connected to an end of the passageway, and further connected to the washing piping.

A second dishwasher of the present invention is so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes or a rinsing assistant having both sticking prevention function for making food easy to remove and rinsing enhancement function; and a passageway for joining the sticking inhibitor or rinsing assistant in the reservoir with said warm water.

That is, the second dishwasher comprises a passageway for joining the sticking inhibitor or a rinsing assistant in the reservoir, the rinsing assistant having both functions of sticking prevention and rinsing enhancement, with the warm water instead of the passageway of the dishwasher of the above first dishwasher.

Also, the second dishwasher may be provided with a pump for supplying the sticking inhibitor or rinsing assistant in the reservoir to the water heater through the passageway.

Otherwise, an ejector may be connected to an end of the passageway and further connected to the rinsing piping.

A third dishwasher of the present invention is so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes or a rinsing assistant having both sticking prevention function for making food easy to remove and rinsing enhancement function;

a spray nozzle for spraying said sticking inhibitor or rinsing assistant to the dishes; and a pump for supplying said sticking inhibitor or rinsing assistant in said reservoir through spray piping to said spray nozzle.

That is, the third dishwasher comprising instead of the passageway of the above-described first dishwasher: spray nozzles for spraying the sticking inhibitor or a rinsing assistant having both functions of sticking prevention and rinsing enhancement; and a pump for supplying the sticking inhibitor or rinsing assistant in the reservoir to the spray nozzles through spray piping.

A fourth dishwasher of the present invention is so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes or a rinsing assistant having both sticking prevention function for making food easy to remove and rinsing enhancement function;

water piping having at an end thereof a spray nozzle for spraying water toward the dishes;

agent piping communicated with the reservoir; and an ejector connected to an end of the agent piping and further connected to said water piping.

That is, the fourth dishwasher comprises instead of the passageway of the above-described first dishwasher: water piping having at its ends spray nozzles for spraying water toward dishes; agent piping communicated with the reservoir; and an ejector connected to an end of the agent piping and further connected to the water piping.

A dish washing method of the present invention is characterized in that it comprises a process for applying to surfaces of dishes a rinsing assistant having both sticking prevention function, by which food is made easy to remove, and rinsing enhancement function.

Preferably, the rinsing assistant includes hydrophilic groups and hydrophobic groups and is adsorbed to the surfaces of the dishes by the hydrophilic groups and is adsorbed to food surfaces by the hydrophobic groups.

Preferably, the above-mentioned rinsing assistant contains, as an active ingredient, at least one polymer selected from the group consisting of a homopolymer of an acrylate or methacrylate having a fluoroalkyl group and a hydrophilic group and a copolymer comprising (a) a repeating unit derived from an acrylate or methacrylate having a fluoroalkyl group and a hydrophilic group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide.

Furthermore, the copolymer preferably comprises a repeating unit derived from at least one polymerizable compound having no fluoroalkyl group selected from the group consisting of ethylene, vinyl chloride, vinylidene halogenide, styrene, acrylic acid and its alkyl esters, methacrylate and its alkyl esters, benzyl methacrylate, vinyl alkyl ketone, vinyl alkyl ether, butaxdiene, isoprene, chloroprene and maleic anhydride.

Preferably, the rinsing assistant may be applied to dishes in either way of adding it to rinsing warm water in the rinsing process or spraying it to dishes upon completion of the rinsing process.

A fifth dishwasher of the present invention is so arranged that dishes are accommodated on a rack provided in a washing chamber, a detergent at the bottom of the washing chamber is sprayed from an arm through piping toward the dishes by a circulating pump, thereafter the detergent at the bottom of the washing chamber is drained by drain means and fresh water is supplied to the bottom of the washing chamber, thereby effecting rinsing of the dishes at least one time by the circulating pump, the dishwasher comprising:

a reservoir for storing therein a sticking inhibitor for making food easy to remove from the dishes or a rinsing assistant having both sticking prevention function for making food easy to remove and rinsing enhancement function; and a passageway for joining the sticking inhibitor in the reservoir with said detergent.

A sixth dishwasher of the present invention is so arranged that dishes are accommodated on a rack provided in a washing chamber, a detergent at the bottom of the washing chamber is sprayed from an arm through piping toward the dishes by a circulating pump, thereafter the detergent at the bottom of the washing chamber is drained by drain means and fresh water is supplied to the bottom of the washing chamber, thereby effecting rinsing of the dishes at least one time by the circulating pump, the dishwasher comprising:

a reservoir for storing therein a sticking inhibitor for making food easy to remove from the dishes or a rinsing assistant having both sticking prevention function for making food easy to remove and rinsing enhancement function;

a spray nozzle for spraying said sticking inhibitor or rinsing assistant to the dishes; and a pump for supplying said sticking inhibitor or rinsing assistant in said reservoir through spray piping to said spray nozzle.

That is, the sixth dishwasher comprises instead of the passageway of the fifth dishwasher: spray nozzles for spraying the sticking inhibitor or rinsing assistant; and a pump for supplying the sticking inhibitor or rinsing assistant in the reservoir to the spray nozzles through spray piping.

A seventh dishwasher of the present invention is so arranged that dishes are accommodated on a rack provided in a washing chamber, a detergent at the bottom of the washing chamber is sprayed from an arm through piping toward the dishes by a circulating pump, thereafter the detergent at the bottom of the washing chamber is drained by drain means and fresh water is supplied to the bottom of the washing chamber, thereby effecting rinsing of the dishes at least one time by the circulating pump, the dishwasher comprising:

a reservoir for storing therein a sticking inhibitor for making food easy to remove from the dishes or a rinsing assistant having both sticking prevention function for making food easy to remove and rinsing enhancement function;

water piping having at an end thereof a spray nozzle for spraying water toward the dishes;

agent piping communicated with the reservoir; and an ejector connected to an end of the agent piping and further connected to said water piping. That is, the seventh dishwasher comprises instead of the passageway of the fifth dishwasher: water piping having at its ends spray nozzles for spraying water toward dishes; agent piping communicated with the reservoir; and an ejector connected to an end of the agent piping and further connected to the water piping.

An eighth dishwasher of the present invention is so arranged that dishes are accommodated on a rack provided in a washing chamber, a detergent at the bottom of the washing chamber is sprayed from an arm through piping toward the dishes by a circulating pump, thereafter the detergent at the bottom of the washing chamber is drained by drain means and fresh water is supplied to the bottom of the washing chamber, thereby effecting rinsing of the dishes at least one time by the circulating pump, the dishwasher comprising:

a reservoir for storing therein a sticking inhibitor for making food easy to remove from the dishes or a rinsing assistant having both sticking prevention function for making food easy to remove and rinsing enhancement function;

water piping having at an end thereof a spray nozzle for spraying water toward the dishes;

a water reservoir provided to the water piping; and a pump and piping for supplying the sticking inhibitor or rinsing assistant to the water reservoir.

That is, the eighth dishwasher comprises a water reservoir disposed at the position of the ejector of the seventh dishwasher instead thereof; and a pump and agent piping for supplying the sticking inhibitor or rinsing assistant in the reservoir to the water reservoir.

The function of the present invention is described hereinbelow.

The sticking inhibitor of the present invention is adsorbed to the surfaces of dishes made of earthenware, porcelain, glass, or metal by hydrophilic groups in hydrogen bond while it makes contact with food such as rice left uneaten on dishes by hydrophobic groups only with the dispersion force acting between almost no-polar molecules. The bonding between the food and the hydrophobic groups of the sticking inhibitor is by dispersion force and therefore weak, thus the sticking inhibitor making it rather difficult for food to stick to dishes. As a result, even dry rice will easily be removed from dishes by washing. In addition, if the above-mentioned sticking inhibitor is a compound having fluoroalkyl groups or a phosphoric ester containing perfluoroalkyl groups, still more effect for removing food can be obtained in washing.

The dish washing method of the present invention is such that a sticking inhibitor for making food easy to remove from dish surfaces is applied to dishes, thus facilitating the removal of rice left uneaten on dishes once washed. Moreover, even if the rice is dried, it can readily be removed from dishes by later washing. To more effects, if the sticking inhibitor is added to the detergent in the washing process, a dispersion characteristic of the sticking inhibitor is enhanced, increasing the degree of sticking to dishes. As another case, if the sticking inhibitor is sprayed upon completion of the rinsing process, it can be applied uniformly to clean surfaces of dishes. Also if it is sprayed between the washing process and the rinsing process, nearly the same but slightly lower effect can be obtained. Further, if the sticking inhibitor is added to rinsing warm water in the rinsing process, it is stuck to dishes through remaining heat drying by high-temperature rinsing warm water without any loss.

In the first dishwasher of the present invention, a sticking inhibitor stored in the reservoir is joined with a detergent pumped by a washing pump in the washing process through a passageway and, being added thereto, sprayed toward dishes from a washing arm. As a result, the detergent enhances the dispersion characteristic of the sticking inhibitor, increasing the degree of sticking to dishes. Thus, the sticking inhibitor applied to dish surfaces after washing allows rice left uneaten on the dish surfaces, even if dried, to be readily removed from dishes only by washing with the above dishwasher. In addition, if the sticking inhibitor in the reservoir is supplied to the bottom of the washing chamber or the washing piping through the passageway by a pump, the sticking inhibitor will be mixed with the detergent more perfectly. And if the pump is a diaphragm pump driven by the pressure of the detergent, the driving source can be omitted, which contributes to reduction in cost and size of the system. Moreover, if an ejector is provided at an end of the above-mentioned passageway, the pump and its driving source can be omitted, allowing the system to be cost-reduced and compacted.

In the second dishwasher of the present invention, the sticking inhibitor in the reservoir is joined with warm water through the passageway in the rinsing process, being sprayed from the rinsing arm toward dishes. The sticking inhibitor is stuck to dishes through remaining heat drying by high-temperature rinsing warm water without any loss, whereby the rice left uneaten on dishes, even if dried, can be readily removed from the dishes only by washing with the above dishwasher. In addition, the operations in the case where a pump is provided and the pump is a diaphragm pump or where an ejector is provided are the same as above.

In the third dishwasher of the present invention, the sticking inhibitor in the reservoir is supplied to the spray nozzles through the spray piping by the pump between the washing process and the rinsing process or upon completion of the rinsing process, and then sprayed from the spray nozzles toward dishes. The sticking inhibitor can be applied uniformly to clean surfaces of dishes upon completion of the rinsing process, while it can be with nearly the same but a little less effect as the foregoing between the washing and the rinsing processes. Thus, even dried rice left uneaten on dishes can readily be removed therefrom only by washing with the dishwasher, as in the above case.

In the fourth dishwasher of the present invention, the sticking inhibitor in the reservoir is joined with water in the water piping through the sticking-inhibitor piping by the ejector disposed at one end thereof between the washing process and the rinsing process or upon completion of the rinsing process. Then it is diluted with the water and sprayed from the spray nozzles at the ends of the water piping toward dishes. Thus, the same operations as in the above-described third dishwasher can be effected.

It is considered that the rinsing assistant of the present invention presents its effect with the following mechanism. That is, the rinsing assistant is adsorbed to dish surfaces by hydrophilic groups surrounding hydrophobic groups in the application thereof, making the dish surfaces hydrophilic, compatible with water in the rinsing process. Accordingly, detergent left on dish surfaces over the washing process and insolubles in the rinsing water will adequately be washed away. If dishes get dried after rinsing, the hydrophilic groups still continue to be adsorbed to the surfaces of dishes made of earthenware, porcelain, glass, or metal in hydrogen bond, while the hydrophobic groups having been surrounded by the hydrophilic groups appear on the atmospheric side. These hydrophobic groups will thereafter make contact with food such as rice left uneaten on dishes only by dispersion force acting between almost no-polar molecules. Consequently, food left uneaten is reduced in its sticking force by the rinsing assistant, thus easy to remove from dishes by washing even after drying. Since the foregoing rinsing assistant, as shown above, has both sticking prevention function and rinsing enhancement function, it can impart sticking prevention effect to dishes which are rinsed only in the rinsing process, thus allowing the wash work and the dishwasher to be simplified. It is to be noted here that if the above rinsing assistant contains, as an active ingredient, at least one polymer selected from the group consisting of a homopolymer of an acrylate or methacrylate having a fluoroalkyl group and a hydrophilic group and a copolymer comprising (a) a repeating unit derived from an acrylate or methacrylate having a fluoroalkyl group and a hydrophilic group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide, it will produce such effects in addition to the above ones that the use thereof as a rinsing assistant does not cause any stains or water spots to be left on the surfaces of rinsed dishes, it gives an excellent gloss thereon, and that it allows for a widened concentration range.

Another dish washing method of the present invention is so arranged that the rinsing assistant having both sticking prevention function and rinsing enhancement function is applied to dish surfaces and therefore food such as rice left uneaten on dishes is made easy to remove from the dishes and even if the rice is dried, it can readily be removed therefrom by later washing. In addition, if the above rinsing assistant contains, as an active ingredient, at least one polymer selected from the group consisting of a homopolymer of an acrylate or methacrylate having a fluoroalkyl group and a hydrophilic group and a copolymer comprising (a) a repeating unit derived from an acrylate or methacrylate having a fluoroalkyl group and a hydrophilic group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide, it can produce such effects that it causes no stains or water spots on dish surfaces after rinsing, it gives an excellent gloss thereon, and that it can be used over a wide concentration range. Moreover, if the rinsing assistant is added to rinsing warm water in the rinsing process, it is stuck to dishes through remaining heat drying due to high-temperature rinsing warm water without any loss, while it can impart sticking prevention effect to dishes in the rinsing process, thus allowing the washing work and the dishwasher to be simplified. Further, if the rinsing assistant is sprayed upon completion of the rinsing process, it can be applied to clean surfaces of dishes uniformly.

In the fifth dishwasher of the present invention, the sticking inhibitor stored in the reservoir is joined with the detergent at the bottom of the washing chamber through the passageway in the washing process, and then the detergent containing the sticking inhibitor is sprayed from the arm through the piping toward dishes by the circulating pump. The dispersion characteristic of the sticking inhibitor is enhanced by the detergent, increasing the degree of sticking to dishes. In addition, if the above dishwasher is provided with a passageway for allowing the sticking inhibitor or rinsing assistant in the reservoir to join with fresh water at the bottom of the washing chamber, the sticking inhibitor or rinsing assistant is added to the fresh water through this passageway in the rinsing process, thereby allowing these agents to be applied to the surfaces of dishes having no detergent applied thereon.

In the sixth dishwasher of the present invention, the sticking inhibitor or rinsing assistant in the reservoir is supplied to the spray nozzles through the spray piping by the pump upon completion of the rinsing process, and sprayed from the spray nozzles toward dishes. Thus, the sticking inhibitor or rinsing assistant can be applied to clean surfaces of dishes after rinsing uniformly.

In the seventh dishwasher of the present invention, the sticking inhibitor or rinsing assistant in the reservoir is joined with water in the water piping by an ejector disposed at an end of the agent piping therethrough upon completion of the rinsing process. Then it is diluted with the water and sprayed from the spray nozzles at the ends of the water piping toward dishes. Thus, these agents can be applied to clean surfaces of dishes uniformly.

In the eighth dishwasher of the present invention, the sticking inhibitor or rinsing assistant in the reservoir is supplied to a water reservoir provided to the water piping through the agent piping by a pump upon completion of the rinsing process. Then it is diluted with water and sprayed from the spray nozzles at the ends of the water piping toward dishes. Thus, these agents can be applied to clean surfaces of dishes uniformly.

Incidentally, in place of a sticking inhibitor, a rinsing assistant also may be stored in the reservoir of the above-described second to fourth dishwashers, where this rinsing assistant can be supplied in the same way as in the above-mentioned sticking inhibitor so as to apply the rinsing assistant to dish surfaces.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
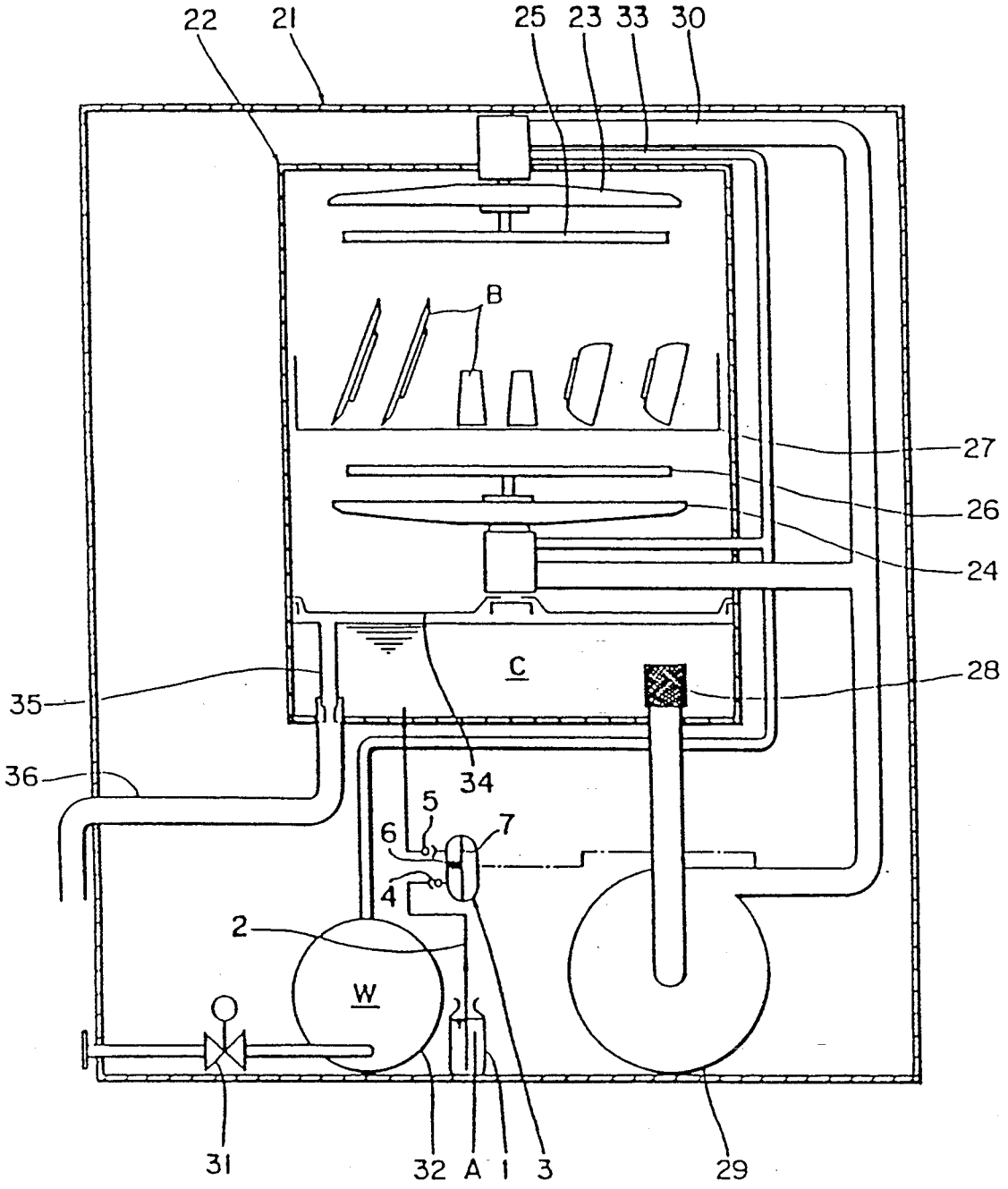
FIG. 1 is a longitudinal sectional view for showing a dishwasher of an embodiment of the present invention.

The present invention will be described in detail below with reference to embodiments thereof in connection with the accompanying drawings.

The sticking inhibitor of the present invention is applied to dish surfaces in order to prevent food from sticking thereto. The sticking inhibitor is composed of a compound adsorbed to dish surfaces by hydrophilic groups and adsorbed to food surfaces by hydrophobic groups.

In many cases, the hydrophilic groups and hydrophobic groups are bonded by divalent organic groups, wherein the hydrophilic groups are:

$$-OH,\ 4\text{-}COOM,\ -OSO_3M,\ -SO_3M,$$

$$-\underset{\underset{OM}{|}}{\overset{\overset{O}{\|}}{P}}-OM,\ -\underset{\underset{O}{|}}{\overset{\overset{O}{\|}}{P}}-OM,\ -\underset{\underset{OM}{|}}{\overset{\overset{O}{\|}}{P}}-OM,$$

$$\left(CH_2CH_2O\right)_m A,\ \ \ N^+X^-$$

where,

M is a hydrogen atom, alkali metal atom, alkaline earth metal atom ammonium group, or substitutional ammonium group;

A is a hydrogen atom, or lower alkyl group;

X is a halogen atom; and m is an integral number of 1 to 20, and wherein the hydrophobic groups are:

$$CF_3CF_2(CF_2CF_2)_n \quad (1)$$

$$\begin{matrix} CF_3 \\ \diagdown \\ \quad CF(CF_2CF_2)_n \\ \diagup \\ CF_3 \end{matrix} \quad (2)$$

$$CF_3CF{=}CF- \quad (3)$$

$$(CF_3)_2C{=}C(CF_2CF_2)- \quad (4)$$

$$\{(CF_3)_2CF\}_2C{=}C(CF_3)- \quad (5)$$

$$(CF_3CF_2CF_2)(CF_3)C{=}C\{CF(CF_3)_2\}- \quad (6)$$

$$H(CF_2CF_2) \quad (7)$$

where n is an integral number of 1 to 8, and wherein the divalent organic groups are, for example:

$$-CH_2CH(Z)CiH_{2i}-,\ -SO_2N(R)CiH_{2j}-,$$

$$-CkH_{2k}O-,\ -COO-,\ -O-\bigcirc-CH_2-$$

[where Z is H, $CH_3$, $C_2H_5$, Cl, or OR′(R′ is H, $CH_3$, $C_2H_5$, $COCH_3$, or $COC_2H_5$); R is an alkyl group having carbon number of 1 to 4; i is an integral number of 0 to 4; j is an integral number of 1 to 4; and k is an integral number of 1 to 3] or any combination of two or more out of these.

In general, meal dishes are made of earthenware, porcelain, glass, metal, or plastics, while the remaining food of a meal such as rice that sticks to the surfaces of dishes is composed of starch, protein, and the like. The sticking of food onto dish surfaces is brought about due to van der Waals force acting between the molecules making up dishes and the molecules making up food, the van der Waals force including dispersion force acting between no-polar molecules, dipole-dipole interactive force acting between molecules having electric dipole, and hydrogen bonding force in the case where atoms in molecules having larger electronegativity make hydrogen bond with hydrogen atoms.

Whereas the above dispersion force is smaller than the dipole-dipole interactive force and the hydrogen bonding force, dishes and food are composed of their own molecules, respectively, each component molecule having all of the above-mentioned three forces. Because it is impossible to change the material of dishes and food, such a sticking inhibitor is effectively applied as will stick to food only by the aforenoted weak dispersion force, in order to prevent food from sticking to dish surfaces. This is the reason why the sticking inhibitor is here provided by a compound that is strongly adsorbed to the surfaces of dishes except those made of plastics by hydrophilic groups in hydrogen bond, and in turn weakly adsorbed to the surfaces of food by the hydrophobic groups, primarily with the dispersion force.

Figure 20:
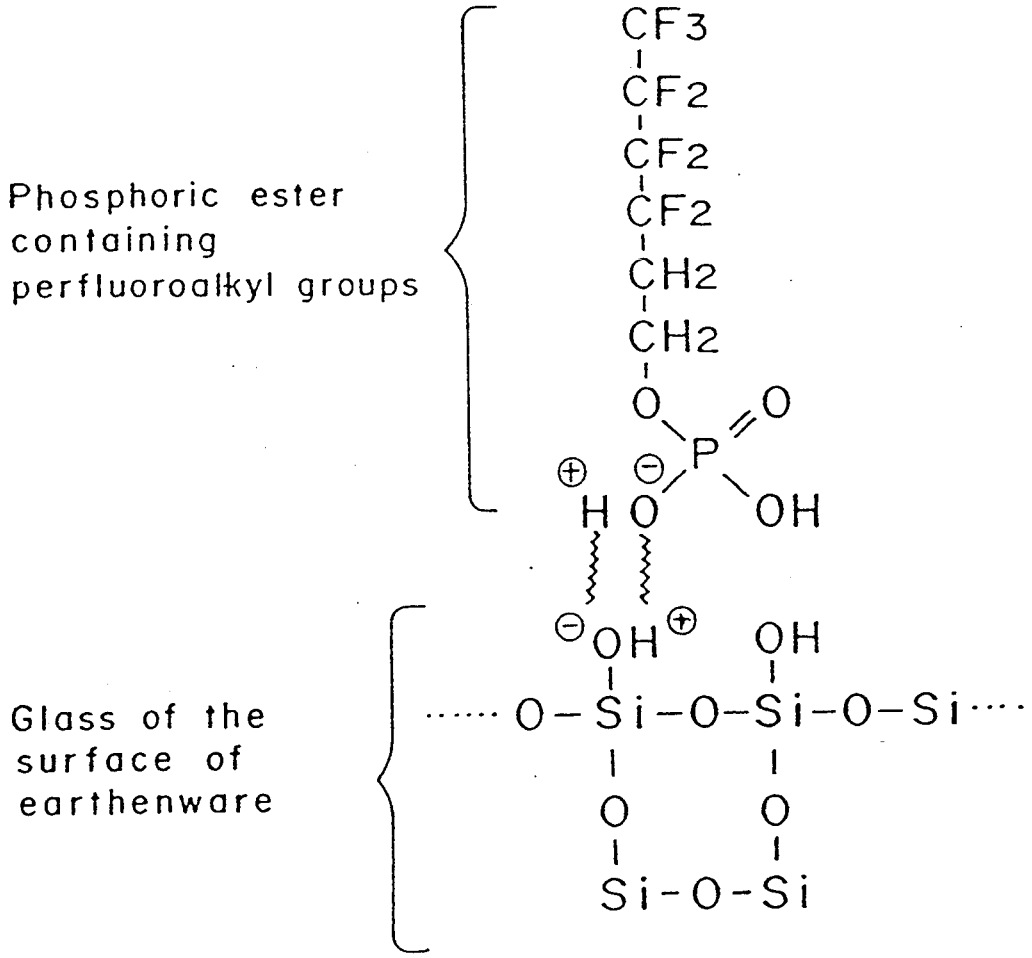
FIG. 20 is a view showing operation of an example of a sticking inhibitor of the present invention.

The above-mentioned compound is preferably one having fluoroalkyl groups and, in particular, a phosphoric ester containing perfluoroalkyl groups. When a solution of phosphoric ester ammonium salt containing perfluoroalkyl groups is applied, for example, to a surface of earthenware, the phosphoric ester containing perfluoroalkyl groups makes hydrogen bond with OH groups of the glaze of the earthenware surface by its OH groups (hydrophilic groups), as shown in FIG. 20, while it orientates its fluorocarbon chains (hydrophobic groups) in the direction of the normal line of the surface. These fluorocarbon chains serve to prevent food such as rice composed of starch from sticking to the glaze of the earthenware surface. Also, on a surface of a metallic dish there exist an oxide film and adsorbed water, where the phosphoric ester containing perfluoroalkyl groups will act in the same way as above. In this operation, the effect of preventing the sticking of starch or the like will be greater when the phosphoric ester containing perfluoroalkyl groups is a monomolecular film, and the orientation thereof mentioned above will be broken when it is a multi-molecular film over a certain degree, causing the dipole-dipole interactive force and the like to act against starch with less effect of the sticking prevention, conversely. For this reason, for example, the proper concentration of the solution of the phosphoric ester ammonium salt containing perfluoroalkyl groups or the like is preferably a few tenths to a few thousandths percent by weight taking economy into consideration so that the above effect of sticking prevention can be obtained.

Shown below are various examples of the present invention:

EXAMPLE 1

$$\{CF_3CF_2(CF_2CF_2)nC_2H_4O\}aP(=O)\{ONH_2(C_2H_4OH)_2\}_{3-a}$$

n=3, 55 mol %, n=4, 28 mol %
n=5, 11 mol %, n=6, 4 mol %
n=7, 2 mol %,
a=1, 38 mol %, a=2, 62 mol %

EXAMPLE 2

$$(C_8F_{17}C_2H_4O)bP(=O)(ONH_4)_{3-b}$$

b=1, 40 mol %, b=2, 60 mol %

EXAMPLE 3

$$\{C_8F_{17}SO_2N(C_2H_5)C_2H_4O\}cP(=O)\{ONH_2(C_2H_4OH)_2\}_3-C$$

c=1, 40 mol %, c=2, 60 mol %

EXAMPLE 4

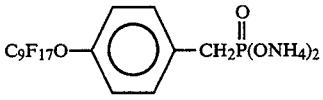

EXAMPLE 5

$C_7F_{15}COONH_4$

EXAMPLE 6

$H(CF_2CF_2)_3COONH_4$

EXAMPLE 7

$C_8F_{17}SO_2N(C_2H_5)CH_2COONH_4$

EXAMPLE 8

$C_8F_{17}CH_2OC_2H_4SO_3Na$

EXAMPLE 9

$$\begin{array}{l} C_8F_{17}CH_2CH_2OCOCHSO_3Na \\ \quad\quad\quad\quad\quad\quad\quad\quad | \\ C_2F_{17}CH_2CH_2OCOCH_2 \end{array}$$

EXAMPLE 10

$C_7F_{15}(CH_2)_5COONa$

EXAMPLE 11

$C_8F_{17}SO_2N(C_2H_5)CH_2COOK$

EXAMPLE 12

$C_8F_{17}SO_2N(C_2H_5)C_2H_4SO_3Na$

EXAMPLE 13

$C_8F_{17}CONHC_3H_6N^+(CH_3)_3.I^-$

EXAMPLE 14

$C_8F_{17}CONHC_3H_6N^+(CH_3)_2C_2H_4COO^-$

EXAMPLE 15

$C_9F_{19}CONH(C_2H_4OH)_3$

EXAMPLE 16

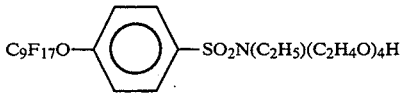

EXAMPLE 17

$$C_8F_{17}C_2H_4OCH_2CH(OH)CH_2O(C_2H_4O)_6H$$

EXAMPLE 18

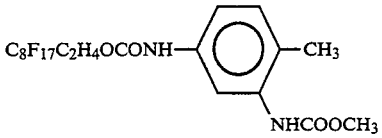

EXAMPLE 19

Diefree ME313 (trade name)

EXAMPLE 20

Texgaurd TG130 (trade name)

Where, the principal component of example 19 is a phosphoric ester compound containing perfluoroalkyl groups, and that of example 20 is a polymer containing perfluoroalkyl groups.

Each of the sticking inhibitors was added into a warm water of 83°±2° C. in a specified amount (see the columns for concentration in Table 1) and stirred. Then cleaned dishes made of earthenware were immersed in each warm water for 10 seconds, followed by remaining heat drying. After a rice liquid of a specified concentration was applied to the dried dishes, the dishes were dried for twenty hours under temperature of 20° C. to obtain samples. At this time point, the sticking state of rice to the dishes was visually observed, the observation results taken as evaluation I. Next, the dishes subjected to the visual observation were washed with the dishwasher later described in connection with FIG. 22, and thereafter an iodine solution was sprayed to the surfaces of the washed dishes. Then, the state of rice remaining on the dishes were observed, the observation results taken as evaluation II. The test results were as listed in Table 1, where symbols ⊚, o, Δ, and x denote, in the order of increasing in the amount of sticking rice, remarkably small; small; a little small; and almost non-treated, respectively, for evaluations I and II.

TABLE 1

| | | Concentration of sticking inhibitor (weight ratio) | | | | |
|---|---|---|---|---|---|---|
| Example | Effect | $\frac{1}{10^2}$ | $\frac{1}{10^3}$ | $\frac{1}{10^4}$ | $\frac{5}{10^5}$ | $\frac{1}{10^5}$ |
| 1 | Evaluation I | | ⊚ | o | o | Δ |
| | Evaluation II | | ⊚ | o | o | Δ |
| 2 | Evaluation I | | ⊚ | o | o | Δ |
| | Evaluation II | | ⊚ | o | o | Δ |
| 3 | Evaluation I | | ⊚ | o | o | Δ |

TABLE 1-continued

| Example | Effect | Concentration of sticking inhibitor (weight ratio) $\frac{1}{10^2}$ | $\frac{1}{10^3}$ | $\frac{1}{10^4}$ | $\frac{5}{10^5}$ | $\frac{1}{10^5}$ |
|---|---|---|---|---|---|---|
| | Evaluation II | | ◎ | ○ | ○ | Δ |
| 4 | Evaluation I | | ◎ | ○ | Δ | X |
| | Evaluation II | | ◎ | ○ | Δ | X |
| 5 | Evaluation I | | ○ | ○ | Δ | X |
| | Evaluation II | | ○ | ○ | Δ | X |
| 6 | Evaluation I | | ○ | ○ | Δ | X |
| | Evaluation II | | ○ | ○ | Δ | X |
| 7 | Evaluation I | | ◎ | ○ | Δ | X |
| | Evaluation II | | ◎ | ○ | Δ | X |
| 8 | Evaluation I | | ◎ | ○ | Δ | X |
| | Evaluation II | | ◎ | ○ | Δ | X |
| 9 | Evaluation I | | ◎ | ○ | ○ | Δ |
| | Evaluation II | | ◎ | ○ | ○ | Δ |
| 10 | Evaluation I | | ○ | ○ | Δ | X |
| | Evaluation II | | ○ | ○ | Δ | X |
| 11 | Evaluation I | | ◎ | ○ | Δ | Δ |
| | Evaluation II | | ◎ | ○ | Δ | Δ |
| 12 | Evaluation I | | ◎ | ○ | Δ | Δ |
| | Evaluation II | | ◎ | ○ | Δ | Δ |
| 13 | Evaluation I | | ○ | ○ | Δ | Δ |
| | Evaluation II | | ○ | ○ | Δ | Δ |
| 14 | Evaluation I | | ○ | ○ | Δ | Δ |
| | Evaluation II | | ○ | ○ | Δ | Δ |
| 15 | Evaluation I | | ◎ | ○ | Δ | Δ |
| | Evaluation II | | ◎ | ○ | Δ | Δ |
| 16 | Evaluation I | | ○ | ○ | Δ | X |
| | Evaluation II | | ○ | ○ | Δ | X |
| 17 | Evaluation I | | ○ | ○ | Δ | X |
| | Evaluation II | | ○ | ○ | Δ | X |
| 18 | Evaluation I | | ○ | ○ | ○ | Δ |
| | Evaluation II | | ○ | ○ | ○ | Δ |
| 19 | Evaluation I | ◎ | ○ | ○ | ○ | X |
| | Evaluation II | ◎ | ○ | ○ | ○ | X |
| 20 | Evaluation I | | ○ | ○ | Δ | X |
| | Evaluation II | | ○ | ○ | Δ | X |

As is apparent from Table 1, the composite formed of a fluoroalkyl compound functions to prevent the sticking of rice, and in the case of example 19 where the composite is formed of a compound of fluoroalkyl groups having perfluoroalkyl groups at its end, it is found that the higher the concentration, the greater the effect for preventing the sticking of rice. More specifically, the fluorocarbon chains, which are hydrophobic groups of each sticking inhibitor hydrogen-bonded to the surfaces of earthenware dishes by OH groups, serve to prevent the rice liquid itself from sticking to the dishes and further to make it easy to remove the sticking rice liquid from the dishes.

The above-described sticking inhibitors are, in each case, applied to the surfaces of dishes to which food is served, and thus may be eaten along with the food as it remains sticking thereto. Accordingly, an acute oral toxicity test was made using mice with respect to the following four types of phosphoric ester compounds having perfluoroalkyl groups, (1) to (4), which have the same principal parts as in the most predominant sticking inhibitor:

$$[CF_3CF_2(CF_2CF_2)_3CH_2CH_2O]_2\overset{\overset{\displaystyle O}{\|}}{P}OH \quad (1)$$

$$[CF_3CF_2(CF_2CF_2)_3CH_2CH_2O]_2\overset{\overset{\displaystyle O}{\|}}{P}ONH_4 \quad (2)$$

$$[CF_3CF_2(CF_2CF_2)_3upCH_2CH_2O]_x\overset{\overset{\displaystyle O}{\|}}{P}(OH)_{3-x} \quad (3)$$

(x = 1, 3.2%, x = 2, 75.5%, x = 3, 21.3%)

-continued $$[CF_3CF_2(CF_2CF_2)_3upCH_2CH_2O]_x\overset{\overset{\displaystyle O}{\|}}{P}(ONH_4)_{3-x} \quad (4)$$

(x = 1, 3.2%, x = 2, 75.5%, x = 3, 21.3%)

To male and female sets of five mice, five weeks old (weight: approx. 20 g), the above compounds additively suspended to a 1.5% carboxymethylcellulose solution were forcedly administered by 20 mg for each mouse at one time by means of metallic stomach sounds, and their general symptom was observed for a period of seven days after the administration. The result was that no symptom was seen. From this result, the acute oral toxicity lethal dose 50% $LD_{50}$ proved to be more than 1 g/kg for each compound. This value gives a conclusion that even if the above-mentioned compounds are taken in man's body along with food from the surfaces of dishes, there are no possibilities of the acute oral toxicity.

The rinsing assistant of the present invention is applied to dish surfaces, having both the functions of sticking prevention for making food easy to remove and of the rinsing enhancement. The rinsing assistant is formed of a polymer which has hydrophilic groups and hydrophobic groups so that it is adsorbed to dish surfaces by the hydrophilic groups surrounding the hydrophobic groups and, after drying, adsorbed to dish surfaces by the hydrophobic groups appearing to the surfaces.

Figure 25:
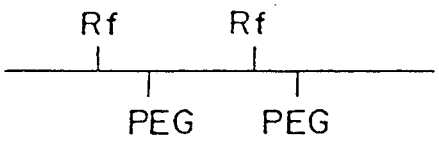
FIGS. 25(*a–d*) shows the operation of an example of a rinsing assistant of the present invention.
Figure 25:
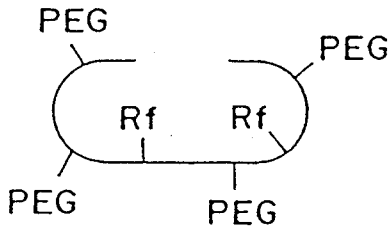
Figure 25:
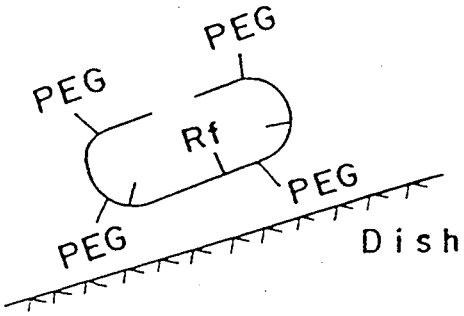
Figure 25:
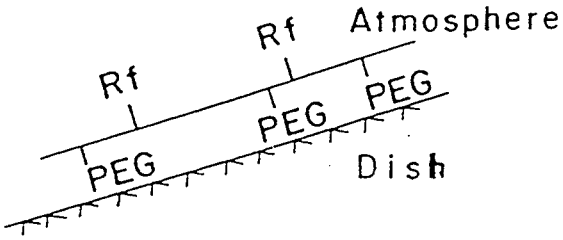

For example, the above-mentioned hydrophobic groups include polyfluoroalkyl group Rf, while the hydrophilic groups include methoxypolyoxyethylene PEG, and it is supposed that the two are copolymerized into a compound having a molecular structure as shown in FIG. 25 (A).

In addition,

Rf: $CF_3CF_2(CF_2CF_2)n-$ ; n=2 to 8 (primarily, 3)

PEG: $-(OCH_2CH_2-)_m CH_3$; m=2 to 23

The above compound, as shown in FIG. 25 (B), when diluted with water, becomes compatible therewith by the hydrophilic PEG going outside the balled-yarn-like hydrophobic polymer Rf. It is supposed that when the compound solution is subsequently applied or sprayed to a dish surface, as shown in FIG. 25 (C), its hydrophilic PEG is adsorbed to the dish surface, making it hydrophilic, compatible with water. Further, it is considered that when water on the dish surface is dried away, as shown in FIG. 25 (D), the hydrophobic Rf goes out on the atmospheric side with the PEG still adsorbed to the dish surface, thereby serving to prevent the sticking of food such as rice as will be left uneaten on a dish as well as to accelerate the removal of food in washing.

Since the mechanism for the state of FIG. 25 (D) is the same as previously described referring to FIG. 20 on the sticking inhibitors, the explanation of the function and effect for sticking prevention of the above compound, i.e. rinsing assistant is omitted. The proper concentration of the solution of the polymer is preferably a few percent to a few thousandths present by weight taking economy into consideration.

Preferred examples of the acrylate or methacrylate having the fluoroalkyl group and the hydrophilic group are compound of the formula:

$$CH_2=C(R^2)COOCH(CH_2Rf)CH_2O(R^{10}O)n_3R^{11}$$

or $CH_2=C(R^2)COO(R^{10}O)_{n3}R^1Rf$ wherein $R^1$ is a straight or branched alkylene group having 1 to 10 carbon atoms; a group of the formula: $-SO_2N(R^3)R^4-$ or $-CH_2CH(OR^5)CH_2-$ in which $R^3$ is an alkyl group having 1 to 10 carbon atoms, $R^4$ is a straight or branched alkylene group having 1 to 10 carbon atoms and $R^5$ is a hydrogen atom or an acyl group having 1 to 10 carbon atoms; a group of the formula:

$-CH_2CH(OR^5)CH_2(OR^{10})_{n3}-$,
$-CH_2OCH_2CH(OR_5)CH_2-$ or $-CH_2\underset{\underset{CH_2O(R^{10}O)_{n3}R^{11}}{|}}{CH}-$ in which $R^{10}$ is an alkylene group having 2 to 6 carbon atoms, and $R^{11}$ is a hydrogen atom or a methyl group; $R^2$ is a hydrogen atom or a methyl group; Rf is a straight or branched polyfluoroalkyl group having 3 to 20 carbon atoms; and $n_3$ is a number of 1 to 50.

Specific examples of such compound are

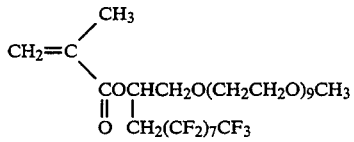

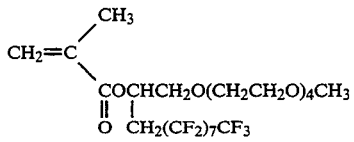

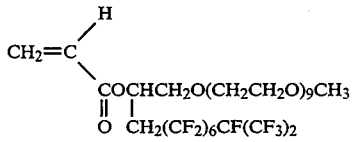

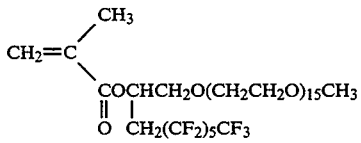

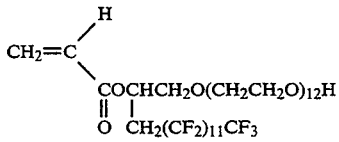

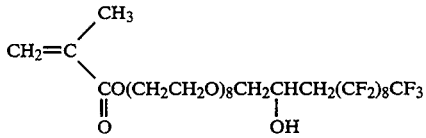

-continued

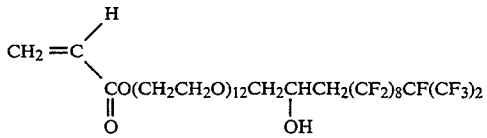

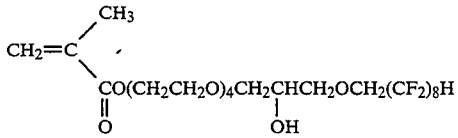

A preferred example of the monomer which constitutes the unit (a) is a compound of the formula:

$RfR^1OCOC(R^2)=CH_2$ wherein Rf and $R^2$ are the same as defined above. Specific examples of this compound are $CF_3(CF_2)_7(CH_2)_{10}OCOCH=CH_2$
$CF_3(CF_2)_7(CH_2)_{10}OCOC(CH_3)=CH_2$
$CF_3(CF_2)_6CH_2OCOCH=CH_2$
$CF_3(CF_2)_6CH_2OCOC(CH_3)=CH_2$
$(CF_3)_2CF(CF_2)_6(CH_2)_2OCOCH=CH_2$
$(CF_3)_2CF(CF_2)_8(CH_2)_2OCOCH=CH_2$
$(CF_3)_2CF(CF_2)_{10}(CH_2)_2OCOCH=CH_2$
$(CF_3)_2CF(CF_2)_6(CH_2)_2OCOC(CH_3)=CH_2$
$(CF_3)_2CF(CF_2)_8(CH_2)_2OCOC(CH_3)=CH_2$
$(CF_3)_2CF(CF_2)_{10}(CH_2)_2OCOC(CH_3)=CH_2$
$CF_3CF_2(CF_2)_6(CH_2)_2OCOCH=CH_2$
$CF_3CF_2(CF_2)_8(CH_2)_2OCOCH=CH_2$
$CF_3CF_2(CF_2)_{10}(CH_2)_2OCOCH=CH_2$
$CF_3CF_2(CF_2)_6(CH_2)_2OCOC(CH_3)=CH_2$
$CF_3CF_2(CF_2)_8(CH_2)_2OCOC(CH_3)=CH_2$
$CF_3CF_2(CF_2)_{10}(CH_2)_2OCOC(CH_3)=CH_2$
$H(CF_2)_8CH_2OCOC(CH_3)=CH_2$
$H(CF_2)_8CH_2OCOCH=CH_2$
$CF_3(CF_2)_7SO_2N(CH_3)(CH_2)_2OCOCH=CH_2$
$CF_3(CF_2)_7SO_2N(C_2H_5)(CH_2)_2OCOC(CH_3)=CH_2$
$(CF_3)_2CF(CF_2)_8CH_2CH(OCOCH_3)CH_2OCOC(CH_3)=CH_2$
$(CF_3)_2CF(CF_2)_8CH_2CH(OH)CH_2OCOCH=CH_2$
$CF_3CF_2(CF_2)_6CH_2CH(OH)CH_2(OCH_2CH_2)_4OCOCH=CH_2$
$CF_3CF_2(CF_2)_6CH_2CH(OH)CH_2(OCH_2CH_2)_8OCOC(CH_3)=CH_2$
$(CF_3)_2CF(CF_2)_6CH_2CH(OCOCH_3)CH_2(OCH_2CH_2)_{12}OCOC(CH_3)=CH_2$

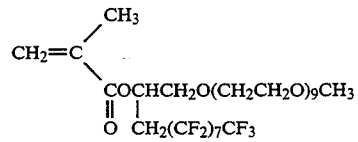

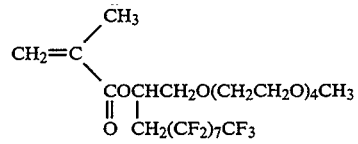

-continued

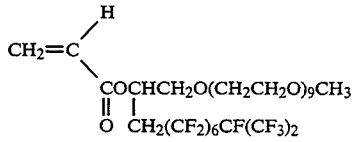

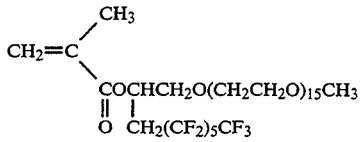

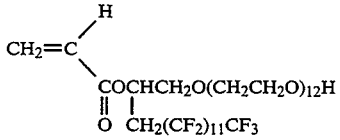

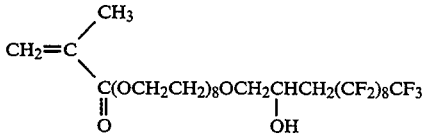

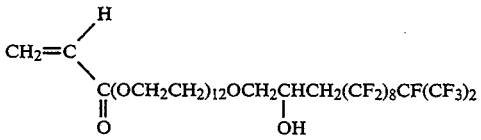

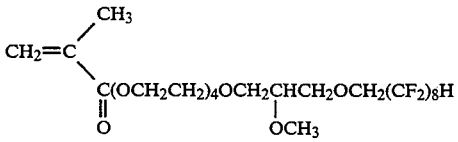

Specific examples of the hydrophilic group are —OH, —COOM, —$OSO_3M$, —$SO_3M$, or the groups of the formula:

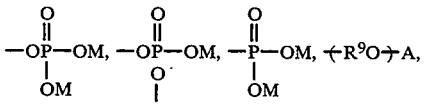

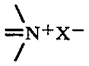

wherein M is a hydrogen atom, an alkali metal atom, an alkaline earth metal atom, an ammonium group or a substituted ammonium group, A is a hydrogen atom or a lower alkyl group, X is a halogen atom such as a chlorine or bromine atom, m is an integer of 1 to 20, and $R^9$ is an alkylene group having 1 to 5 carbon atom.

The acrylate or methacrylate having the hydrophilic group includes $$CH_2{=}CR^6COO(R^7O)_{n_1}(R^8O)_{n_2}R^9$$

wherein $R^6$ is a hydrogen atom or a methyl group, $R^7$ is an alkylene group having 3 to 6 carbon atoms, $R^8$ is —$CH_2CH_2$—, $R^9$ is a hydrogen atom or an alkyl group having 1 to 20 carbon atoms, $n_1$ is an integer of 0 to 50 and $n_2$ is an integer of 0 to 50 provided that the sum of $n_1$ and $n_2$ is at least one. $R^7$ is preferably —$CH(CH_3)CH_2$—, though it may be —$CH(C_2H_5)CH_2$—. This compound may be a mixture of two or more compounds having different $R^7$, $n_1$ and/or $n_2$.

The acrylamide or methacrylamide having the hydrophilic group includes a compound of the formula:

$$CH_2{=}CR^6CONR^{12}R^{13}$$

wherein $R^6$ is the same as defined above, $R^{12}$ is a hydrogen atom or —$CH_2OH$ and $R^{13}$ is a hydrogen atom or —$CH_2OH$.

Specific examples of the monomer which constitutes the unit (b) are $CH_2{=}CHCOO(CH_2CH_2O)pH$ (p = 3–9)
$CH_2{=}C(CH_3)COO(CH_2CH_2O)pH$ (p = 3–9)
$CH_2{=}CHCOO(CH_2CH_2O)pCH_3$ (p = 3–9)
$CH_2{=}C(CH_3)COO(CH_2CH_2O)pCH_3$ (p = 3–9)
$CH_2{=}C(CH_3)COO(CH_2CH_2O)_{23}CH_3$
$CH_2{=}CHCOOCH_2CH_2OH$

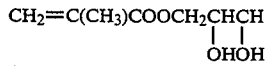

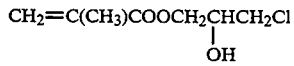

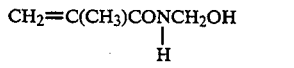

$CH_2{=}C(CH_3)CON(CH_2OH)_2$
$CH_2{=}C(CH_3)CN$
$CH_2{=}CHCN$

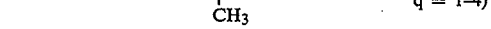

In addition to the above units (a) and (b), the copolymer of the present invention may comprise other units derived from a polymerizable compound having no fluoroalkyl group such as ethylene, vinyl chloride, vinylidene halogenide, styrene, acrylic acid and its alkyl esters, methacrylic acid and its alkyl esters, benzyl methacrylate, vinyl alkyl ketone, vinyl akyl ether, butadiene, isoprene, chloroprene, maleic anhydride and the like. With such other units, the copolymer is modified to have better durability and lower costs. In addition, the solubility and other properties of the copolymer can be improved. Preferably, an amount of the other units is not larger than 10% by weight based on the weight of the copolymer.

Further, various tests of sticking prevention effect and those of rinsing were made on the compound, as will be described later. As a result, it was established that the compound, differing from conventional rinsing assistants, does not cause stains or water spots to be left on dish surfaces, gives an excellent gloss, and is available in a wide concentration range.

The following are examples of the compounds used in the sticking prevention effect test and the rinsing test.

EXAMPLE 1

In a four-necked glass flask (one liter) equipped with a mercury thermometer and a stirrer having polytetrafluoroethylene crescent shape blades, $CF_3CF_2(CF_2CF_2)nCH_2CH_2OCO\text{-}CH{=}CH_2$ (a mixture of the compounds in which n=3, 4 or 5 in a weight ratio of 5:3:1) (70 g), $CH_2{=}C(CH_3)COO(CH_2C$-

$H_2O)_8CH_3$(30 g) and isopropanol (400 g) were charged and stirred in a nitrogen stream to well disperse them. After bubbling nitrogen gas in the mixture for about one hour, azobisisobutyronitrile (1.0 g) was added and the mixture was further stirred in a nitrogen stream at 70° C. for 10 hours to proceed copolymerization. The analysis of the reaction mixture with gas chromatography revealed that a conversion in the copolymerization was 99% or higher. This conversion indicated that the ratio of the units in the copolymer substantially corresponded to the ratio of the charged monomers. The obtained dispersion contained 20% of a solid copolymer.

The obtained copolymer dispersion was diluted with water to a desired solid content of the copolymer (5, 10, 50, 100, 1000 or 10,000 ppm) and used as a sticking inhibitor.

In each sticking inhibitor warmed up to 83°±2° C., a china dish (a diameter of 230 mm) and a transparent glass (a diameter of 65 mm and a height of 122 mm) were dipped for 10 seconds and removed in air followed by drying with thermal inertia.

The dried glass was observed with the naked eye and evaluated for the presence of stains on its surface and for surface gloss. The results are shown in Table 2 as Evaluations I and II, respectively.

In the dish, 20 ml of a cooked rice liquid which had been prepared by a cooked rice liquid preparation method was poured and dried at 20° C. for 20 hours. After drying, a sticking condition of the rice was observed with the naked eye, and the results are shown in Table 4 as Evaluation III.

On the outer surface of the glass, a fixed amount of a lip stick (Elecseal glass by Shiseido) was smeared on a fixed area by pinching the edge with a thumb and a forefinger on which the lip stick was smeared.

Then, the dish and the glass were washed with a dish washer. On the washed dish, an iodide liquid was sprayed to observe the condition of the remaining rice on the dish. The results are shown in Table 4 as Evaluation IV.

The condition of the smeared lip stick on the glass after washing was observed with the naked eye. The results are shown in Table 5 as Evaluation V.

The cooking rice liquid preparation method

The rice is boiled in a usual manner and allowed to settle by its own heat for 15 minutes. To 75 g of the cooked rice, 500 ml of distilled water is added and stirred in a homogenizer for 30 minutes. Then, the cooked rice is kept at 30° C. while stirring with a magnetic stirrer in a constant temperature bath at 30° C.

EXAMPLES 2 TO 14

In the same manner as in Example 1 but using the following monomers in the designated ratio, a copolymer was produced and a resulting copolymer dispersion was diluted with water to a determined concentration. Then, the diluted dispersion was subjected to the same evaluation tests as in Example 1. The results are shown in Tables 2, 4 and 5.

| | | | wt % |
|---|---|---|---|
| Example 1: | (a) | $C_2F_2(CF_2CF_2)nCH_2CH_2OCOCH{=}CH_2$ (a mixture of the compounds wherein n = 3, 4 and 5 in a weight ratio of 5:3:1) | 70 |
| | (b) | $CH_3(OCH_2CH_2)_8OCOC(CH_3){=}CH_2$ | 30 |
| Example 2: | (a) | the same as (a) in Example 1 | 45 |
| | (b) | $H(OCH_2CH_2)_9\{OCH(CH_3)CH_2\}_7OCOC(CH_3){=}CH_2$ | 35 |
| | | $HOCH_2CH_2OCOC(CH_3){=}CH_2$ | 20 |
| Example 3: | (a) | the same as (a) in Example 1 | 60 |
| | (b) | $H(OCH_2CH_2)_8OCOC(CH_3){=}CH_2$ | 35 |
| | | $CH_2{=}C(CH_3)CO(OCH_2CH_2)_9OCOC(CH_3){=}CH_2$ | 5 |
| Example 4: | (a) | $CF_3(CF_2)_7SO_2N(CH_3)CH_2CH_2OCOC(CH_3){=}CH_2$ | 65 |
| | (b) | $NCCH{=}CH_2$ | 18 |
| | | $CH_3(OCH_2CH_2)_{23}OCOCH{=}CH_2$ | 18 |
| | | $CH_3(OCH_2CH_2)_9OCOC(CH_3){=}CH_2$ | 7 |
| | | $C_4H_9OCH_2NHCOCH{=}CH_2$ | 2 |
| Example 5: | (a) | $(CF_3)_2CF(CF_2CF_2)nCH_2CH(OH)CH_2OCOCH{=}CH_2$ (a mixture of the compounds wherein n = 3, 4 and 5 in a weight ratio of 5:3:1) | 60 |
| | (b) | $NCC(CH_3){=}CH_2$ | 12 |
| | | $H(OCH_2CH_2)_9OCOC(CH_3){=}CH_2$ | 25 |
| | | $HOCH_2CH_2OCOC(CH_3){=}CH_2$ | 3 |
| Example 6: | (a) | $CF_3CF_2(CF_2CF_2)_3CH_2CH_2OCOC(CH_3){=}CH_2$ | 45 |
| | (b) | $H(OCH_2CH_2)_9OCOC(CH_3){=}CH_2$ | 25 |
| | | $HOCH_2CH_2OCOCH{=}CH_2$ | 20 |
| | (c) | $H\{OCH(CH_3)CH_2\}OCOC(CH_3){=}CH_2$ | 10 |
| Example 7: | (a) | the same as (a) in Example 1 | 60 |
| | (b) | $CH_3(OCH_2CH_2)_8OCOC(CH_3){=}CH_2$ | 33 |
| | (c) | $CH_2CHCH_2OCOC(CH_3){=}CH_2$ (O) | 2 |
| | | $C_4H_9CH(C_2H_5)CH_2OCOC(CH_3){=}CH_2$ | 5 |
| Example 8: | (a) | $H(CF_2CF_2)_4CH_2OCOCH{=}CH_2$ | 60 |
| | (b) | $H(OCH_2CH_2)_9OCOC(CH_3){=}CH_2$ | 30 |
| | (c) | $C_4H_9CH(C_2H_5)CH_2OCOC(CH_3){=}CH_2$ | 10 |
| Example 9: | (a) | $CF_3CF_2(CF_2CF_2)_3CH_2$ / $CH_3(OCH_2CH_2)_4OCH_2CHOCOCH{=}CH_2$ | 100 |
| Example 10: | (a) | $(CF_3)_2CF(CF_2CF_2)_3CH_2CH_2OCOC(CH_3){=}CH_2$ | 60 |
| | (b) | $NCC(CH_3){=}CH_2$ | 30 |

-continued

| | | | wt % |
|---|---|---|---|
| | | $HOCH_2NHCOCH{=}CH_2$ | 10 |
| Example 11: | (a) | $CF_3CF_2(CF_2CF_2)_3CH_2CH(OCOCH_3)CH_2OCOCH{=}CH_2$ | 70 |
| | (b) | $HOCOC(CH_3){=}CH_2$ | 10 |
| | | $H(OCH_2CH_2)_9OCOCH{=}CH_2$ | 20 |
| Example 12: | (a) | $CF_3CF_2(CF_2CF_2)_3CH_2CH(OH)CH_2(OCH_2CH_2)_{12}$ $OCOCH{=}CH_2$ | 30 |
| | | $CF_3CF_2(CF_2CF_2)_3CH_2CH(OCOCH_3)CH_2OCOC$ $(CH_3){=}CH_2$ | 30 |
| | (b) | $HOCOCH{=}CH_2$ | 10 |
| | | $H(OCH_2CH_2)_8OCOCH{=}CH_2$ | 20 |
| Example 13: | (a) | the same as (a) in Example 1 | 53 |
| | (b) | $CH_3(OCH_2CH_2)_9OCOC(CH_3){=}CH_2$ | 21 |
| | | $H\{OCH_2CH(CH_3)\}_{12}OCOC(CH_3)$ | 13 |
| | | $CH_2CHCH_2OCOC(CH_3){=}CH_2$ (epoxide ring) | 13 |
| Example 14: | (a) | $CF_3CF_2(CF_2CF_2)_3SO_2N(C_2H_5)CH_2CH_2OCOCH{=}CH_2$ | 40 |
| | | $CF_3CF_2(CF_2CF_2)_3CH_2CH_3(OCH_2CH_2)_4OCH_2{-}$ $CH_2OCOC(CH_3){=}CH_2$ | 20 |
| | (b) | $CH_3(OCH_2CH_2)_9OCOCH{=}CH_2$ | 30 |
| | | $(HOCH_2)_2NCOCH{=}CH_2$ | 10 |
| | | Comparative Example 1 | |

In the same manner as in Example 1 but using sorbitan monocaprylate in place of the copolymer, the evaluation tests I, II, III, IV and V were carried out. The results are shown in Tables 3, 4 and 5.

Comparative Example 2

In the same manner as in Example 1 but using an untreated glass, the evaluation tests I and II were carried out. The results are shown in Table 3.

Evaluation III:

◎: Almost all the rice is liberated from the dish.
o: A half of the rice is liberated from the dish.
Δ: part of the rice is liberated from the dish.
x: All the rice sticks to the dish.

Evaluations IV and V:

◎: A very little sticking.
o: A little sticking.
Δ: Slight sticking.
x: The same level as non-treatment.

TABLE 2

| Example | Effect Evaluation | Concentration of linsing aid (by weight) 5/$10^6$ | 1/$10^5$ | 5/$10^5$ | 1/$10^4$ | 1/$10^3$ | 1/$10^2$ |
|---|---|---|---|---|---|---|---|
| 1 | I | o | o | ◎ | ◎ | ◎ | ◎ |
| | II | o | o | ◎ | ◎ | ◎ | ◎ |
| 2 | I | ◎ | ◎ | ◎ | ◎ | ◎ | ◎ |
| | II | ◎ | ◎ | ◎ | ◎ | ◎ | ◎ |
| 3 | I | o | ◎ | ◎ | ◎ | ◎ | ◎ |
| | II | o | ◎ | ◎ | ◎ | ◎ | ◎ |
| 4 | I | o | o | ◎ | ◎ | ◎ | ◎ |
| | II | o | o | ◎ | ◎ | ◎ | ◎ |
| 5 | I | o | ◎ | ◎ | ◎ | ◎ | ◎ |
| | II | o | ◎ | ◎ | ◎ | ◎ | ◎ |
| 6 | I | ◎ | ◎ | ◎ | ◎ | ◎ | ◎ |
| | II | ◎ | ◎ | ◎ | ◎ | ◎ | ◎ |
| 7 | I | o | ◎ | ◎ | ◎ | ◎ | ◎ |
| | II | o | ◎ | ◎ | ◎ | ◎ | ◎ |
| 8 | I | o | ◎ | ◎ | ◎ | ◎ | ◎ |
| | II | o | ◎ | ◎ | ◎ | ◎ | ◎ |
| 9 | I | o | o | ◎ | ◎ | ◎ | ◎ |
| | II | o | o | ◎ | ◎ | ◎ | ◎ |
| 10 | I | o | o | ◎ | ◎ | ◎ | ◎ |
| | II | o | o | ◎ | ◎ | ◎ | ◎ |
| 11 | I | o | ◎ | ◎ | ◎ | ◎ | ◎ |
| | II | o | ◎ | ◎ | ◎ | ◎ | ◎ |
| 12 | I | o | ◎ | ◎ | ◎ | ◎ | ◎ |
| | II | o | ◎ | ◎ | ◎ | ◎ | ◎ |

TABLE 2-continued

| Example | Effect Evaluation | Concentration of linsing aid (by weight) 5/$10^6$ | 1/$10^5$ | 5/$10^5$ | 1/$10^4$ | 1/$10^3$ | 1/$10^2$ |
|---|---|---|---|---|---|---|---|
| 13 | I | ◎ | ◎ | ◎ | ◎ | ◎ | ◎ |
| | II | ◎ | ◎ | ◎ | ◎ | ◎ | ◎ |
| 14 | I | o | ◎ | ◎ | ◎ | ◎ | ◎ |
| | II | o | ◎ | ◎ | ◎ | ◎ | ◎ |

TABLE 3

| Example | Effect Evaluation | Concentration of linsing aid (by weight) 5/$10^6$ | 1/$10^5$ | 5/$10^5$ | 1/$10^4$ | 1/$10^3$ | 1/$10^2$ |
|---|---|---|---|---|---|---|---|
| Comp. 1 | I | X | Δ | Δ | o | o(*1) | o(*1) |
| | II | X | Δ | Δ | o | o(*1) | o(*1) |
| Comp. 2 | I | | | X (untreated) | | | |
| | II | | | X (untreated) | | | |

Note: (*1) The surface of the glass was sticky.

TABLE 4

| Example | Effect Evaluation | Concentration of linsing aid (by weight) 1/$10^5$ | 5/$10^5$ | 1/$10^4$ | 1/$10^3$ | 1/$10^2$ |
|---|---|---|---|---|---|---|
| 1 | III | Δ | o | o | ◎ | ◎ |
| | IV | Δ | o | o | ◎ | ◎ |
| 2 | III | Δ | o | o | ◎ | ◎ |
| | IV | Δ | o | o | ◎ | ◎ |
| 3 | III | Δ | o | ◎ | ◎ | ◎ |
| | IV | Δ | o | ◎ | ◎ | ◎ |
| 4 | III | Δ | o | o | ◎ | ◎ |
| | IV | Δ | o | o | ◎ | ◎ |
| 5 | III | Δ | o | ◎ | ◎ | ◎ |
| | IV | Δ | o | ◎ | ◎ | ◎ |
| 6 | III | Δ | o | ◎ | ◎ | ◎ |
| | IV | Δ | o | ◎ | ◎ | ◎ |
| 7 | III | Δ | o | ◎ | ◎ | ◎ |
| | IV | Δ | o | ◎ | ◎ | ◎ |
| 8 | III | Δ | o | o | ◎ | ◎ |
| | IV | Δ | o | o | ◎ | ◎ |
| 9 | III | Δ | o | o | ◎ | ◎ |
| | IV | Δ | o | o | ◎ | ◎ |
| 10 | III | Δ | o | o | ◎ | ◎ |
| | IV | Δ | o | o | ◎ | ◎ |
| 11 | III | Δ | o | ◎ | ◎ | ◎ |

TABLE 4-continued

| Example | Effect Evaluation | Concentration of linsing aid (by weight) $\frac{1}{10^5}$ | $\frac{5}{10^5}$ | $\frac{1}{10^4}$ | $\frac{1}{10^3}$ | $\frac{1}{10^2}$ |
|---|---|---|---|---|---|---|
| | IV | Δ | ○ | ◎ | ◎ | ◎ |
| 12 | III | Δ | ○ | ○ | ◎ | ◎ |
| | IV | Δ | ○ | ○ | ◎ | ◎ |
| 13 | III | Δ | ○ | ◎ | ◎ | ◎ |
| | IV | Δ | ○ | ◎ | ◎ | ◎ |
| 14 | III | Δ | ○ | ○ | ◎ | ◎ |
| | IV | Δ | ○ | ○ | ◎ | ◎ |
| Comp. 1 | III | X | X | X | X | X |
| | IV | X | X | X | X | X |
| Comp. 3 | III | X (untreated) | | | | |
| | IV | X (untreated) | | | | |

TABLE 5

| Example | Effect Evaluation | Concentration of linsing aid (by weight) $\frac{1}{10^5}$ | $\frac{5}{10^5}$ | $\frac{1}{10^4}$ | $\frac{1}{10^3}$ | $\frac{1}{10^2}$ |
|---|---|---|---|---|---|---|
| 1 | V | Δ | ○ | ○ | ◎ | ◎ |
| 1 | V | Δ | ○ | ○ | ◎ | ◎ |
| 2 | V | Δ | ○ | ○ | ◎ | ◎ |
| 3 | V | Δ | ○ | ◎ | ◎ | ◎ |
| 4 | V | Δ | ○ | ○ | ◎ | ◎ |
| 5 | V | Δ | ○ | ◎ | ◎ | ◎ |
| 6 | V | Δ | ○ | ◎ | ◎ | ◎ |
| 7 | V | Δ | ○ | ◎ | ◎ | ◎ |
| 8 | V | Δ | ○ | ○ | ◎ | ◎ |
| 9 | V | Δ | ○ | ○ | ◎ | ◎ |
| 10 | V | Δ | ○ | ○ | ◎ | ◎ |
| 11 | V | Δ | ○ | ◎ | ◎ | ◎ |
| 12 | V | Δ | ○ | ○ | ◎ | ◎ |
| 13 | V | Δ | ○ | ◎ | ◎ | ◎ |
| 14 | V | Δ | ○ | ○ | ◎ | ◎ |
| Comp. 1 | V | X | X | X | X | X |
| Comp. 3 | V | X (untreated) | | | | |

FIGS. 1 to 6 are longitudinal sectional views showing various dishwashers (the first dishwashers) used for the method by which a sticking inhibitor of the present invention is added to a detergent so as to be applied to dish surfaces in the washing process. Of these dishwashers, the ones shown in FIGS. 1, 3, and 5 have a liquid-pressure-operated diaphragm pump, an electric diaphragm pump, and an ejector, respectively, with a built-in electric water heater, being undercounter type dishwashers that can be accommodated under a kitchen sink. 0n the other hand, the ones shown in FIGS. 2, 4, and 6 have a liquid-pressure-operated diaphragm pump, an electric diaphragm pump, and an ejector, respectively, with a gas water heater provided externally, being tall, door type dishwashers that can wash a large number of dishes at one time.

Figure 27:
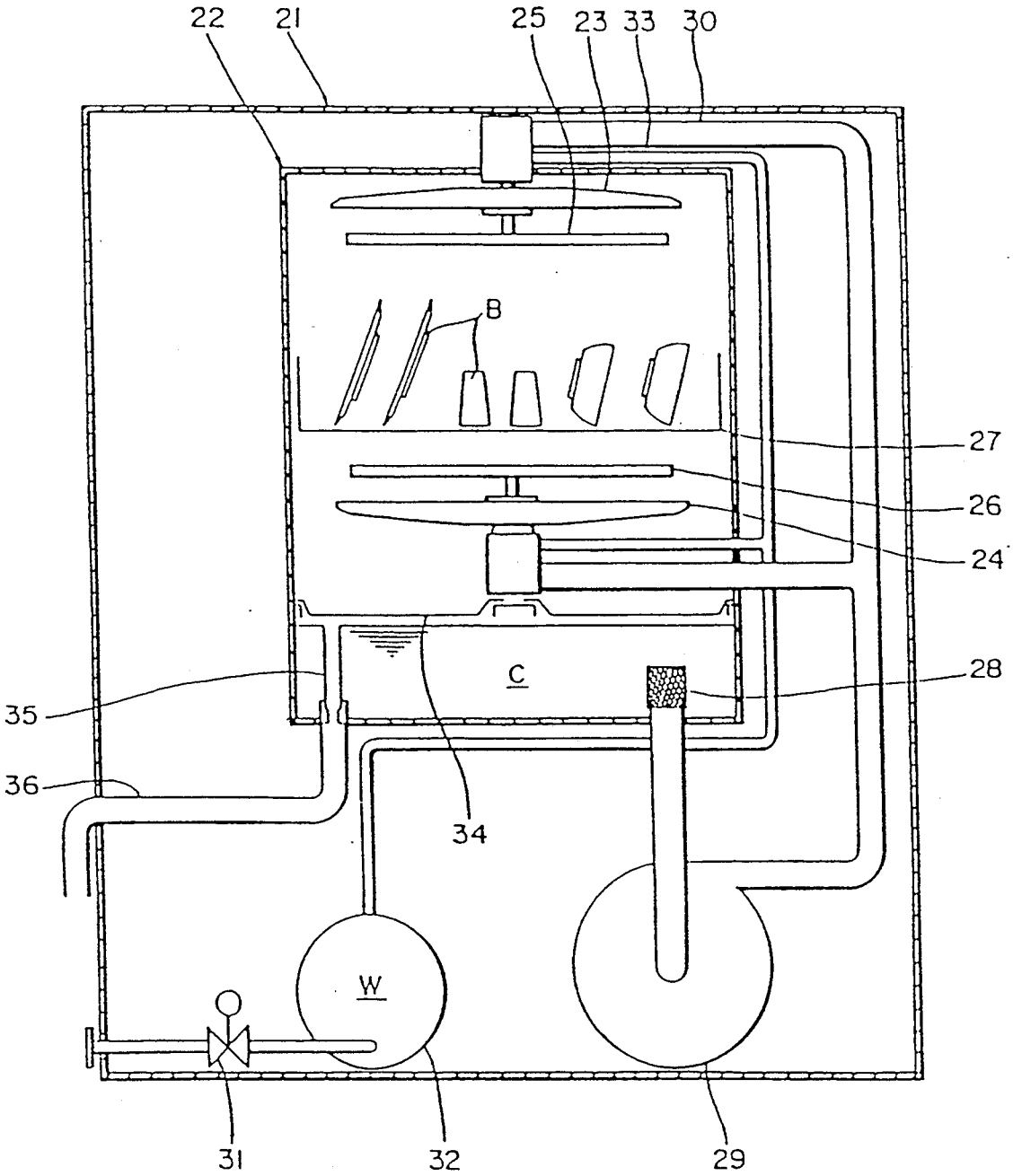
Fig. 27 PRIOR ART
FIG. 27 is a longitudinal sectional view showing a conventional business-use dishwasher.

The dishwasher in FIG. 1 is provided, in addition to the conventional counterpart described referring to FIG. 27, with a reservoir 1 in which sticking inhibitor A is stored, and a passageway 2 adapted to lead the sticking inhibitor A to the bottom of a washing chamber 22 communicated with washing piping 30 through a washing pump 29, the passageway 2 being provided with a diaphragm pump 3 driven by discharge pressure of the washing pump 29 with check valves 4, 5 interposed therebetween, wherein like members are indicated by like numerals in connection with the dishwasher in FIG. 27. The above diaphragm pump 3 is adapted to suck in a certain amount of the sticking inhibitor A through the check valve 4 by push-back operation of a diaphragm 7 by a back spring 6 during the idle state of the washing pump 29, and discharge the sucked sticking inhibitor A to the bottom of the washing chamber 22 through the check valve 5 by push-out operation of the diaphragm 7 by liquid pressure of the detergent (see the dash-and-dot line in the figure) discharged from the washing pump 29 during its operating state.

Figure 3:
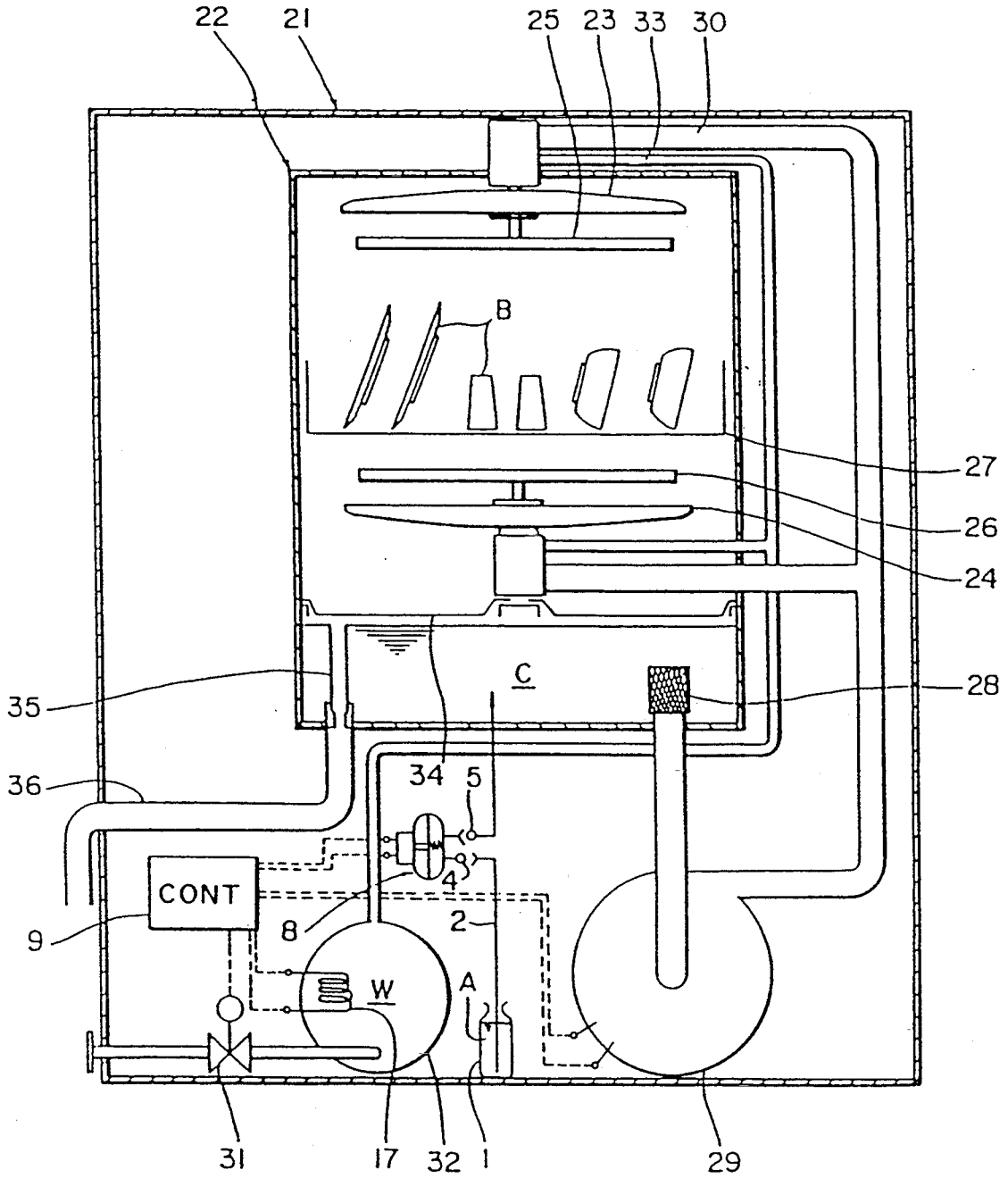
FIG. 3 is a similar longitudinal sectional view.

FIG. 3 illustrates a variation of the dishwasher in FIG. 1. The varied dishwasher is provided with an electric diaphragm pump 8 in place of the diaphragm pump 3 of FIG. 1 and further with a controller 9 for sequentially controlling the electric diaphragm pump 8, a washing pump 29, the heater of an electric water heater 32, and an electromagnetic valve 31 for supplying water as the washing process progresses. The controller 9, in accordance with its control program, makes the washing pump 29 held ON for a specified time period, thereby carrying out the washing process, makes the electromagnetic valve 31 held open for a specified time period, thereby carrying out the rinsing process, and moreover controls the rest time between the two processes. The controller 9 further controls the timing of suction and discharge operations of the electric diaphragm pump 8.

Figure 5:
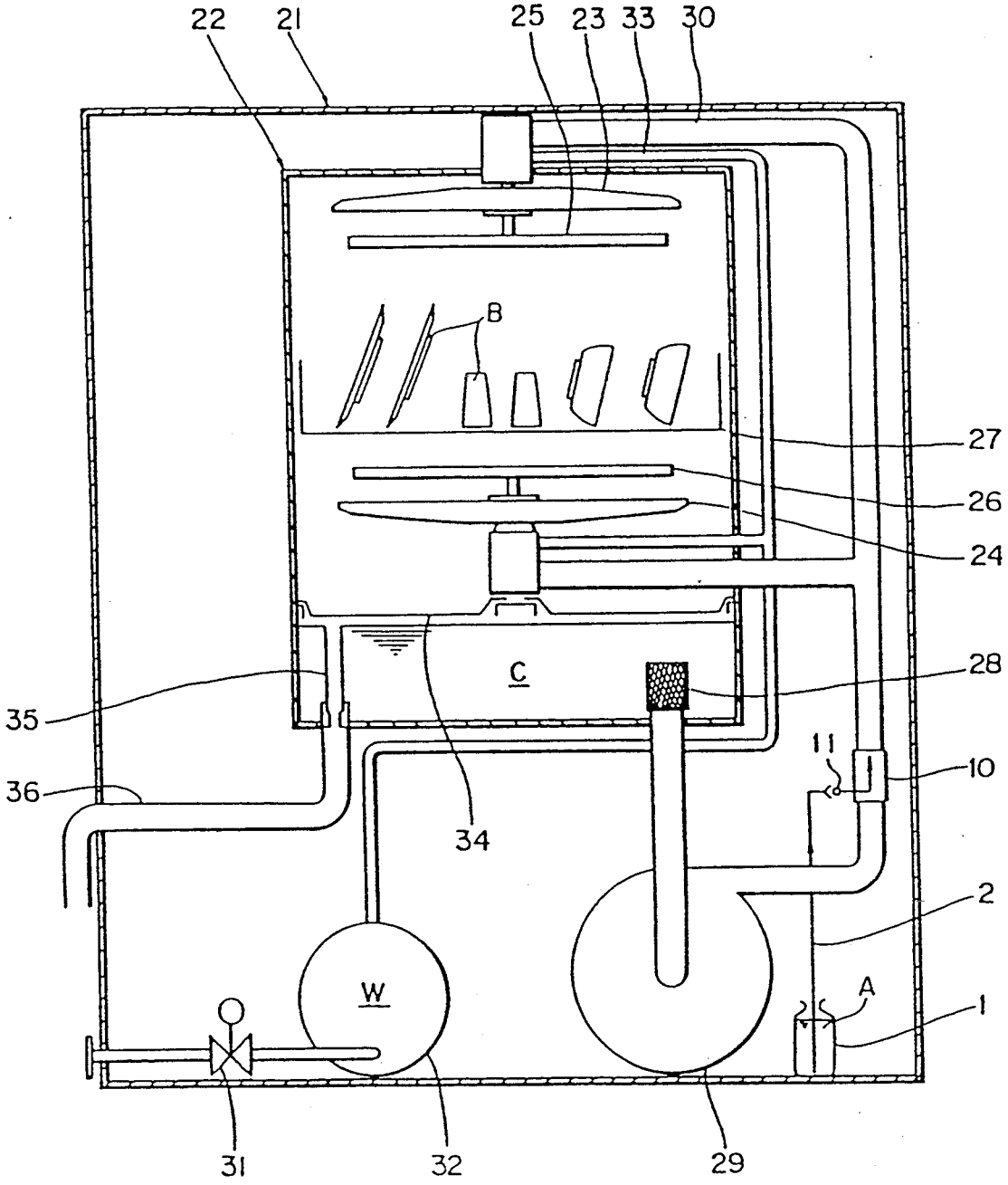
FIG. 5 is a similar longitudinal sectional view.

FIG. 5 illustrates a simplified variation of the dishwasher of FIG. 1. The varied dishwasher has the diaphragm pump 3 in FIG. 1 omitted, but has a passageway 2 for leading the sticking inhibitor A joined together with washing piping 30 as well as an ejector 10 provided to an end of the passageway 2 with a check valve 11 interposed therebetween, the ejector 10 being disposed within the washing piping 30. With the arrangement, when the detergent C is pumped into the washing piping 30 by the operation of the washing pump 29, the sticking inhibitor A is sucked into the detergent C by the ejector 10.

Figure 2:
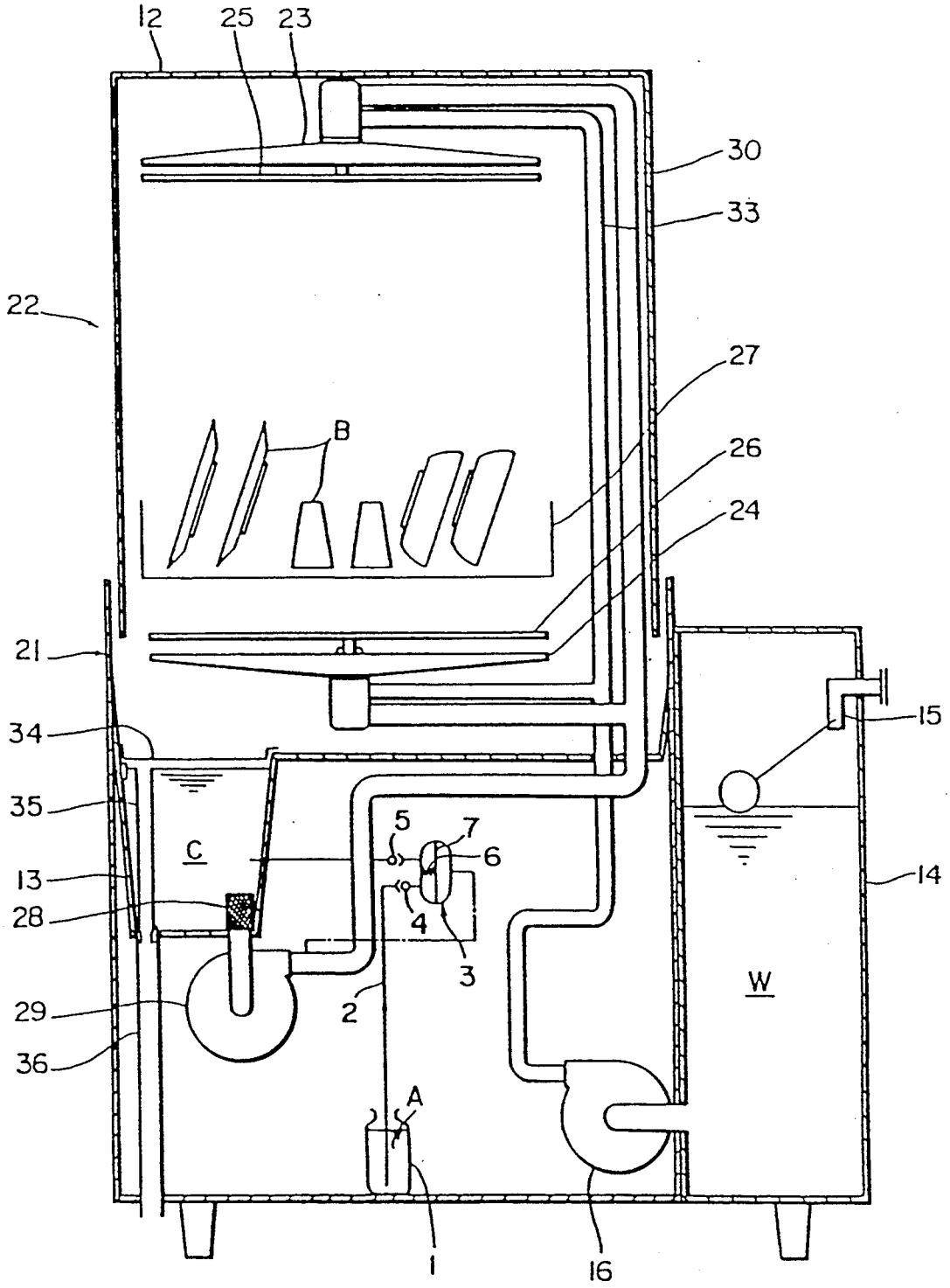
FIG. 2 is a similar longitudinal sectional view.
Figure 4:
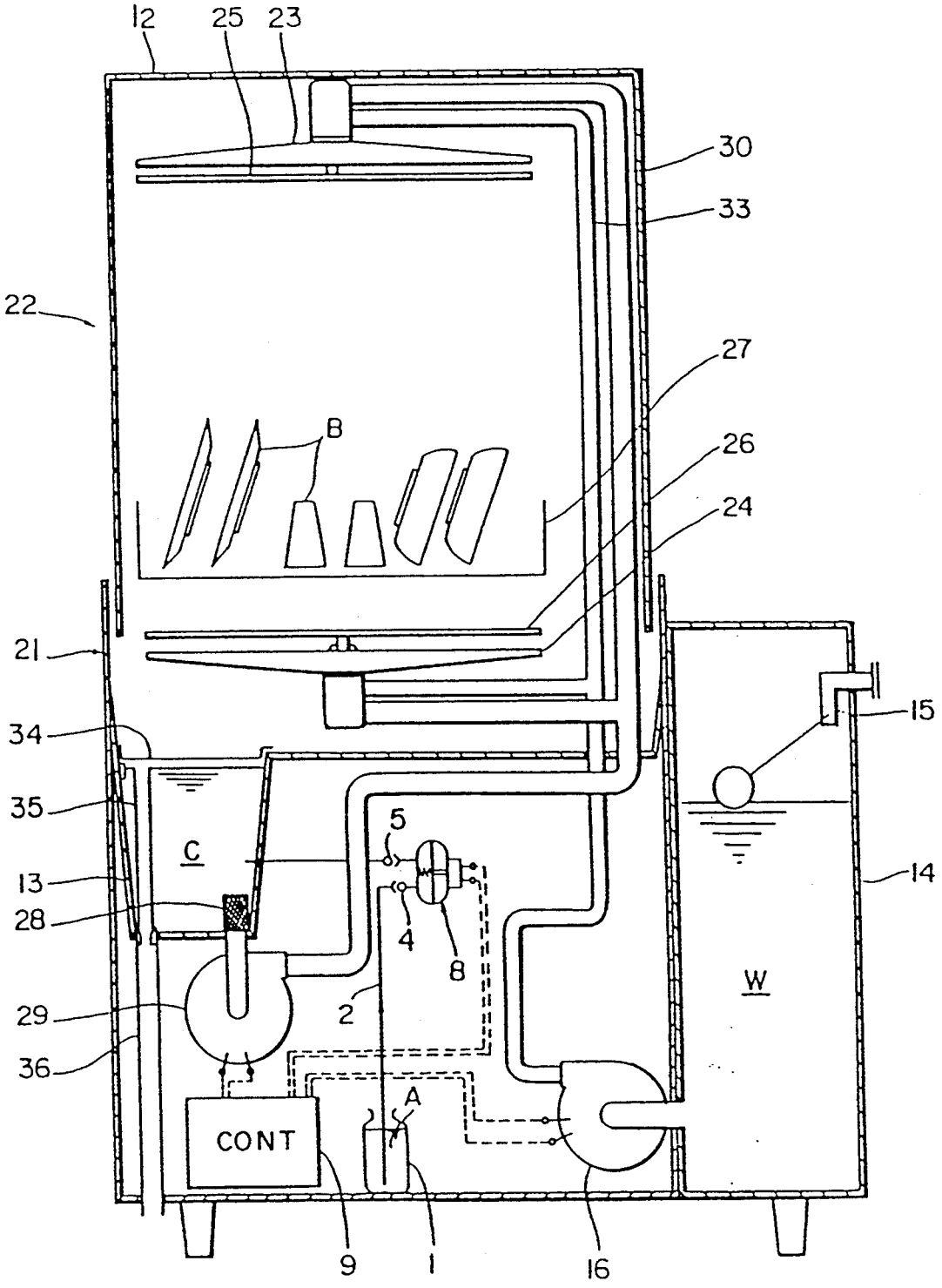
FIG. 4 is a similar longitudinal sectional view.
Figure 6:
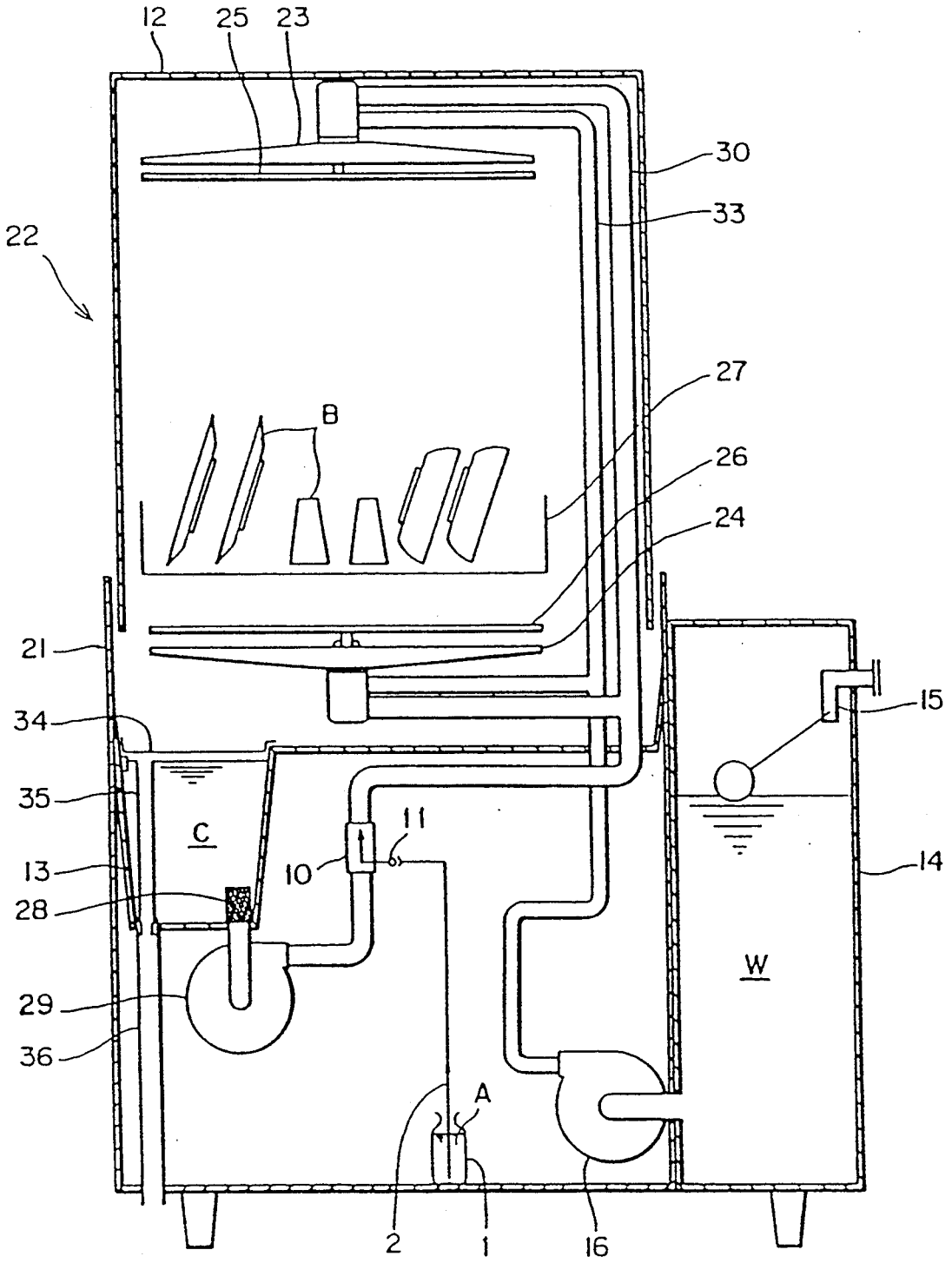
FIG. 6 is a similar longitudinal sectional view.

On the other hand, the door type dishwashers shown in FIGS. 2, 4, and 6 are the same in their basic construction as those of undercounter type in FIGS. 1, 3, and 5, differing therefrom only in that: in the door type dishwashers, there is provided a washing chamber 22 immediately above the casing 21, the washing chamber 22 being made up of an upper hood 12 the up-and-down movement of which enables a rack 27 having dishes B accommodated thereon to be put in and out in three ways, and a lower washing reservoir 13 having a detergent C; and in that rinsing warm water is supplied as it is heated by a gas water heater 14 externally provided and having a water supply ball tap 15 and a rinsing pump 16. The arrangement of other members including the reservoir 1 for sticking inhibitors, diaphragm pump 3, electric diaphragm pump 8, and ejector 10 is the same as the former counterparts, where FIGS. 2, 4, and 6 correspond to FIGS. 1, 3, and 5, respectively.

The first dishwashers having the above-mentioned arrangement are described in their operation below, especially in their washing method in which a sticking inhibitor is added to a detergent in the washing process so as to be applied to dishes, taking the case of FIG. 1 by way of example.

Referring to FIG. 1, the diaphragm pump 3 sucks in itself a specified quantity of the sticking inhibitor A from the reservoir 1 through the check valve 4 provided to the passageway 2 by push-back operation of the diaphragm 7 by the back spring 6 during the idle state of the washing pump 29. When the washing pump 29 is actuated with start-up of the dishwasher, the diaphragm 7 is pushed out by liquid pressure of the detergent C discharged from the washing pump 29, causing the sticking inhibitor A to be discharged to the bottom of the washing chamber 22 through the check valve 5 on the passageway 2. As a result, the sticking inhibitor A is added to the detergent C that is heat insulated at 60° to 65° C. The sticking inhibitor added to the detergent C is pumped by the washing pump 29 to washing arms 23, 24 disposed above and below in the washing chamber 22 through the washing piping 30. Then the sticking inhibitor is sprayed therefrom along with the detergent toward the dishes B on the rack 27. By this spraying, the dishes B are washed with the detergent C, while the sticking inhibitor A enhanced in its dispersion characteristic by the detergent C is successfully stuck to the surfaces of the dishes B.

After a certain period of operation, the washing pump 29 stops. When a certain rest time elapses thereafter, the electromagnetic valve 31 opens so as to supply water to the electric water heater 32. The water, heated to 80° to 85° C. by the water heater 32, is sprayed from upper and lower rinsing arms 25, 26 through rinsing piping 33 toward the dishes B. As a result, the detergent on the surfaces of the dishes B is washed away with the warm water, while the sticking inhibitor A firmly sticking to the surfaces of the dishes B by hydrogen bond (see FIG. 20) will not be washed away almost at all, allowing the dishes B to be dried by remaining heat of the warm water as the sticking inhibitor is left sticking to the surfaces thereof.

Now that the dishes B are washed through and rice can be served thereon, even when the rice is left uneaten and allowed to be dried, the rice having a number of hydroxyl groups are unlikely to stick to the dishes B due to hydrophobic groups of the sticking inhibitor A on the surfaces of the dishes B, which reject the rice. This eliminates the need for pretreatment of immersing them in a water bath for a long time as necessitated conventionally, but permits the remaining rice to be removed from the dishes B only by washing with the dishwasher, as is the principal effect of the dishwasher. Accordingly, by omitting the pretreatment of bath immersion, it is made possible to reduce the time and labor required to wash dishes particularly in restaurants or the like. In addition, in the example of FIG. 1, since the diaphragm pump 3 is driven by the pressure of discharged liquid of the washing pump 29, it is unnecessary to separately provide driving means therefor, thus affording an advantage that the dishwasher can be reduced in cost and size.

In the varied dishwasher in FIG. 3, the electric diaphragm pump 8 is employed, and it is arranged to control the pump 8, washing pump 29, the heater 17 of the electric water heater 32, and the electromagnetic valve 31 by the controller 9. Thus, the dishwasher in FIG. 3 has such an advantage, in addition to the principal effect described for the foregoing example, that it is possible by use of programs to discretionally and readily set the washing time, idle time, rinsing time, rinsing water temperature, and the timing of adding a sticking inhibitor. Moreover, in the example of FIG. 5, the diaphragm pump 3 is omitted and the ejector 10 is provided to the washing piping 30. Thus, in addition to the principal effect described for the above example, the dishwasher in FIG. 5 affords such an advantage that the sticking inhibitor A can continuously be added to the detergent C during the operation of the washing pump 29, allowing the dishwasher to be further reduced in cost and size. The examples in FIGS. 2, 4, and 6 are of the same construction as the ones in FIGS. 1, 3, and 5, respectively, only differing therefrom in the type of dishwasher, thus capable of the same operations and effects.

Figure 7:
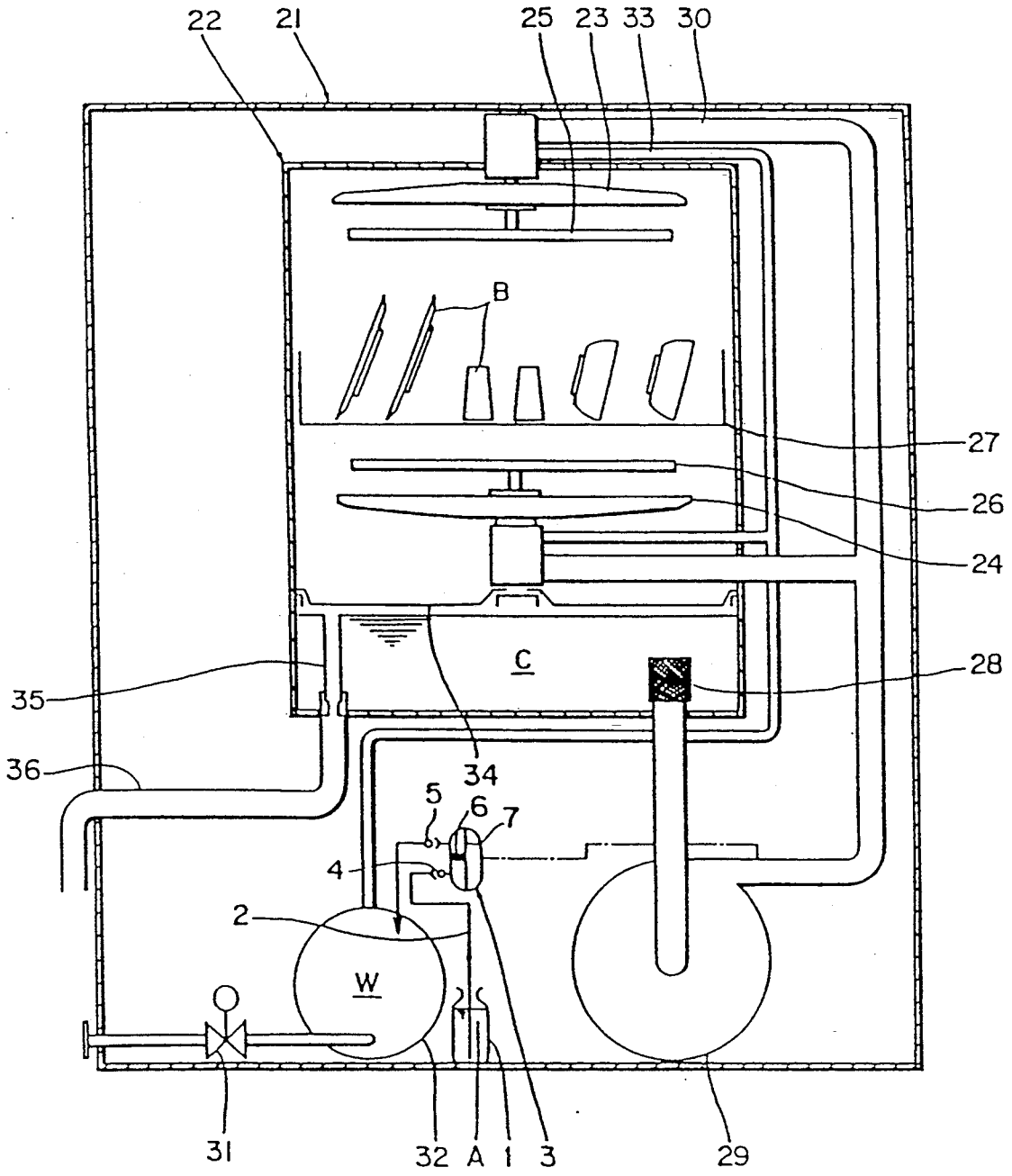
FIG. 7 is a similar longitudinal sectional view.
Figure 8:
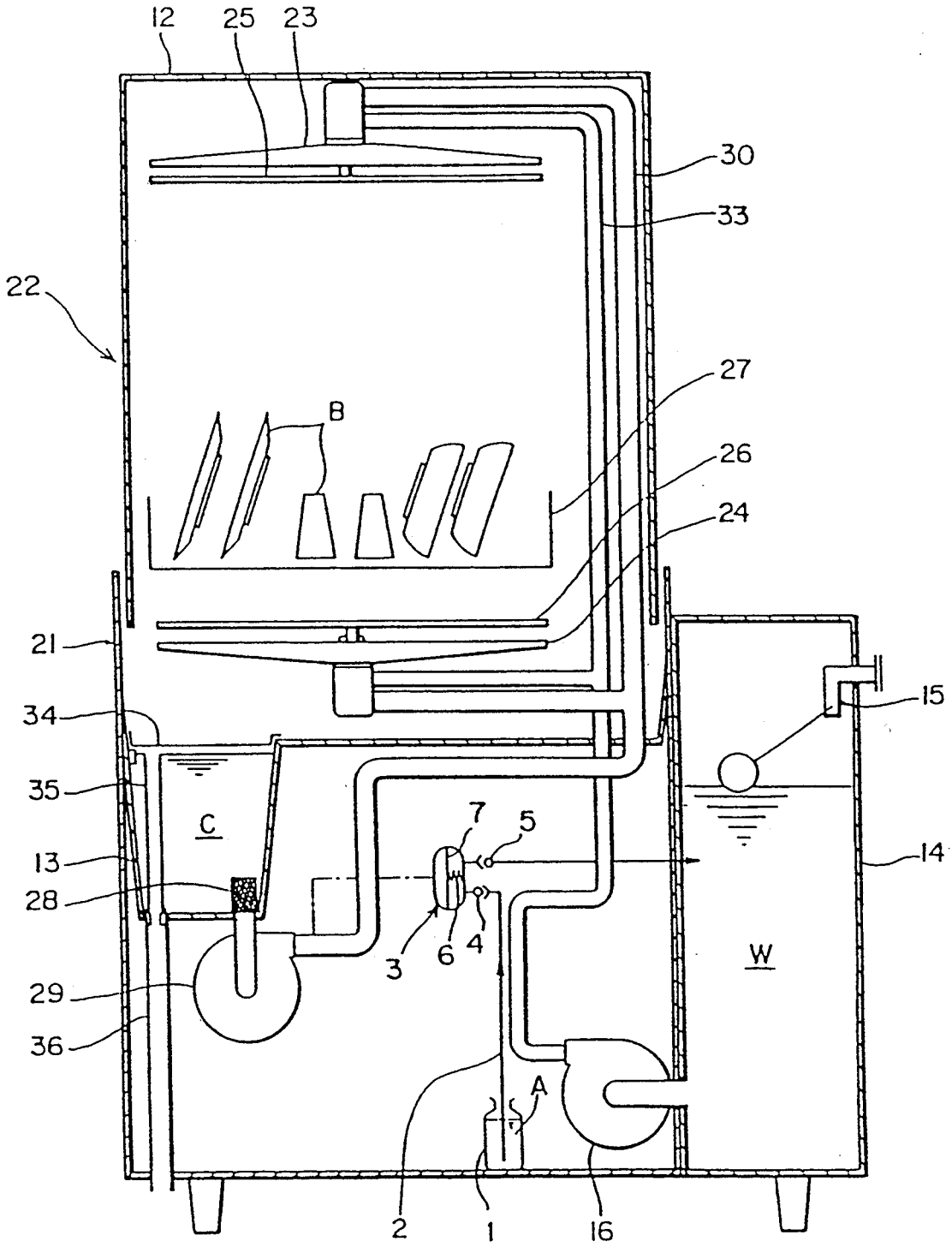
FIG. 8 is a similar longitudinal sectional view.
Figure 9:
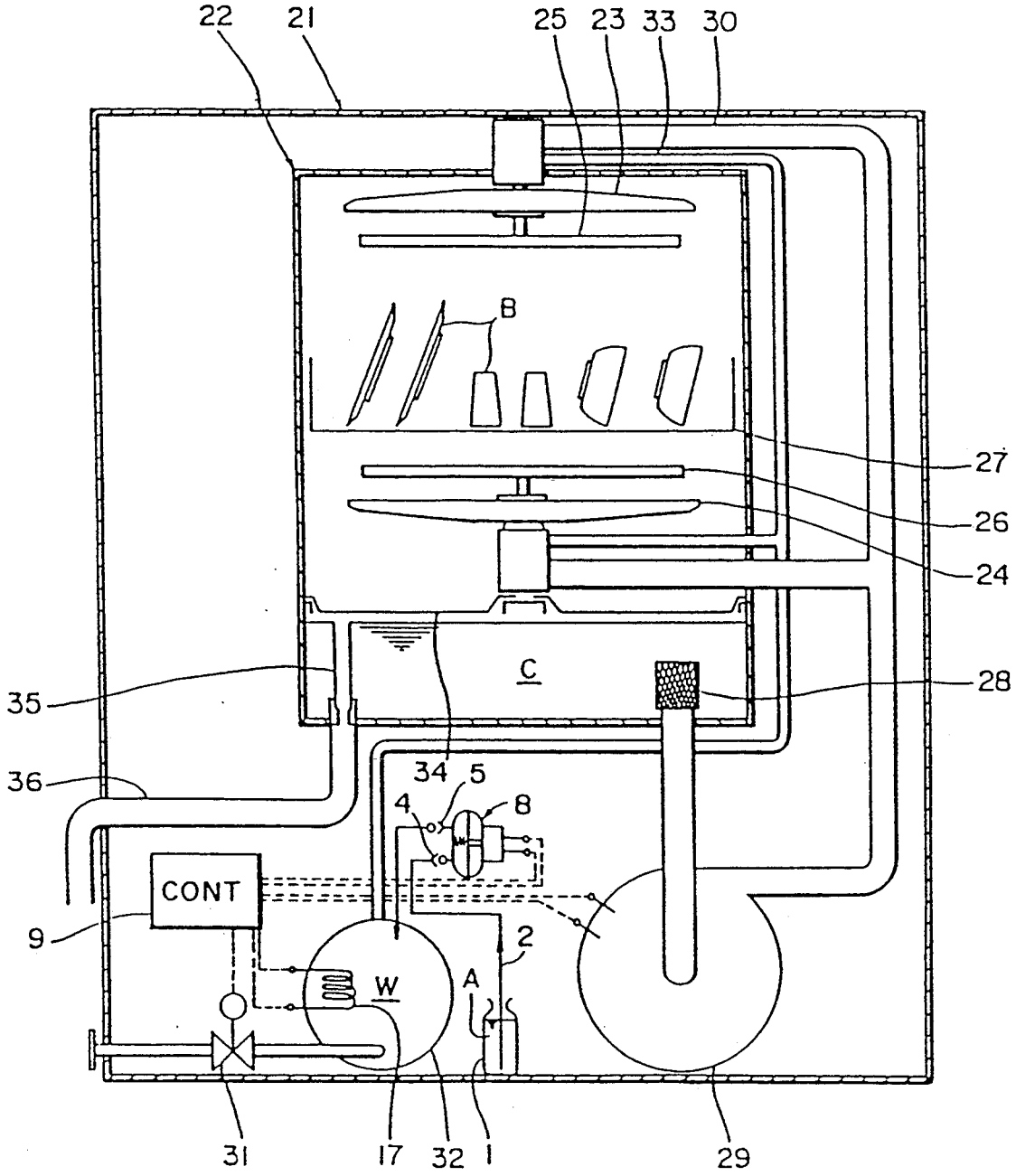
FIG. 9 is a similar longitudinal sectional view.
Figure 10:
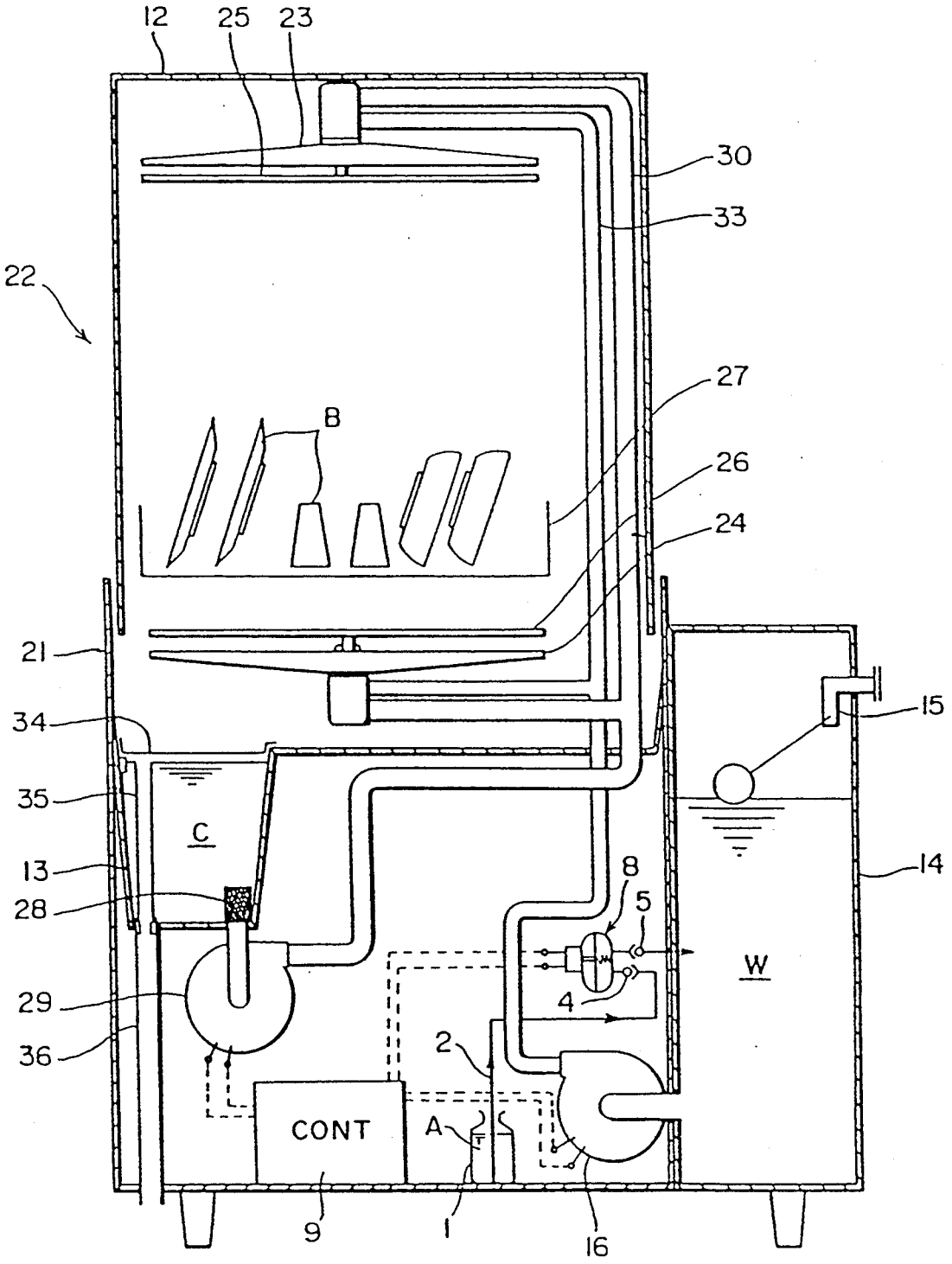
FIG. 10 is a similar longitudinal sectional view.
Figure 11:
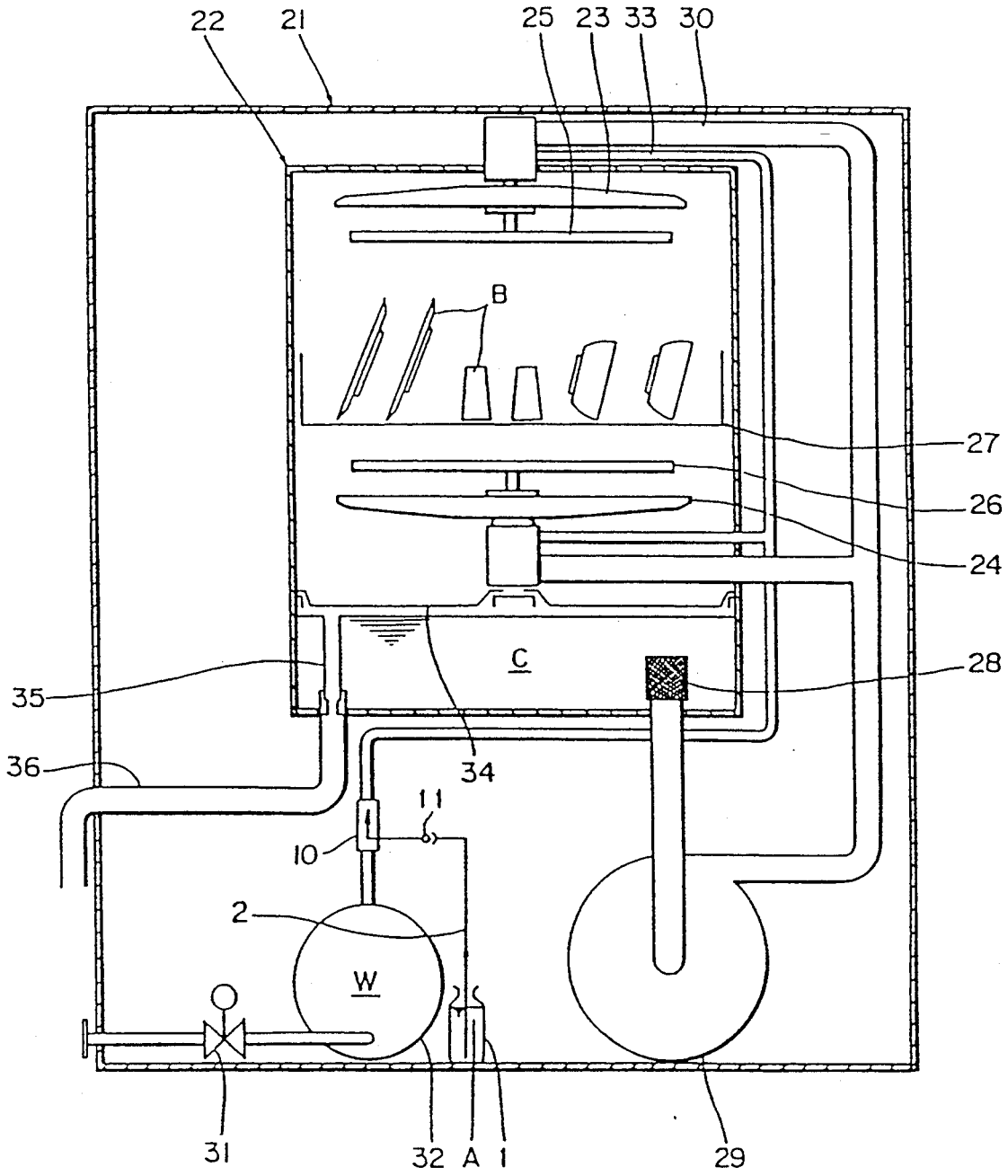
FIG. 11 is a similar longitudinal sectional view.
Figure 12:
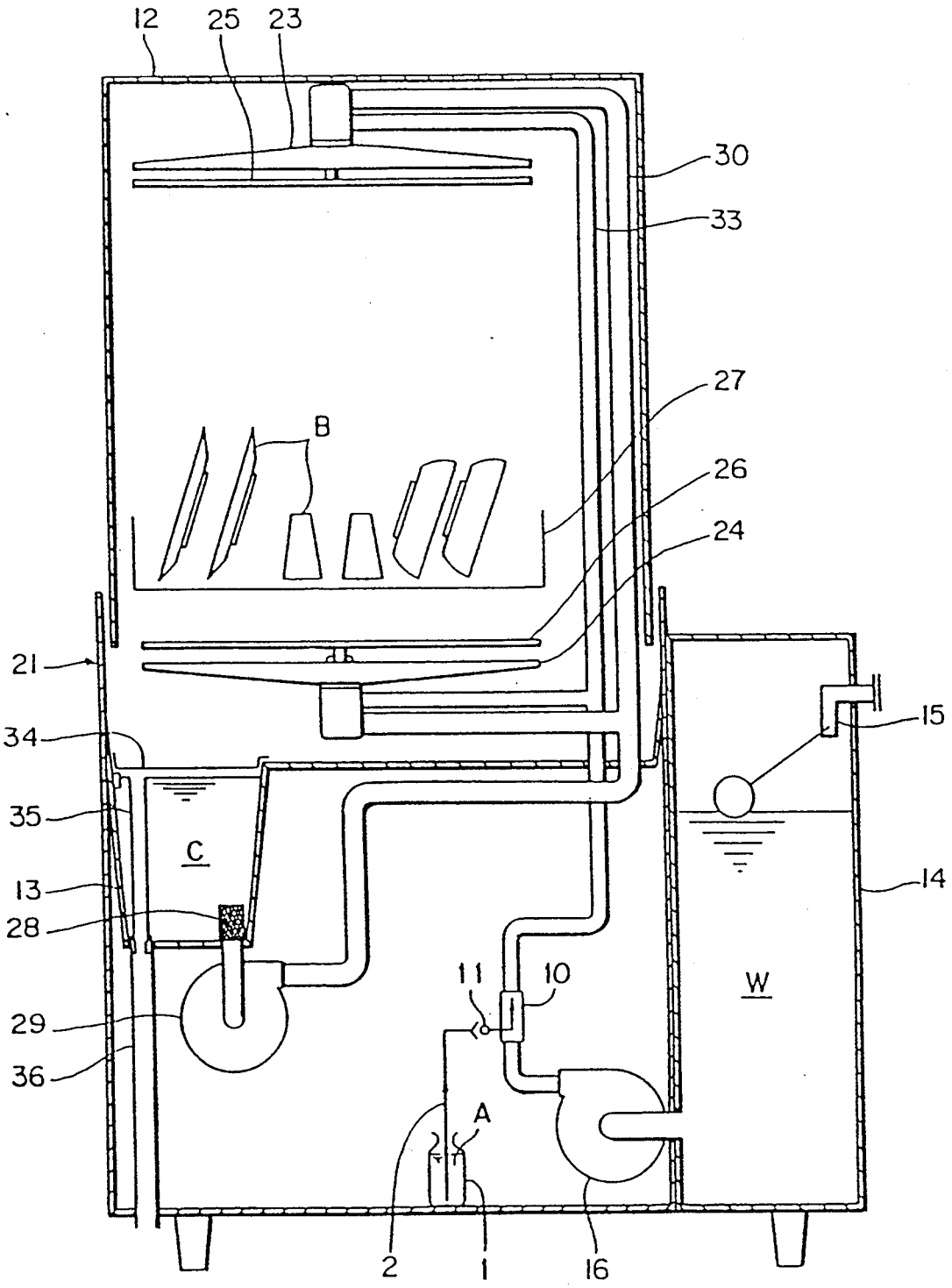
FIG. 12 is a similar longitudinal sectional view.

FIGS. 7 to 12 are longitudinal sectional views each showing a second dishwasher used for the method by which the above sticking inhibitor is added to rinsing warm water in the rinsing process so as to be applied to dishes. Out of these dishwashers, the ones shown in FIGS. 7, 9, and 11 are of such undercounter type as corresponding to the above-described ones in FIGS. 1, 3, and 5, respectively, wherein the dishwashers differ from the counterparts only in that the passageway 2 communicated with the reservoir 1 for the sticking inhibitor A is led not to the bottom of the washing chamber 22 or the washing piping 30 but to the electric water heater 32 and the rinsing piping 33. Throughout the drawings, like other members are indicated by like numerals. The dishwashers shown in FIGS. 8, 10, and 12 are of such door type as corresponding to the ones in FIGS. 2, 4, and 6, respectively, wherein the dishwashers differ from the counterparts only in that the passageway 2 communicated with the reservoir 1 for the sticking inhibitor A is led not to the washing reservoir 13 or the washing piping 30 but to the gas water heater 14 and the rinsing piping 33. Throughout the drawings, like other members are indicated by like numerals.

Incidentally, if a rinsing assistant, later described, is stored in the reservoir 1 instead of the sticking inhibitor A, the rinsing assistant can be added to rinsing warm water in the rinsing process so as to be applied to dishes.

The description is now directed to the method for adding the sticking inhibitor to rinsing warm water in the rinsing process thereby to apply it to dishes with the second dishwasher so constructed as above, taking the case of FIG. 7 by way of example, where only the differences from FIG. 1 are referred to.

In FIG. 7, the diaphragm pump 3 sucks in the sticking inhibitor A from the reservoir 1 during the idle state of the washing pump 29 and discharges it into the electric water heater 32 during the operation of the washing pump 29, thereby adding the sticking inhibitor A to rinsing warm water W. Thereafter, when the washing by the washing pump 29 is over and an idle interval has elapsed, the electromagnetic valve 31 is opened so that the rinsing warm water W containing the sticking inhibitor A is sprayed from the rinsing arms 25, 26 toward dishes B. The detergent C remaining on the surfaces of the dishes B is thereby washed away, while the sticking inhibitor A in the rinsing warm water is strongly adsorbed to the surfaces of the dishes B by hydrogen bond and moreover stuck thereto without any loss through remaining heat drying by the high-temperature rinsing warm water. And yet, since the succeeding rinsing process is eliminated in this case unlike in FIG. 1, the sticking inhibitor will not be washed away, advantageously. Thus, even if rice is left uneaten on the dishes B so washed all over, the rice can readily be removed from the dishes only by washing with the dishwasher without pretreatment of bath immersion, as is the case with FIG. 1. This is the principal effect of the dishwasher, permitting the reduction in time and labor in washing dishes to be realized.

Also, the variations in FIGS. 9 and 11 differ from the ones in FIGS. 3 and 5, respectively, only in the above-described operation for FIG. 7, thus offering the advantage described for FIGS. 3 or 5 as well as the foregoing principal operation and effect. Further, the examples or variations in FIGS. 8, 10, and 12 are of the same construction as in FIGS. 7, 9, and 11, respectively, differing therefrom only in the type of dishwasher, thus capable of the same operation and effect as above.

Figure 13:
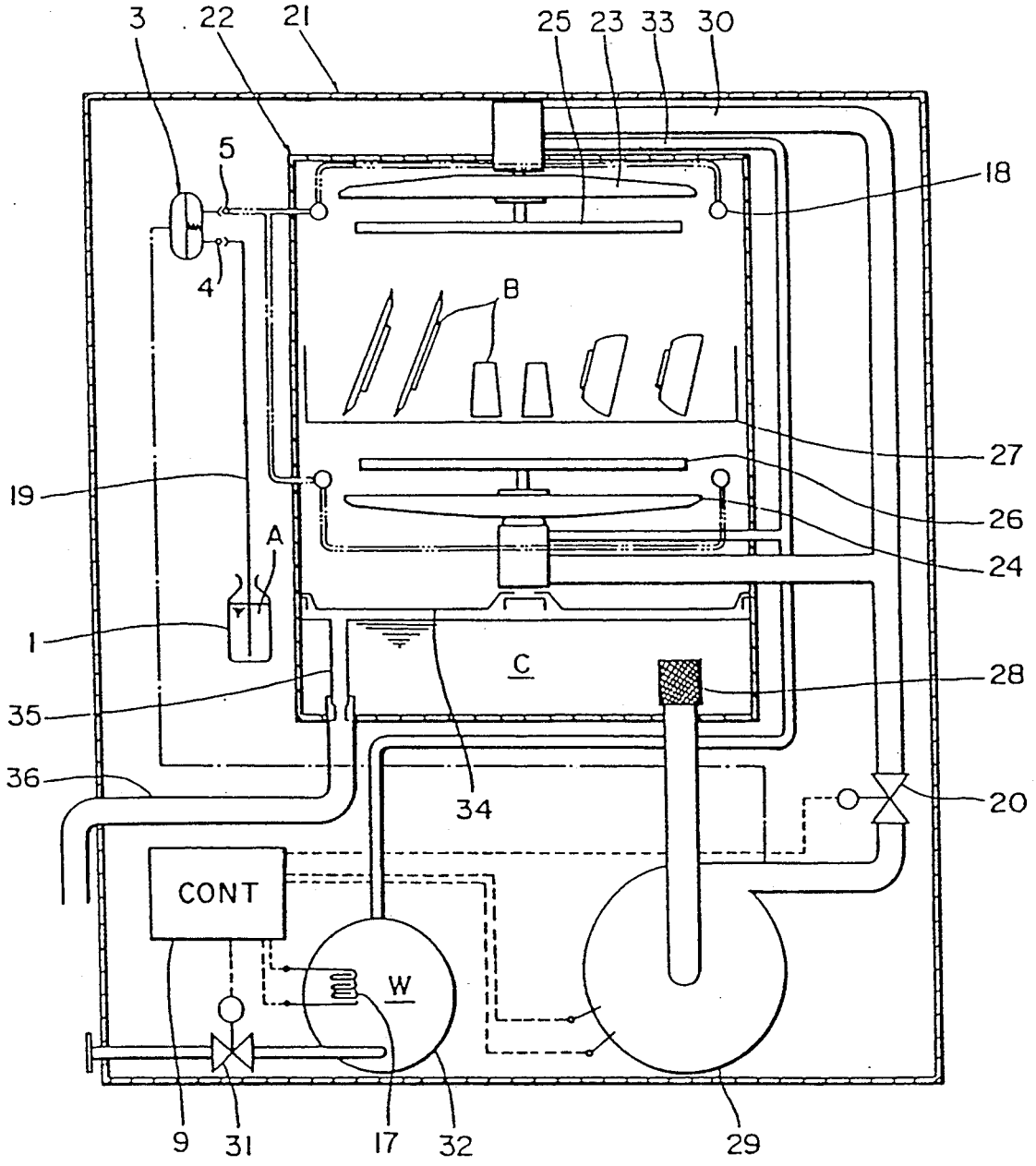
FIG. 13 is a similar longitudinal sectional view.
Figure 14:
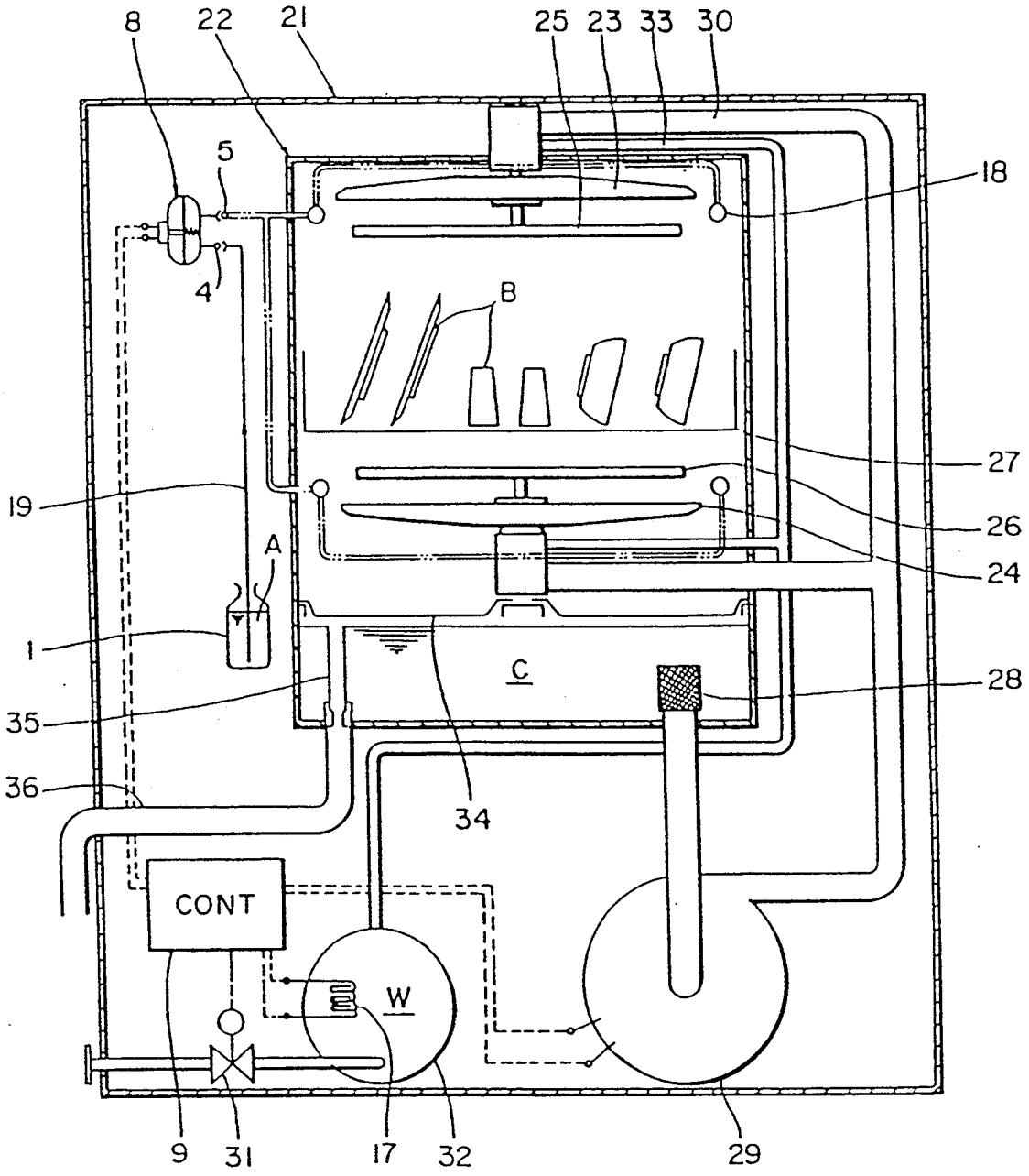
FIG. 14 is a similar longitudinal sectional view.
Figure 17:
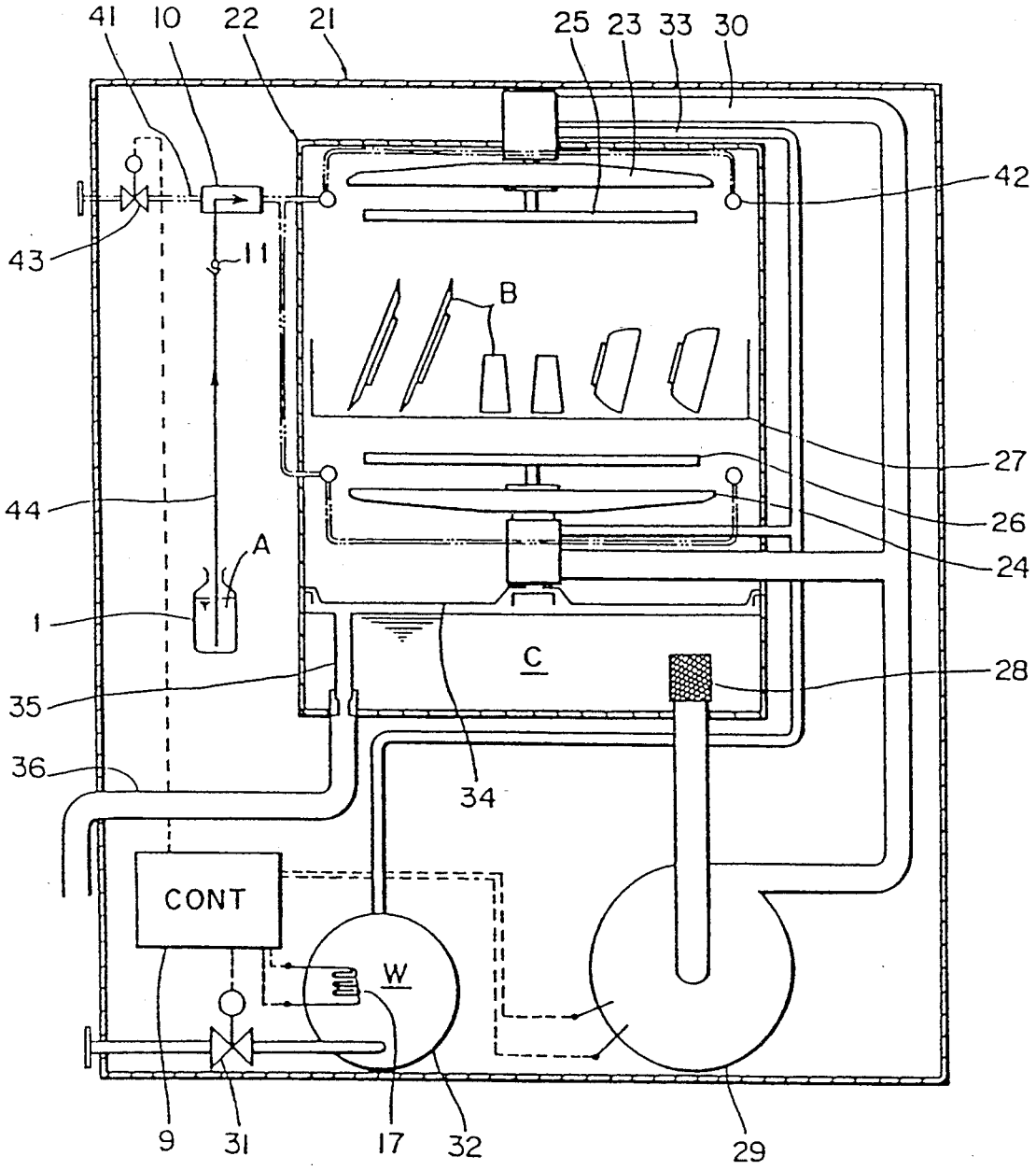
FIG. 17 is a similar longitudinal sectional view.

FIGS. 13, 14, and 17 are longitudinal sectional views showing a third and a fourth dishwasher, respectively, used for the dish washing method in which the above-mentioned sticking inhibitor is sprayed to dishes between the washing and rinsing processes or upon completion of the rinsing process so as to be applied to the dishes. These dishwashers are, in all cases, of the undercounter type and of the same basic construction as the case of FIG. 3 where the controller 9 is provided. Incidentally, in these dishwashers, if a rinsing assistant, later described, is stored in the reservoir 1 instead of the sticking inhibitor A, the rinsing assistant can be sprayed to dishes after the completion of the rinsing process so as to be applied to the dishes.

More specifically, the third dishwashers in FIGS. 13 and 14 each include spray nozzles 18 above and below in the washing chamber 22 exclusively for spraying the sticking inhibitor A to the dishes B in place of the sticking inhibitor supply system in FIG. 3, and a diaphragm pump for supplying the sticking inhibitor A in the reservoir 1 to the above-mentioned spray nozzles 18 through the spray piping 19, wherein the diaphragm pump 3 in FIG. 13 is driven by the discharge pressure of the washing pump 29 and the electric diaphragm pump 8 in FIG. 14 is controlled by the controller 9. Incidentally, the controller 9 in FIG. 13 is adapted to further control an electromagnetic switch valve 20 provided to the washing piping 30.

Figure 15:
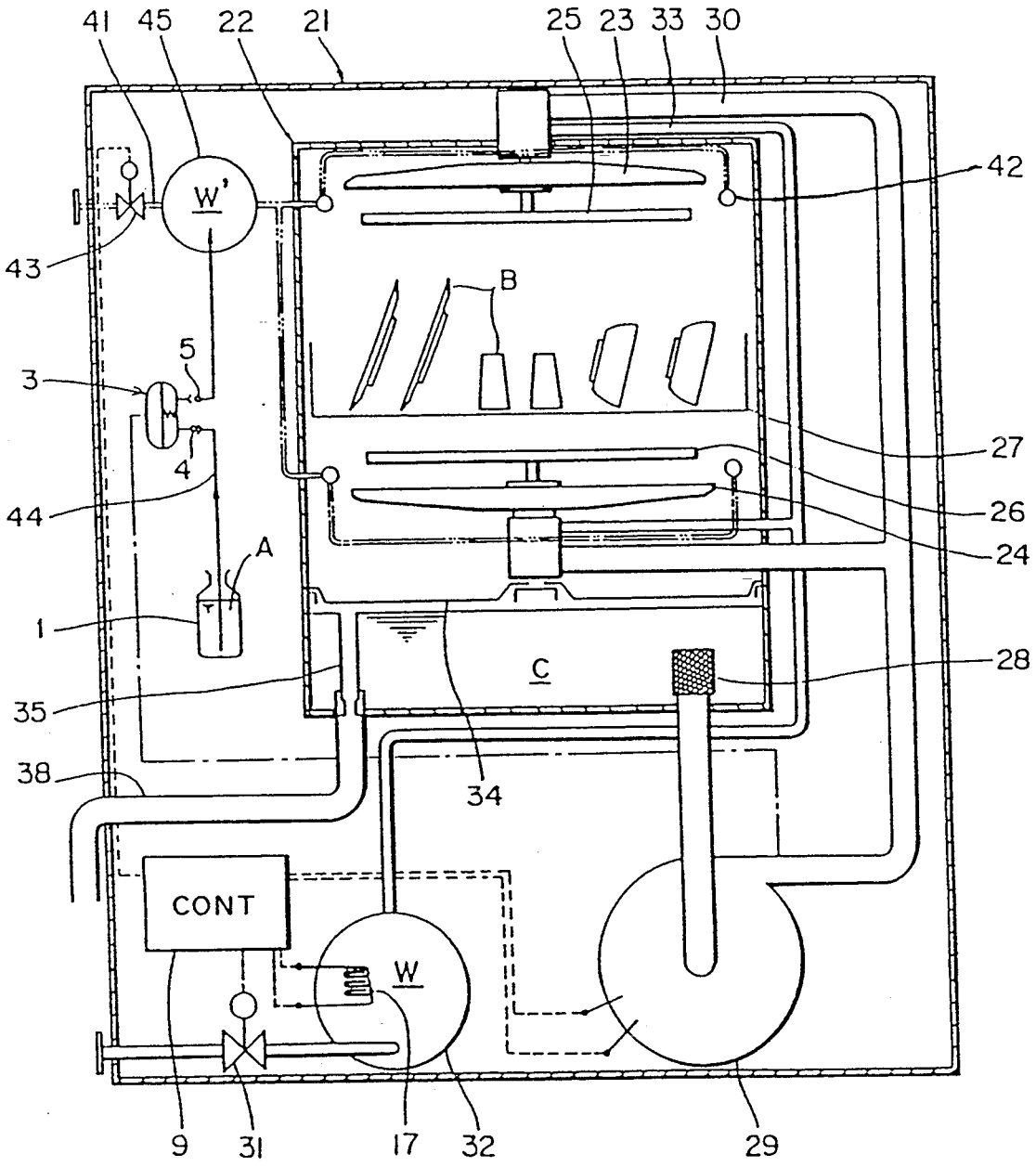
FIG. 15 is a similar longitudinal sectional view.
Figure 16:
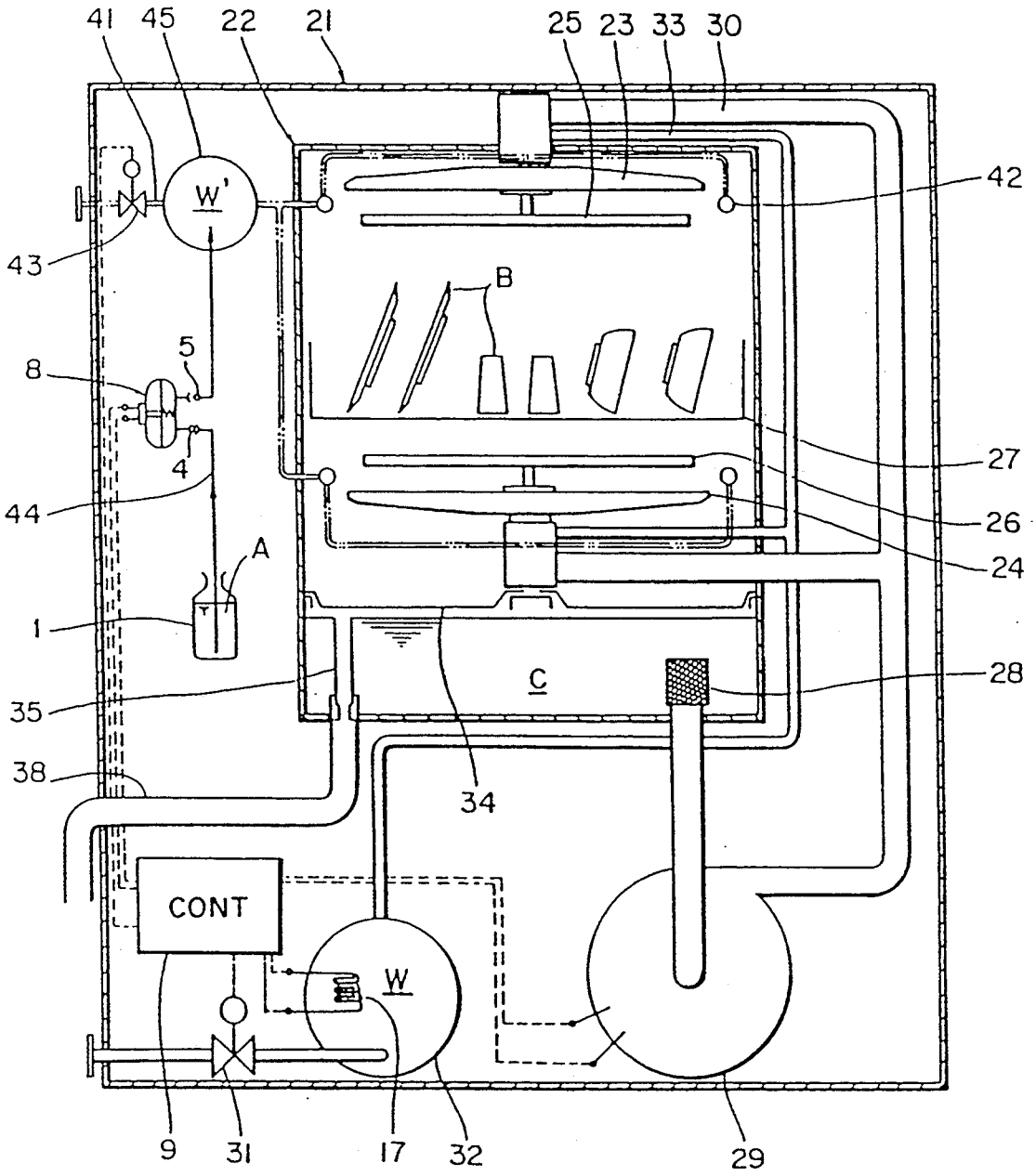
FIG. 16 is a similar longitudinal sectional view.

On the other hand, the fourth dishwasher in FIG. 17 includes, in place of the sticking inhibitor supply system in FIG. 3, water piping 41 having at its farther ends spray nozzles 42 for spraying water toward the dishes B and at its base end an electromagnetic switch valve 43; an agent piping 44 for the sticking inhibitor communicated with the reservoir 1; and moreover an ejector 10 disposed at the agent piping 44 so as to be positioned within the water piping 41 with a check valve interposed therebetween, wherein the electromagnetic switch valve 43 is controlled by the controller 9. The dishwashers shown in FIGS. 15 and 16 are variations of the fourth dishwasher in FIG. 17, wherein there is provided a water reservoir 45 at the position of the ejector 10 in FIG. 17 as a substitute therefor, to which water reservoir 45 the sticking inhibitor A is supplied by the liquid-pressure-operated diaphragm pump 3 provided in the course of the agent piping 44 (see FIG. 15) or the electric diaphragm pump 8.

The description is now made for the method of applying a sticking inhibitor with the third dishwasher constructed as above.

Figure 18A:
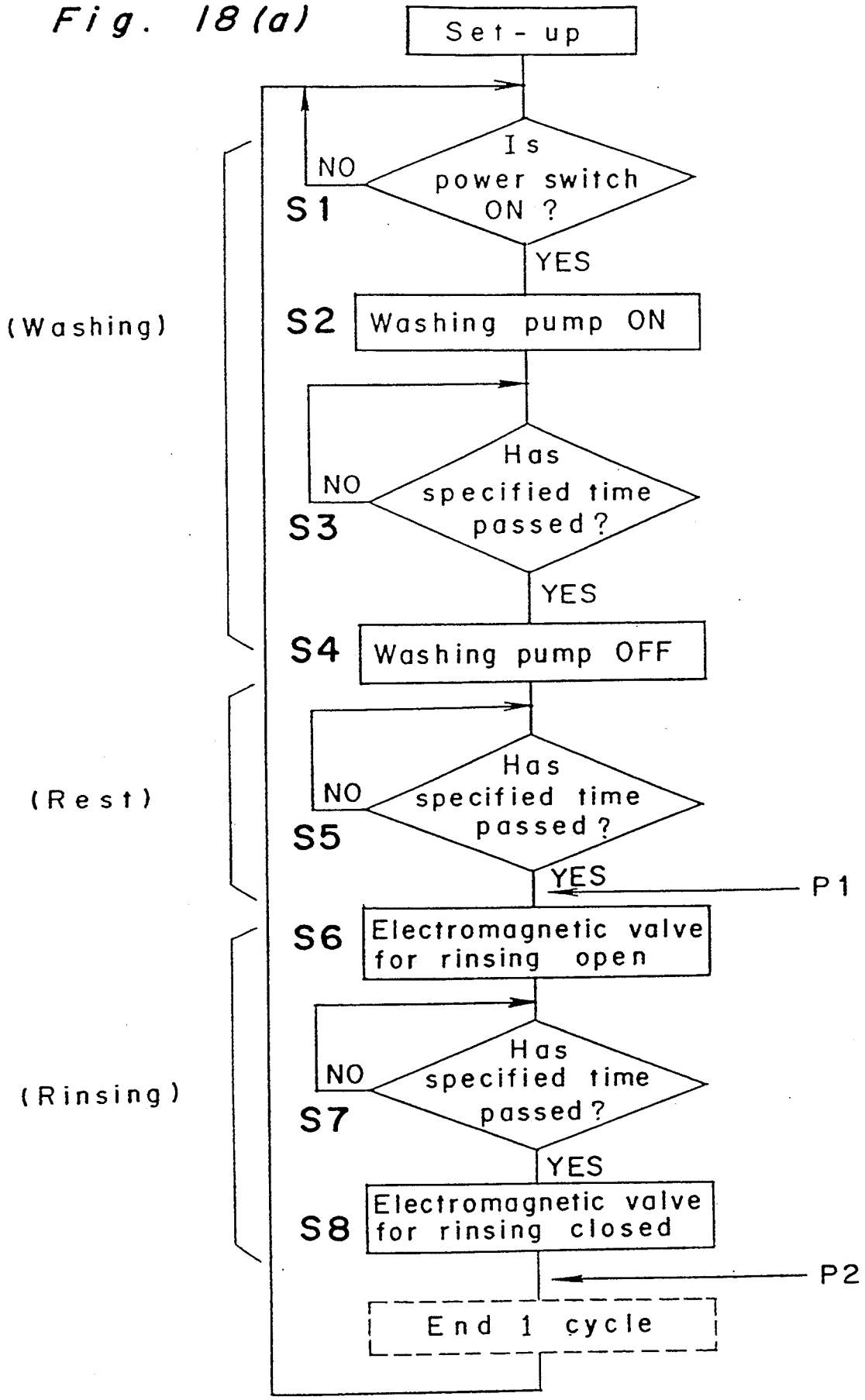
FIGS. 18 (*a*) and (*b*) are flow charts showing operation of the dishwasher of the above embodiments of undercounter type.
Figure 18B:
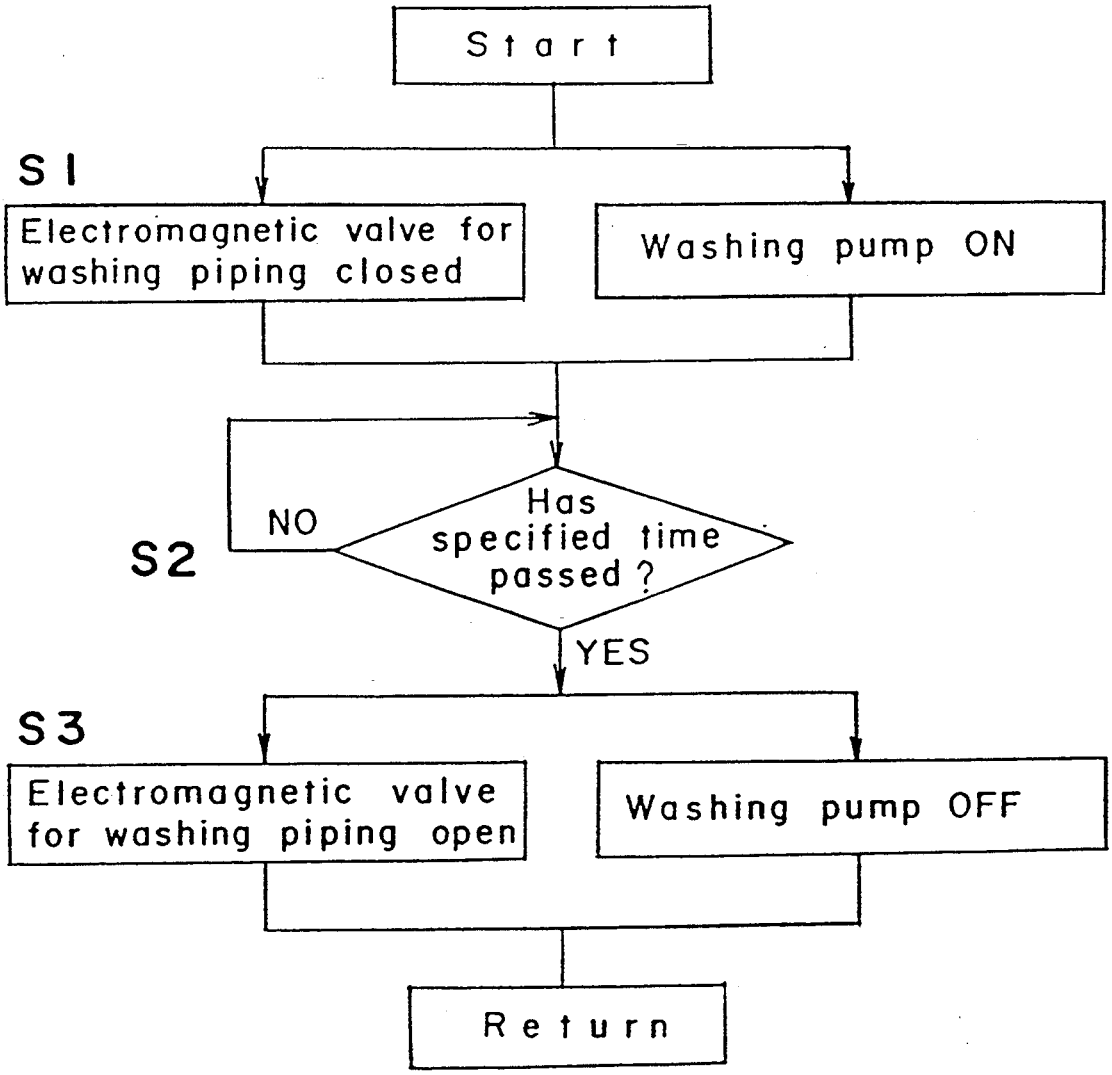

Referring to FIG. 13, the controller 9, according to the program, makes the electromagnetic switch valve 20 closed during a certain idle interval subsequent to the washing process by the washing pump 29 or upon completion of the rinsing process (see P1 and P2 in FIG. 18 (*a*)), and actuates the washing pump 29 (see S1 in FIG. 18 (*b*)). Then the detergent C discharged from the washing pump 29 drives the diaphragm pump 3 without being transferred to the washing arms 23, 24, thereby allowing a certain quantity of the sticking inhibitor A having previously sucked in the diaphragm pump 3 to be sprayed from the spray nozzles 18 through the check valve 5 toward the dishes B. After a certain time elapses, the controller 9 stops the washing pump 29 and opens the electromagnetic switch valve 20 (see S2 and S3 in FIG. 18 (*b*)).

When the above operations are performed upon completion of the rinsing process, the sticking inhibitor A can be applied uniformly to the clean surfaces of the dishes B washed through, while when it is done during the idle interval, similar application can be carried out although the sticking inhibitor may be missed in a little quantity in the succeeding rinsing process. Accordingly, the principal effect previously mentioned can be obtained that the remaining rice sticking to dish surfaces can readily be removed merely by washing with the dishwasher, realizing the reduction in time and labor in washing dishes. In addition, in the example of FIG. 13, since the liquid-pressure-operated diaphragm pump 3 is employed, the dishwasher can be reduced in cost and size, advantageously.

In the variation of FIG. 14, since the electric diaphragm pump 8 controlled by the controller 9 is employed, the dishwasher can provide an advantage that the timing of spraying the sticking inhibitor A can discretionally and readily be set without the electromagnetic switch valve 20, in addition to the principal effect of those examples described above.

In the fourth dishwasher constructed as above (see FIG. 17), the controller 9 makes the electromagnetic switch valve 43 opened during the idle interval between the washing and rinsing processes or upon completion of the rinsing process (see P1 and P2 in FIG. 18 (*a*)). Then, into the water pumped to the water piping 41 through the electromagnetic switch valve 43, the sticking inhibitor A is sucked through the piping 44 by the ejector 10, the resulting water-diluted sticking inhibitor being sprayed from the spray nozzles 18 toward the dishes B. Thus, as in the case described referring to FIG. 13, the principal effect can be obtained that the remaining rice sticking to the surfaces of dishes washed through can readily be removed merely by washing with the dishwasher, allowing the time and labor for washing dishes to be reduced. In addition, in the example of FIG. 17, since the diaphragm pump 3 in FIG. 13 is omitted and the ejector 10 is provided to the water piping 41, the sticking inhibitor A can continuously be added to water during the water supply period, thus further advantageously allowing the cost and size of the dishwasher to be reduced further.

In the variation of FIG. 15, since the ejector 10 is substituted by the water reservoir 45 to which the sticking inhibitor A is supplied by the diaphragm pump 3 driven by discharge pressure of the washing pump 29, the dishwasher can advantageously be reduced in cost and size by virtue of its omission of the pump driving source in addition to the above-described principal effect. Further, in the variation of FIG. 16, since the diaphragm pump 3 in FIG. 15 is substituted by the electric diaphragm pump 8 controlled by the controller 9, the timing of adding the sticking inhibitor A can discretionally and readily be set to advantage in addition to the above-described principal effect.

FIG. 18 (*a*) is a flow chart comprehensively showing the operation sequence of the undercounter type dishwashers (see FIGS. 1, 3, 5, 7, 9, 11, 13, and 14 through 17).

In the above dishwashers, when a power switch is turned on at step S1, the washing pump 29 is turned on at step S2, and the detergent C is sprayed from the washing arms 23, 24 toward the dishes B, the washing process starting. Then, in the cases of the dishwashers of FIGS. 1, 7, and 15, the diaphragm pump 3 discharges the sticking inhibitor A previously sucked therein to the detergent C at the bottom of the washing chamber 22, the rinsing warm water W in the electric water heater 32 or water W' in the water reservoir 45 by discharge pressure of the washing pump 29, while in the case of the dishwasher of FIG. 5 the sticking inhibitor A is sucked in the detergent C flowing through the washing piping 30 by the ejector 10. Next, when a specified time period has elapsed at step S3, the washing pump 29 is turned off at step S4, terminating the washing process. At this point, the diaphragm pump 3 sucks in itself another batch of sticking inhibitor A from the reservoir 1 by the back spring 6, and the ejector 10 terminates the suction of sticking inhibitor A. Thereafter, in the dishwashers of FIGS. 1 and 5, the sticking inhibitor A is added to the detergent C in the washing process so as to be applied to the dishes B. In the case of the dishwasher of FIG. 3, the controller allows the electric diaphragm pump 8 to be operated at any discretionary timing within the cycle of FIG. 18 (*a*) so as to add the sticking inhibitor A to the detergent C, where the application thereof to the dishes B is made during the washing process, as in the above case.

Subsequently, a specified idle interval is counted at step S5 with the dishwasher out of operation. At time point P1 when the specified idle interval has just elapsed, in the cases of the dishwashers of FIGS. 13, 14, 15, and 17, the controller 9 in FIG. 13 goes into a subroutine shown in FIG. 18 (*b*), the controller 9 in FIG. 14 puts the electric diaphragm pump 8 into discharge operation, and the controller 9 in each of FIGS. 15 and 17 opens the electromagnetic switch valve 43. Then, in the dishwasher of FIG. 13, according to the above-mentioned subroutine (S1 to S3 in FIG. 18 (*b*)), the sticking inhibitor A in the reservoir 1 is sprayed from the spray nozzles 18 to the dishes B by the liquid-pressure-operated diaphragm pump 3, while in the dishwashers of FIGS. 14 and 15 the sticking inhibitor A is sprayed directly, or as diluted with water, from the spray nozzles 18 or spray nozzles 42 to the dishes B. As a result, in these dishwashers, the sticking inhibitor A is sprayed and applied to the dishes B between the washing and rinsing processes. Incidentally, in the dishwasher of FIG. 16, the controller 9 allows the electric diaphragm pump 8 to be operated at any discretionary timing within the cycle of FIG. 18 (*a*) so as to apply the sticking inhibitor A to the water W', where the application thereof to the dishes is made during the idle interval with the electromagnetic switch valve 43 open, as in the above case.

After that, the electromagnetic valve 31 for rinsing use is opened at step S6, and the rinsing warm water W passing through the electric water heater 32 is sprayed from the rinsing arms 25, 26 to the dishes B, thus starting the rinsing process. Then, in the dishwasher of FIG. 7, the sticking inhibitor A has already been added to the rinsing warm water at step S2, while in the dishwasher of FIG. 11, the sticking inhibitor A is sucked in the rinsing warm water W flowing through the rinsing piping 33 by the ejector 10. Next, when a specified rinsing time has elapsed at step S7, the electromagnetic valve 31 for rinsing use is closed at step S8, terminating the rinsing. As a result, in the dishwashers of FIGS. 7 and 11, the sticking inhibitor A is added to the rinsing warm water W so as to be applied to the dishes B in the rinsing process. Incidentally, in the dishwasher of FIG. 9, the controller 9 allows the electric diaphragm pump 8 to be operated at any discretionary timing within the cycle of FIG. 18 (*a*) so as to apply the sticking inhibitor A to the rinsing warm water W', where the application thereof to the dishes is made during the rinsing process with the electromagnetic switch valve 43 open, as in the above case.

In addition, at time point P2 upon completion of the rinsing process at step S8 rather than at time point P1, if the same operation as described for time point P1 is executed in the dishwashers of FIGS. 13, 14, 15, 16, and 17, the sticking inhibitor A is sprayed and applied to the dishes B upon completion of the rinsing process.

Figure 19:
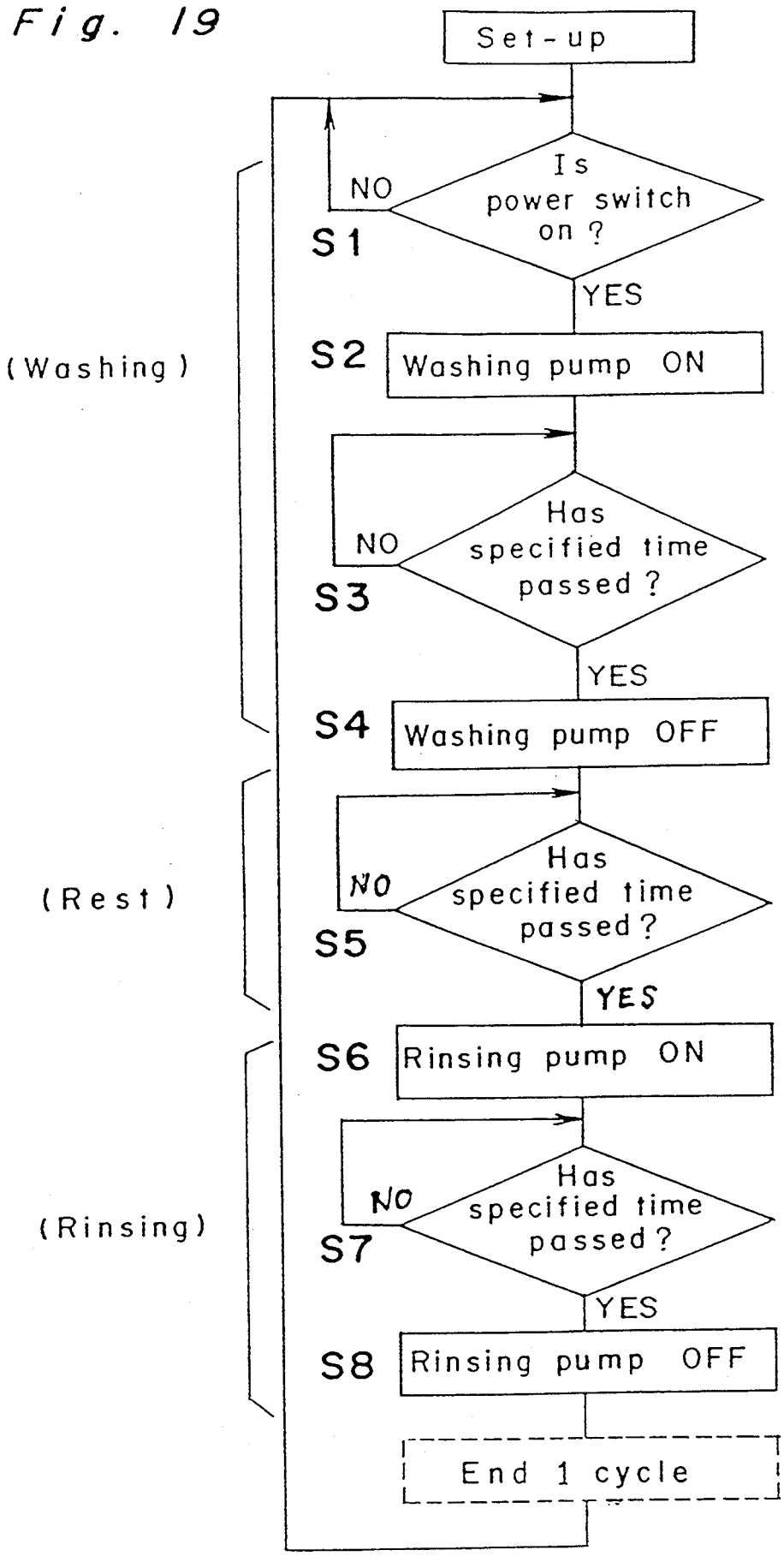
FIG. 19 is a flow chart showing operation of the dishwasher of the above embodiment of door type.

On the other hand, FIG. 19 is a flow chart comprehensively showing the operation sequence of the above-mentioned door type dishwashers (see FIGS. 2, 4, 6, 8, 10, and 12).

In the above dishwashers, when a power switch is turned on at step S1, the washing pump 29 is turned on at step S2, and the detergent C is sprayed from the washing arms 23, 24 toward the dishes B, the washing process starting. In doing this, in the dishwashers of FIGS. 2 and 8, the diaphragm pump 3 discharges the sticking inhibitor A previously sucked therein to the detergent C in the washing reservoir 13 or the rinsing warm water W in the gas water heater 14 by discharge pressure of the washing pump 29, while in the dishwasher of FIG. 6, the sticking inhibitor A is sucked in the detergent C flowing through the washing piping 30 by the ejector 10. Next, when a specified washing time has elapsed at step S3, the washing pump 29 is turned off at step S4, terminating the washing process. Thus, in the dishwashers of FIGS. 2 and 6, the sticking inhibitor A is added to the detergent C so as to be applied to the dishes in the washing process. Incidentally, in the dishwashers of FIG. 4 the controller 9 allows the electric diaphragm pump 8 to be operated at any discretionary timing within the cycle of FIG. 19 so as to add the sticking inhibitor A to the detergent C, where the application thereof to the dishes B is made during the washing process, as in the above case.

Subsequently, when a specified idle interval is counted up at step S5, the rinsing pump 16 is turned on at step S6, and the rinsing warm water W coming from the gas water heater 14 is sprayed from the rinsing arms 25, 26 to the dishes B, starting the rinsing process. At this time point, in the dishwasher of FIG. 8, the sticking inhibitor A has already been added to the rinsing warm water W at step S2, while in the dishwasher of FIG. 12, the sticking inhibitor A is sucked in the rinsing warm water W flowing through the rinsing piping 33 by the ejector 10. Next, when it is judged that a specified rinsing time has elapsed at step S7, the rinsing pump 16 is stopped at step S8, terminating the rinsing. Thus, in the dishwashers of FIGS. 8 and 12, the sticking inhibitor A is added to the rinsing warm water W so as to be applied to the dishes B during the rinsing process. Incidentally, in the dishwasher of FIG. 10, the controller 9 allows the electric diaphragm pump 8 to be operated at any discretionary timing within the cycle of FIG. 19 so as to add the sticking inhibitor A to the rinsing warm water W, where the application thereof to the dishes B is made during the rinsing process with the rinsing pump 16 in operation, as in the above case.

As described heretofore, if the sticking inhibitor A of the present invention is used with any dishwasher of FIGS. 1 through 17, any of the dish washing methods of the present invention can be put into practice and such a principal effect is produced that even if rice left uneaten on the dishes B once washed through is dried, the rice can readily be removed merely by washing with the dishwasher without pretreatment of bath immersion as would conventionally take time and labor to a substantial extent. This leads to realization of labor-saving, time-saving dish washing.

Figure 21:
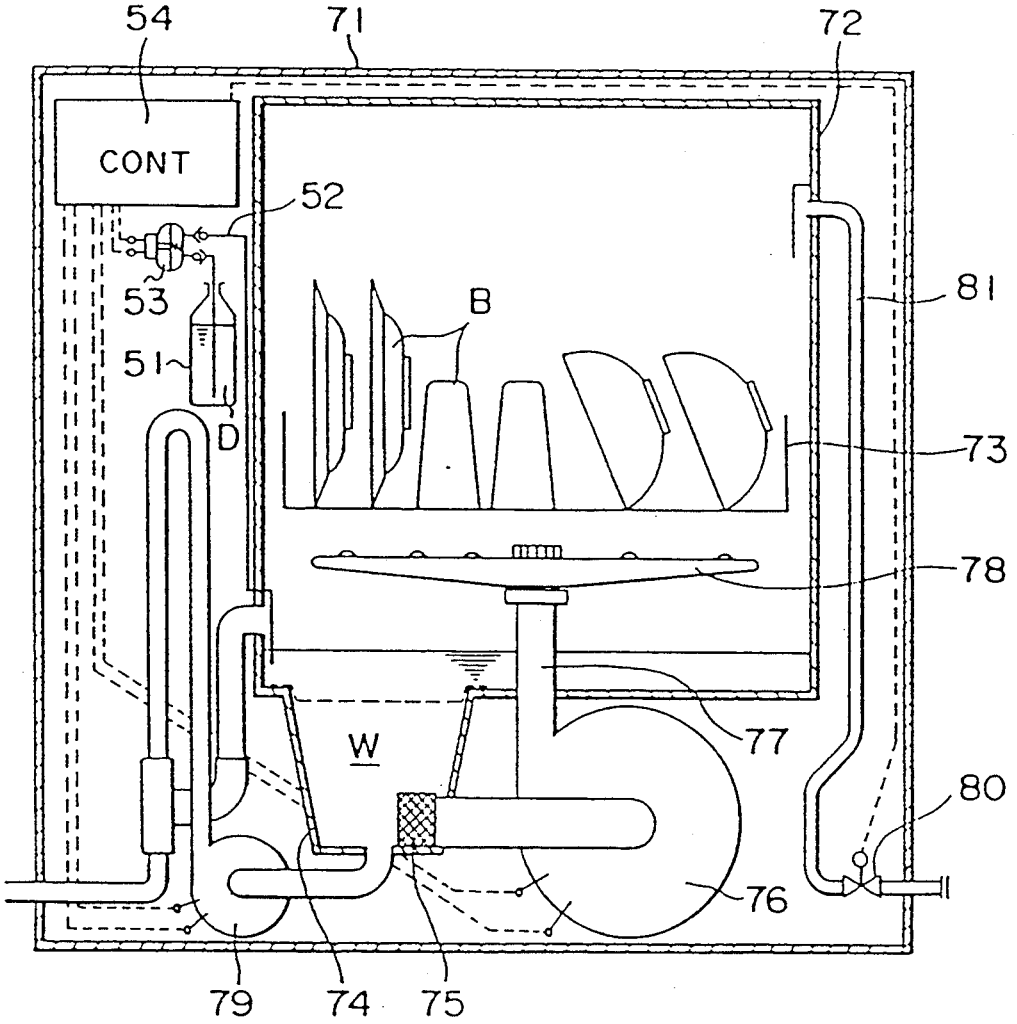
FIG. 21 is a longitudinal sectional view for showing a dishwasher of an embodiment of the present invention.
Figure 22:
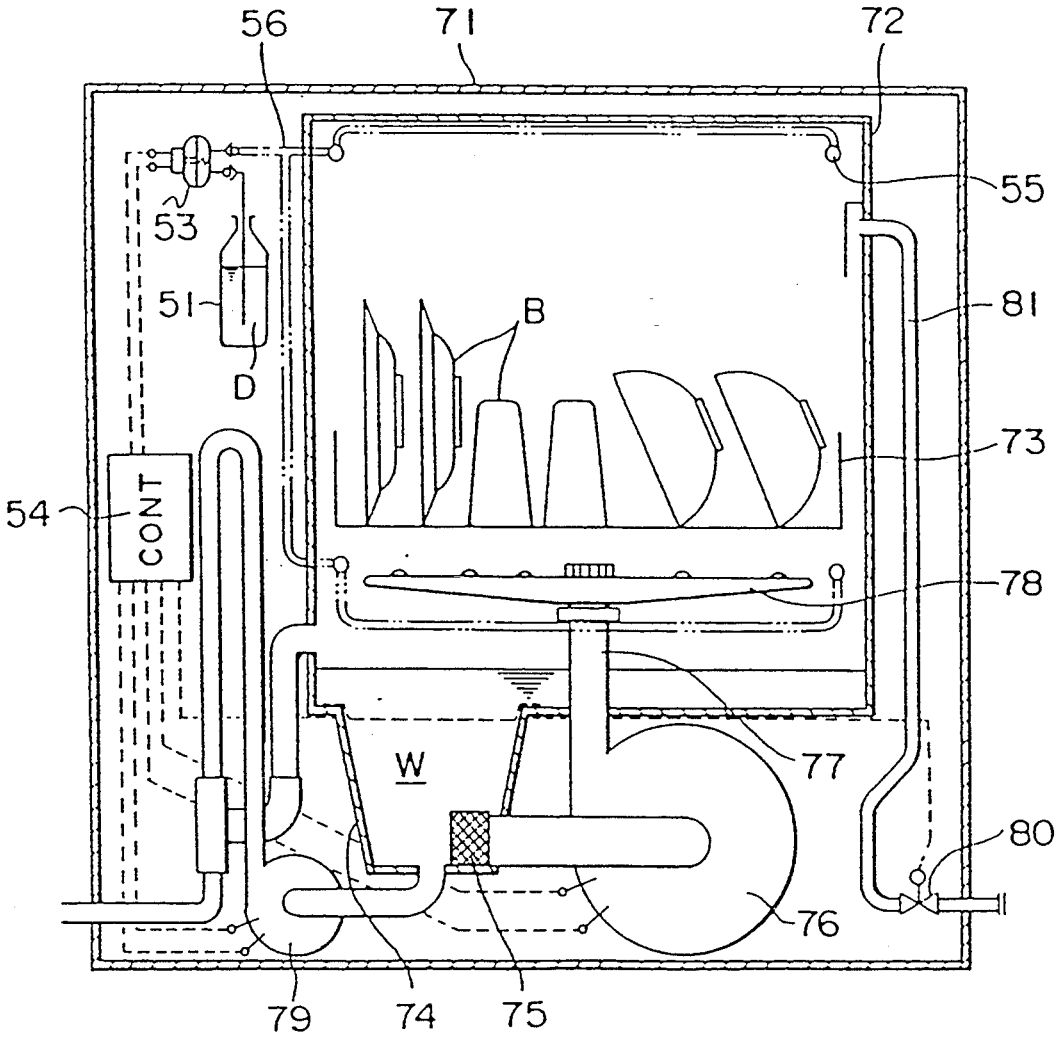
FIG. 22 is a similar longitudinal sectional view.
Figure 23:
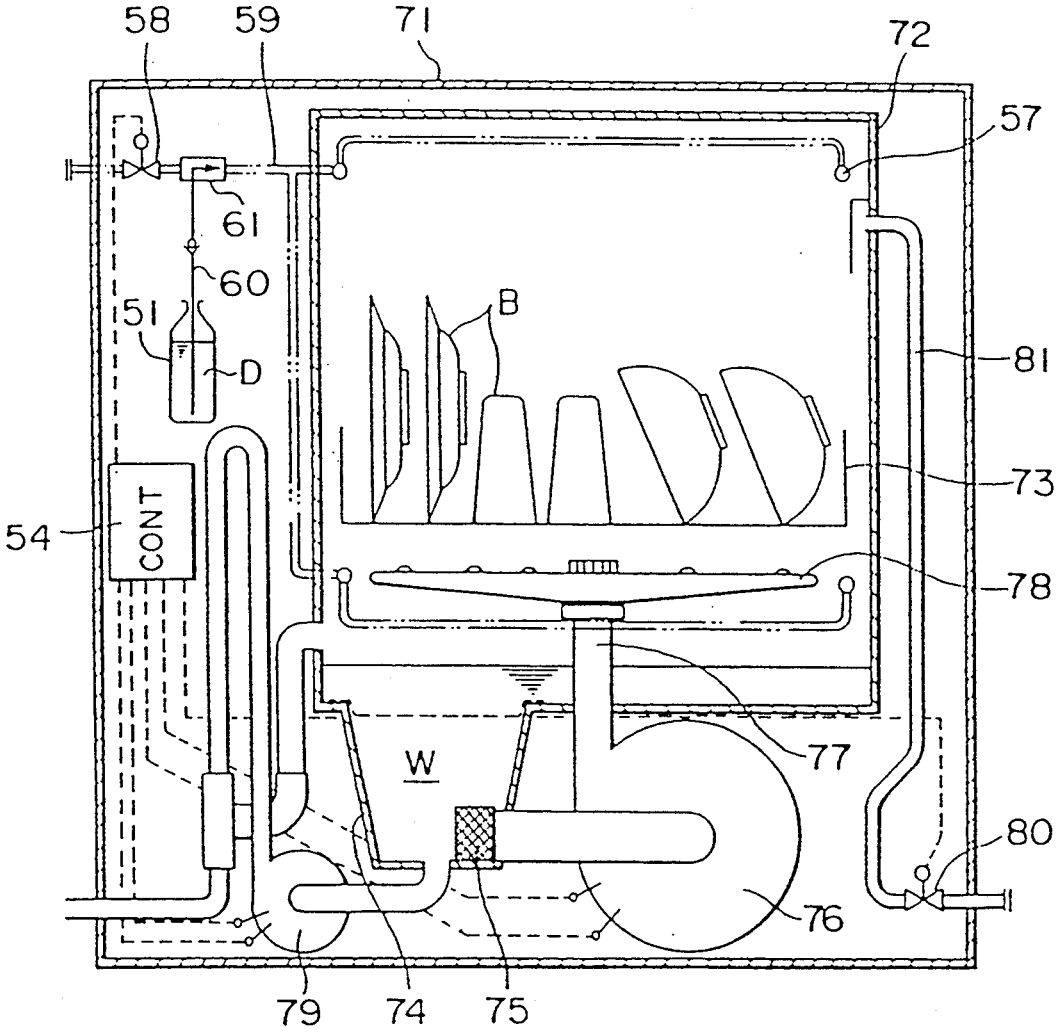
FIG. 23 is a similar longitudinal sectional view.
Figure 24:
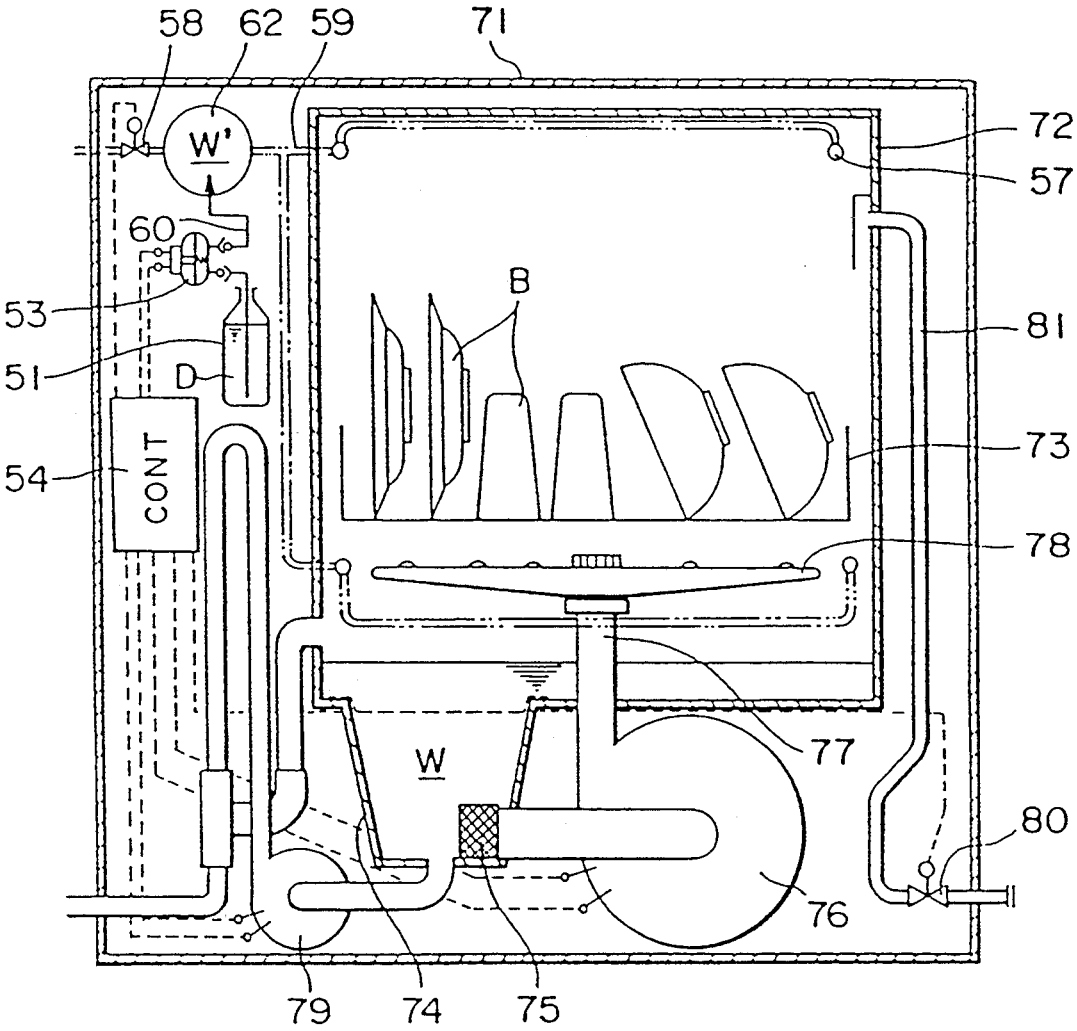
FIG. 24 is a similar longitudinal sectional view.

FIG. 21 is a longitudinal sectional view of a fifth dishwasher used for the dish washing method by which a rinsing assistant is added to rinsing warm water in the rinsing process so as to be applied to dishes, while FIGS. 22 to 24 are longitudinal sectional views of sixth to eighth dishwashers used for the dish washing method by which the above-mentioned rinsing assistant is sprayed and applied to dishes upon completion of the rinsing process. These dishwashers are similar in basic construction to the conventional household-use one described referring to FIG. 28, and additionally provided with a reservoir 51 having a rinsing assistant D stored therein and means for supplying the rinsing assistant. Accordingly, throughout the drawings, like members are indicated by like numerals.

Figure 28:
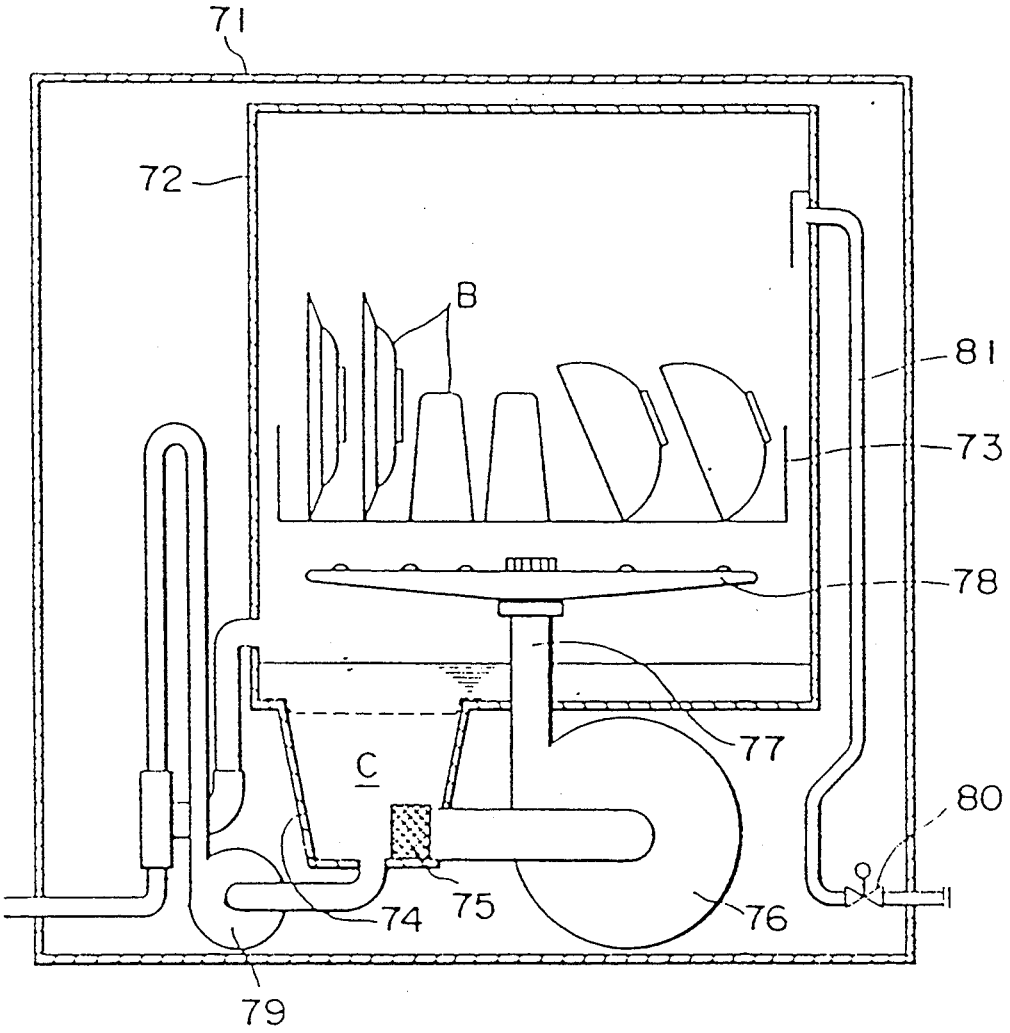
Fig. 28 PRIOR ART
FIG. 28 is a longitudinal sectional view showing a conventional household-use dishwasher.

The fifth dishwasher of FIG. 21 is provided, in addition to the conventional dishwasher described on FIG. 28, with the reservoir 51 having the rinsing assistant D stored therein, a passageway 52 for leading the rinsing assistant D in the reservoir 51 to the reservoir 74 at the bottom of the washing chamber 72, and an electric diaphragm pump 53 for pumping the rinsing assistant D to the passageway 52 by control of the controller 54. The controller 54 sequentially controls the above-mentioned electric diaphragm pump 53, circulating pump 76, drain pump 79, and electromagnetic valve 80 according to the control program as the washing process goes on.

More specifically, the controller 54 makes the electromagnetic valve 80 open so as to supply water fully to the reservoir 74 in which a detergent was previously stored, thereafter drives the circulating pump 76 for a specified time period thereby to effect the washing process, and then drives the drain pump 79 thereby to drain the reservoir 74. Next, it makes the electromagnetic valve 80 open so as to supply fresh water W fully to the reservoir 74, thereafter drives the circulating pump 76 thereby to effect rinsing, and then drives the drain pump 79 thereby to drain water. This sequence of rinsing operation is repeated several times (for example, four times). Before the last water supply, during the supply, after the full implementation of the supply, or during the rinsing, the electric diaphragm pump 53 is driven to supply a specified amount of rinsing assistant D through the passageway 52 to the water in the reservoir 74 (see FIG. 26).

In addition, if the previously described sticking inhibitor A is stored in the reservoir 51 in place of the rinsing assistant D, and if the electric diaphragm pump 53 is driven by the controller 54 during the washing process or the rinsing process, the sticking inhibitor can be applied to dishes as in the dishwashers referred to in conjunction with FIGS. 1 to 12.

On the other hand, the sixth dishwasher of FIG. 22 includes, as means for supplying the rinsing assistant D, spray nozzles 55 exclusively for spraying the rinsing assistant D disposed above and below in the washing chamber 72, and a diaphragm pump 53 for supplying the rinsing assistant D in the reservoir 51 to the above-mentioned spray nozzles 55 through spray piping 56. The diaphragm pump 53 is controlled by the same controller 54 as described above after completion of the sequence of the rinsing process so as to spray the rinsing assistant D uniformly to the surfaces of cleaned dishes B.

Moreover, the seventh dishwasher of FIG. 23 includes, as means for supplying the rinsing assistant D, water piping 59 having at its ends spray nozzles 57 for spraying water toward the dishes B from above and below and at its base end an electromagnetic valve 58; agent piping 60 communicated with the reservoir 51; and an ejector 61 provided to an end of the piping 60 with a check valve interposed therebetween so as to be positioned within the water piping 59, wherein the electromagnetic valve 58 is open-controlled by the controller 54 after the completion of the sequence of rinsing process.

Further, the eighth dishwasher of FIG. 8 includes a water reservoir 62 at the position of the ejector 61 of the seventh dishwasher of FIG. 23 as a substitute therefor, wherein the rinsing assistant D is supplied to the above-mentioned water reservoir 62 by an electric diaphragm pump 53 provided in the course of the agent piping 60, and the electric diaphragm pump 53 and electromagnetic valve 58 are controlled also by the controller 54.

In addition, if the reservoir 51 of the sixth to eighth dishwashers has the previously described sticking inhibitor A stored therein in place of the rinsing assistant D and if the above supply means are operated by the controller 54 between the washing and rinsing processes or upon completion of the rinsing process, the sticking inhibitor can be applied to dishes as in the dishwashers described in conjunction with FIGS. 13, 14, and 17.

Figure 26:
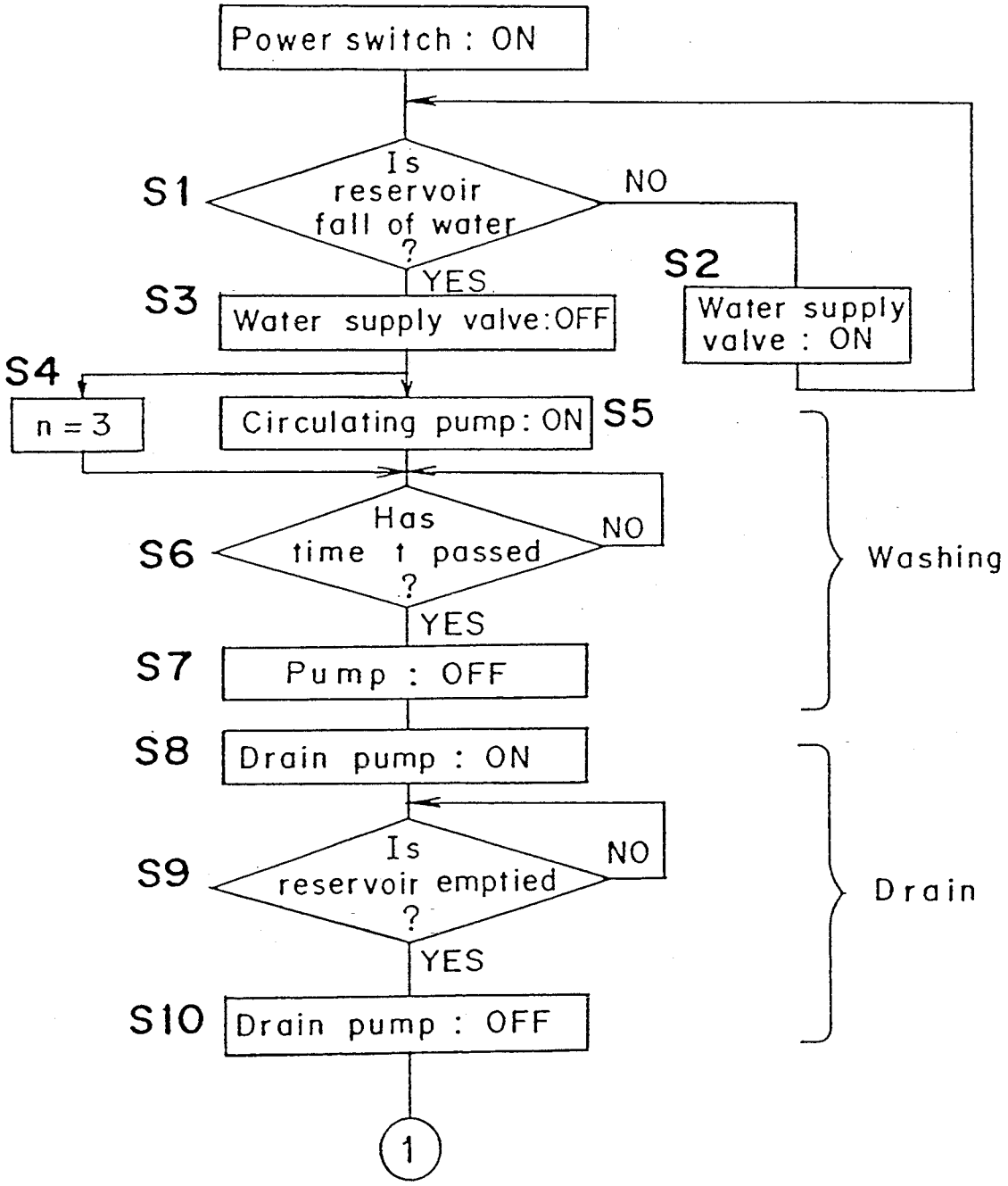
FIGS. 26 (*a*) and (*b*) are flow charts showing operation of the dishwasher of the above-mentioned embodiment.
Figure 26:
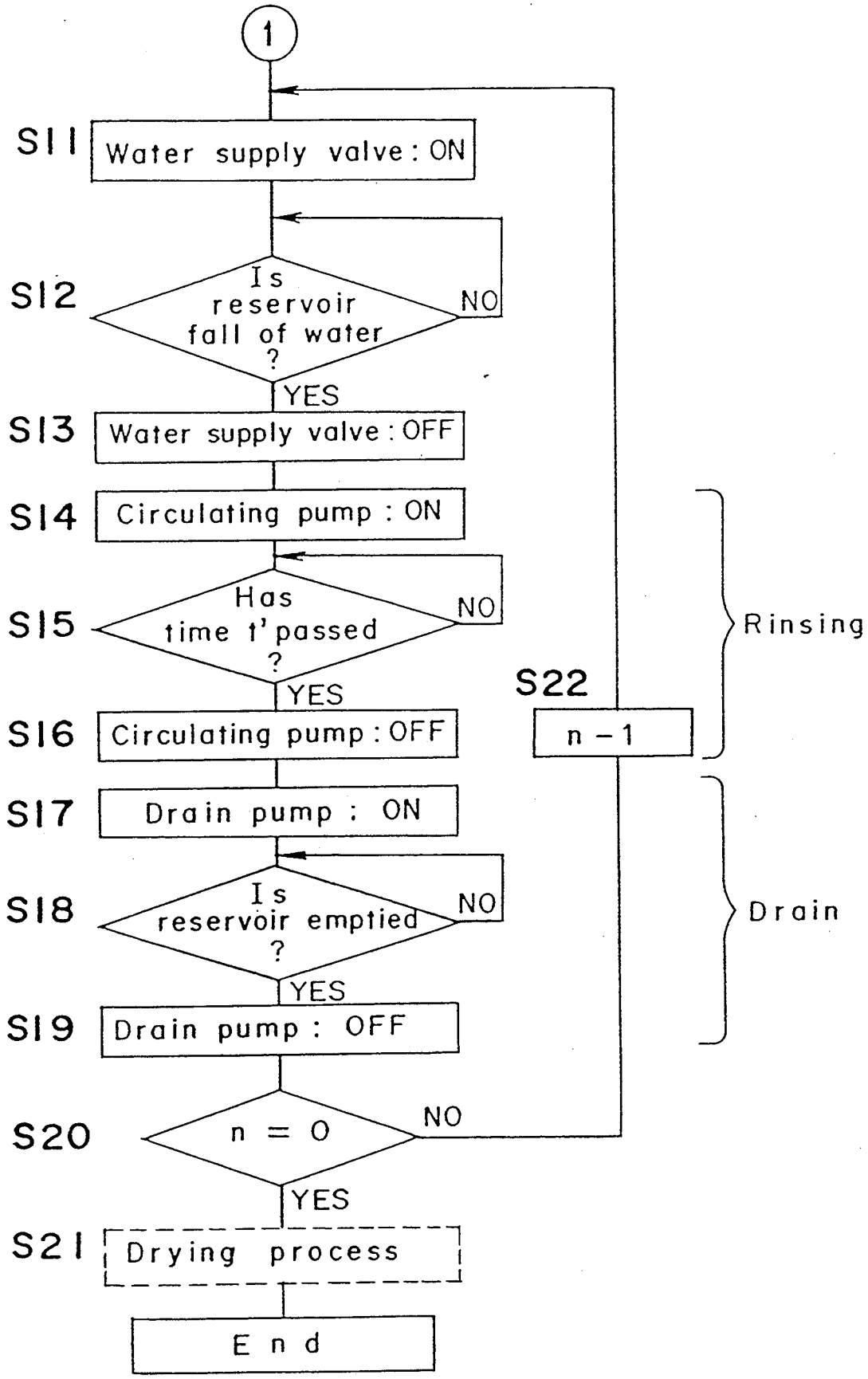

The method for adding the rinsing assistant to rinsing warm water so as to be applied to dishes in the rinsing process with the fifth dishwasher constructed as above is now explained with reference to the flow chart in FIG. 21 and FIGS. 26(*a*) and (*b*).

In the above dishwasher, when the power switch is turned on, it is decided whether or not the reservoir 74 having previously the detergent stored therein is filled with water to the full at step S1. Then, the electromagnetic valve 80 kept open until the reservoir 74 is filled with water to the full (see steps S2 and S3). Then, the number of times n for rinsing is set to 3 at step S4, the circulating pump 76 is driven for a specified time period t at step S5, and the detergent is sprayed from the arms 78 toward dishes B, thus carrying out the washing process (see steps S6 and S7). With the washing process over, the drain pump 79, which is a means for draining water, is driven until the reservoir 74 is emptied, thus carrying out the drain process (see steps S8, S9, and S10).

Further, the sequence of the rinsing process from step S11 to S20 is repeated four times. That is, the electromagnetic valve 80 is held open until the reservoir 74 is filled with water to the full, thereby supplying fresh water to the reservoir 74 (see steps S11 to S13). In this case, the fresh water may be either tap water or warm water resulting from heating the tap water by a heater or the like. Next, the circulating pump 76 is driven for a specified time period t' at step S14 so that the fresh water is sprayed from the arm 78 toward the dishes B, thus carrying out the rinsing process (see steps S14 to S16). In the last cycle of the repeated sequence of rinsing process, i.e. in the fourth process, the controller 54 drives the electric diaphragm pump 53 before the water supply (immediately before step S11), during the supply (S11), after the full implementation of the supply (S13), or during the rinsing (S14) so that the rinsing assistant D stored in the reservoir 51 is supplied to the fresh water in the reservoir 74 through the passageway 52.

By this operation, the rinsing assistant D contained in the fresh water is applied to the surfaces of dishes B on which the detergent is already absent. This rinsing assistant D produces such a sticking prevention effect that rice left uneaten on the dishes once washed through will be unlikely to stick to the surfaces of the dishes, while it will prevent stains and water spots from being left on the surfaces of rinsed dishes, and moreover give an excellent gloss thereto. Further, in the dishwasher, since the rinsing assistant also serving for sticking prevention is added to rinsing water in the rinsing process, it is unnecessary to provide a reservoir or piping for separately adding a sticking inhibitor and moreover an independent application process therefor can be eliminated, thus allowing both the washing work and the dishwasher system to be simplified. Each sequence of rinsing process comes to an end with the drain process in which the drain pump 79 is driven until the rinsing water is emptied out of the reservoir 74 (see steps S17 to S19), and the number of repetitions of the rinsing process is determined at step S20. In this determination, if the repetition number is not more than 3 ($n \geqq 1$), the number n is decremented by 1, the dishwasher returns to step S11, while it reaches four ($n=0$), the dishwasher leaves the repetition loop, passes through the drying process (see step S21), and terminates the operation.

Referring to the method for spraying the rinsing assistant to dishes so as to be applied thereto with the sixth to eighth dishwashers (FIGS. 22 to 24) constructed as above, the operation of each dishwasher is the same as described above, differing only in that the timing of control of the controller 54 is upon completion of the rising process. That is, the controller 54 drives the electric diaphragm pump 53 (see FIG. 22) or the electromagnetic valve 58 (see FIG. 23) or both of them (see FIG. 24) immediately before step S21 in the flow chart (FIGS. 26 (*a*) and (*b*)), whereby the rinsing assistant D is sprayed from the spray nozzles 55 through the spray piping 56, or from the spray nozzles 57 through the water piping 59 toward the dishes B.

In consequence, the rinsing assistant D can be applied uniformly to the clean surfaces of dishes rinsed through, and the rinsing assistant applied thereto produces the same effects of sticking prevention and water spot prevention as well as imparting a gloss as described above.

As is apparent from the foregoing description, the sticking inhibitor of the present invention is strongly adsorbed to dish surfaces by its hydrophilic groups in hydrogen bond, while it is weakly adsorbed to food such as rice primarily by dispersion force between nopolar molecules by its hydrophobic groups, thus causing food to be unlikely to stick to dish surfaces and moreover even allowing food stuck thereto to be readily removed therefrom by washing. In addition, if the aforementioned sticking inhibitor is a compound having perfluoroalkyl groups or fluoroalkyl phosphoric ester salt, more enhanced effect is obtained for removing food by washing.

On the other hand, the rinsing assistant of the present invention, having hydrophilic groups and hydrophobic groups, is adsorbed to dish surfaces by its hydrophilic groups in the application thereof, while it is adsorbed to food surfaces by its hydrophobic groups appearing to the surfaces after being dried. Thus, if it is applied to dish surfaces, it produces the sticking prevention function by which food left uneaten on the dishes is readily removed therefrom, as well as the rinsing enhancement function.

Further, a dish washing method of the present invention is so arranged that the aforementioned sticking inhibitor is added to the detergent in the washing process or added to the rinsing warm water in the rinsing process so as to be applied to dishes, or it is sprayed to dishes between the washing and rinsing processes or upon completion of the rinsing process so as to be applied thereto. Thus, rice left uneaten on the dishes washed through is made unlikely to stick to the dishes, and moreover even if it sticks, it can readily be removed from the dishes without pretreatment of bath immersion, allowing the work of dish washing, especially as a business matter, to be reduced in time and labor.

On the other hand, another dish washing method of the present invention is so arranged that the aforementioned rinsing assistant is added to rinsing warm water or the like in the rinsing process so as to be applied to dishes, or it is sprayed upon completion of the rinsing process so as to be applied to dishes. Thus, it produces water spot prevention effect and gloss impartment effect, in addition to the aforementioned sticking prevention effect, allowing the washing work to be simplified.

Further, a dishwasher of the present invention is adapted to carry out either of the above dish washing methods using the above sticking inhibitor. Thus, food stuck to washed dishes can readily be removed therefrom without pretreatment, allowing the work of dish washing, particularly as a business matter, to be reduced in time and labor.

On the other hand, another dishwasher of the present invention is adapted to carry out the aforementioned other dish washing method, in either form, using the aforementioned rinsing assistant. Thus, it can prevent water spots from arising on washed dishes and moreover impart a satisfactory gloss to dishes, while food sticking to washed dishes can readily be removed, allowing the work of dish washing, particularly as a household matter, to be reduced in time and labor.

The invention being thus described, it will be obvious that the same may be varied in many ways. Such variations are not to be regarded as a departure from the spirit and scope of the invention, and all such are intended to be included within the scope of the following claims.

What is claimed is:

1. A dishwasher so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes; and a passageway for joining the sticking inhibitor in the reservoir with said detergent, wherein said sticking inhibitor contains a compound comprising a fluoroalkyl group having hydrophilic groups and hydrophobic groups, said compound being adsorbed to the surfaces by said hydrophobic groups.

2. A dishwasher so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes; and a passageway for joining the sticking inhibitor in the reservoir with said detergent, wherein said sticking inhibitor comprises a compound including at least one polymer selected from the group consisting of phosphate esters having a perfluoroalkyl group, a homopolymer of an acrylate or methacrylate having a fluoroalkyl group and a hydrophilic group and a copolymer comprising (a) a repeating unit derived from an acrylate or methacrylate having a fluoroalkyl group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide.

3. The dish washer as claimed in claim 2, wherein said copolymer further comprises a repeating unit derived from at least one polymerizable compound having no fluoroalkyl group selected from the group consisting of ethylene, vinyl chloride, vinylidene halogenide, styrene, acrylic acid and its alkyl esters, methacrylate and its alkyl esters, benzyl methacrylate, vinyl alkyl ketone, vinyl alkyl ether, butaxdiene, isoprene, chloroprene and maleic anhydride.

4. A dishwasher so arranged that dishes are accommodated on a rack provided in a washing chamber, a detergent at the bottom of the washing chamber is sprayed from washing arms through washing piping toward the dishes by a washing pump, and warm water from a water heater is sprayed from rinsing arms through rinsing piping toward the dishes, thereby washing the dishes, the dishwasher comprising:

a reservoir for storing therein a sticking inhibitor for making food easy to remove from the dishes; and a passageway for joining the sticking inhibitor in the reservoir with said detergent, wherein said rinsing assistant includes hydrophilic and hydrophobic groups and contains, as an active ingredient, at least one polymer selected from the group consisting of a homopolymer of an acrylate or methacrylate having a fluoroalkyl group and a hydrophilic group and a copolymer comprising (a) a repeating unit derived from an acrylate or methacrylate having a fluoroalkyl group and (b) a repeating unit derived from at least one compound selected from the group consisting of acrylic acid, methacrylic acid, acrylonitrile, methacrylonitrile, an acrylate and a methacrylate having a hydrophilic group, acrylamide and methacrylamide, such that said rinsing assistant is adsorbed to the surfaces of the dishes by the hydrophobic groups.

* * * * *